US012595604B2

(12) United States Patent
Sawada et al.

(10) Patent No.: US 12,595,604 B2
(45) Date of Patent: Apr. 7, 2026

(54) SEWING DEVICE

(71) Applicant: YKK Corporation, Tokyo (JP)

(72) Inventors: Toshiaki Sawada, Toyama (JP); Takayoshi Tanaka, Toyama (JP); Hitomi Nishida, Toyama (JP); Harumi Takagishi, Toyama (JP); Takafumi Oba, Toyama (JP); Takuma Kawato, Toyama (JP); Norihiro Takagi, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 18/724,683

(22) PCT Filed: Dec. 28, 2021

(86) PCT No.: PCT/JP2021/048736

§ 371 (c)(1),
(2) Date: Feb. 14, 2025

(87) PCT Pub. No.: WO2023/127074

PCT Pub. Date: Jul. 6, 2023

(65) Prior Publication Data

US 2025/0179707 A1 Jun. 5, 2025

(51) Int. Cl.

| | |
|---|---|
| ***D05B 35/06*** | (2006.01) |
| ***D05B 23/00*** | (2006.01) |
| ***D05B 33/00*** | (2006.01) |

(52) U.S. Cl.
CPC ..... *D05B 35/064* (2013.01); *D05B 23/00* (2013.01); *D05B 33/006* (2013.01)

(58) Field of Classification Search
CPC ..... D05B 23/00; D05B 35/06; D05B 35/10; D05B 39/00; D05B 33/00; D05B 35/0064
See application file for complete search history.

(56) References Cited

U.S. PATENT DOCUMENTS 3,765,348 A 10/1973 Jabor et al.
4,541,352 A 9/1985 Boser et al.
(Continued)

FOREIGN PATENT DOCUMENTS

CN 110158242 A 8/2019
CN 111836923 A 10/2020
(Continued)

OTHER PUBLICATIONS

International Search Report, PCT Patent Application No. PCT/JP2021/048736, Mar. 22, 2022, 5 pages.
(Continued)

*Primary Examiner* — Danny Worrell
(74) *Attorney, Agent, or Firm* — Kilpatrick Townsend & Stockton LLP

(57) ABSTRACT

A sewing device includes: a fly base on which a fly is to be placed; a fastener base on which a fastener is to be placed; a first conveying device configured to convey the fly on the fly base; a first sewing machine configured to perform edge overcasting on the fly during conveyance by the first conveying device; a supplying and conveying device configured to supply the fastener from the fastener base onto the fly, on which the edge overcasting is finished, in an overlapped manner, and configured to convey the fly and the fastener together; and a second sewing machine configured to sew the fly and the fastener during conveyance aby the supplying and conveying device.

5 Claims, 41 Drawing Sheets

(56) References Cited

U.S. PATENT DOCUMENTS 4,979,450 A * 12/1990 Dudek ..... D05B 35/064 112/113
5,067,424 A * 11/1991 Ishikawa ..... D05B 35/064 112/113
5,069,148 A * 12/1991 Ishikawa ..... D05B 35/102 112/113
5,161,474 A * 11/1992 Ishikawa ..... D05B 37/04 112/475.12
5,170,733 A * 12/1992 Honma ..... D05B 69/20 112/153
5,701,833 A * 12/1997 Suzuki ..... D05B 35/064 116/318
6,237,518 B1 5/2001 Yunoki et al.
7,401,563 B2 * 7/2008 Sho ..... D05B 35/107 112/153
7,444,951 B2 * 11/2008 Ishikawa ..... D05B 27/10 112/475.04
7,628,114 B2 * 12/2009 Aoyama ..... A61F 13/2085 604/385.18
2007/0017425 A1 * 1/2007 Sho ..... D05B 35/107 112/308
2008/0115710 A1 * 5/2008 Ishikawa ..... D05B 35/10 112/470.17
2015/0361605 A1 12/2015 Nakata et al.
2020/0109501 A1 4/2020 Umekawa

FOREIGN PATENT DOCUMENTS

| | | | |
|---|---|---|---|
| CN | 112263055 | A | 1/2021 |
| JP | 2000-070579 | A | 3/2000 |
| JP | 6423568 | B1 | 11/2018 |
| WO | 2018-216061 | A1 | 11/2018 |
| WO | 2020-003983 | A1 | 1/2020 |
| WO | 2020-044390 | A1 | 3/2020 |

OTHER PUBLICATIONS

Written Opinion, PCT Patent Application No. PCT/JP2021/048736, Mar. 22, 2022, 4 pages.
Supplementary European Search Report, European Patent Application No. 21969956.8, Jan. 3, 2025. 8 pages.
International Preliminary Report on Patentability, PCT Patent Application No. PCT/JP2021/048736, Jun. 20, 2024, 9 pages.
Office Action, Chinese Patent Application No. 202180105317.X, Feb. 6, 2026, 17 pages.

* cited by examiner

SEWING DEVICE

TECHNICAL FIELD

The present invention relates to a sewing device that includes a sewing machine for using a fly and a fastener as sewn workpieces and performing edge overcasting on the fly, and a sewing machine for sewing the fly and the fastener. Incidentally, the fly is a protrusion or flyleaf of a front opening of trousers, and is also referred to as front placket.

BACKGROUND ART

As an example of a sewing device in the related art, there is known a sewing device that includes: a top plate on which a fly referred to as a front placket cloth is supplied to a first position; a first feeding portion that conveys the fly on the top plate to a second position; a second gripper that supplies a fastener onto the fly at the second position; a first sewing machine guide portion that guides the overlapped fly and fastener on the top plate; a first sewing machine that sews the fly and the fastener during guidance by the first sewing machine guide portion; a second sewing machine guide portion that guides the sewn fly and fastener on the top plate; and a second sewing machine that processes a fabric edge of the fly during guidance by the second sewing machine guide portion (see Patent Literature 1).

CITATION LIST

Patent Literature

Patent Literature 1: JP6423568B1

SUMMARY OF INVENTION

Technical Problem

An object of the sewing device disclosed in Patent Literature 1 described above is to obviate a failure caused by manual work of a sewing worker. The failure means that certain skills are required for the sewing worker, the quality of a product (obtained by sewing and integrating the fly and the fastener) is not stable, and the amount of sewing is also limited.

According to the sewing device disclosed in Patent Literature 1, the fly and the fastener are sewn, and then the fabric edge of the fly is processed. The processing of the fabric edge refers to cutting or performing edge overcasting on the fly while guiding (conveying) the fly and the fastener in an overlapped state. Further, in order to stabilize the quality of the processing of the fabric edge, that is, edges of the sewn workpieces, it is desirable that the conveyed sewn workpieces are easily pressed.

In Patent Literature 1, details of the conveying of the sewn workpieces in the processing of the fabric edge are as follows. The second sewing machine guide portion includes a sixth pressing plate that presses the fly and the fastener against the top plate. Regarding the sewn workpieces pressed by the sixth pressing plate, the fastener is overlapped in the vicinity of a center of a width of the substantially rectangular fly, and both side portions of the fly in the width are exposed with respect to the fastener. Under this condition, the sixth pressing plate presses one side portion of the sewn workpieces in a width direction against an element row of the fastener. The one side portion of the sewn workpieces in the width direction pressed by the sixth pressing plate includes the fly and a tape of the fastener in an overlapped state, and more specifically, the tape of the fastener and the fly are overlapped in a stepped manner. As described above, in Patent Literature 1, the sewn workpieces are pressed at a portion of the fastener other than the element row at the time of performing fabric edge process of the fly, and it can be said that there is a condition regarding a pressing position. Moreover, the pressed portion is a portion at which the tape of the fastener and the fly overlap with each other in a stepped manner, that is, the pressed portion includes a plurality of portions.

The present invention has been made in view of the above circumstances, and an object of the present invention is to solve the same object as that of Patent Literature 1 by using an apparatus different from that of Patent Literature 1, that is, to reduce manual work of a sewing worker as much as possible in an integration process by sewing a fly and a fastener and a fabric edge process to the fly. Another object of the present invention is to make it easy to press sewn workpieces when processing edges of the sewn workpieces, and to stabilize the processing quality of the edges of the sewn workpieces.

Solution to Problem

A sewing device according to the present invention includes a fly base on which a fly is to be placed; a fastener base on which a fastener is to be placed; a first conveying device configured to convey the fly on the fly base; a first sewing machine configured to perform edge overcasting on the fly during conveyance by the first conveying device; a supplying and conveying device configured to supply the fastener from the fastener base onto the fly, on which the edge overcasting is finished, in an overlapped manner, and configured to convey the fly and the fastener together; and a second sewing machine configured to sew the fly and the fastener during conveyance by the supplying and conveying device.

In addition, although the sewing device according to the present invention may include only the fly base, the first conveying device, the first sewing machine, the supplying and conveying device, and the second sewing machine, the sewing device is desirably configured as follows in order to facilitate the supply of the fly to the fly base.

That is, the sewing device includes a fly supplying portion configured to supply the fly onto the fly base one by one. In addition, the fly supplying portion includes a fly bundle base on which a fly bundle formed by stacking a plurality of flies is to be placed, a fly conveying device configured to take out the fly from the fly bundle base one by one and configured to convey the fly to the fly base, and a fly positioning device configured to position the fly supplied to the fly base.

Although the details of the supplying and conveying device are not limited, in order to correct a relative positional relation between the fly and the fastener according to a product specification, the supplying and conveying device is desirably configured as follows.

That is, the supplying and conveying device includes a fastener supplying device configured to supply the fastener from the fastener base onto the fly, on which the edge overcasting is finished, in the overlapped manner, and a second conveying device configured to linearly convey the fly and the fastener in an overlapped state to the second sewing machine.

The first conveying device is capable of conveying the fly, on which the edge overcasting is finished, on a linear conveyance path provided by the second conveying device, and capable of correcting at least one of a posture and a position of the fly before the fastener is overlapped on the fly.

Further, regarding the sewing device, although it does not matter whether the fastener is positioned in the vicinity of the second sewing machine, it is desirable that the sewing device is configured as follows in order to improve a finished state of the sewing between the fly and the tape of the fastener.

That is, the sewing device includes a tape guide configured to be inserted between a pair of tapes of the fastener on an upstream side in a conveying direction with respect to a needle of the second sewing machine.

In addition, regarding the sewing device, although it does not matter whether a sewing thread is cut after the sewing performed by the second sewing machine, the sewing device is desirably configured as follows.

That is, the sewing device includes a sewing thread cutting device configured to cut the sewing thread after sewing performed by the second sewing machine.

Advantageous Effects of Invention

In the sewing device according to the present invention, the edge overcasting is performed on the fly by the cooperation of the first conveying device and the first sewing machine, the fly and the fastener are sewn by the supplying and conveying device and the second sewing machine, and thus manual work of a sewing worker can be reduced, the quality of the sewn workpieces can be stabilized, and the amount of sewing can also be increased. Moreover, in the sewing device according to the present invention, the sewing workpiece to be conveyed when performing the edge overcasting is a single object, that is, only the fly, and as compared to a sewing device in the related art in which the sewing workpiece includes the overlapped fly and fastener, that is, includes a plurality of objects, the sewing workpiece is easy to be pressed, and as a result, the sewing workpiece can be stably conveyed, and the quality of the edge overcasting can be stabilized.

The sewing device may include the fly supplying portion. When the fly bundle is placed on the fly bundle base, the fly conveying device conveys the fly to the fly base, and the fly positioning device positions the fly on the fly base, thereby facilitating the supply of the fly to the fly base.

Further, in the sewing device, the supplying and conveying device includes the fastener supplying device and the second conveying device, and thus the supply of the fastener from the fastener base onto the fly, on which the edge overcasting is finished, is facilitated by the fastener supplying device, and when the first conveying device is capable of conveying the fly, on which the edge overcasting is finished, on the linear conveyance path provided by the second conveying device, and correcting at least one of the posture and the position of the fly, the relative positional relation between the fly and the fastener can be corrected according to the product specification.

Further, when the sewing device includes the tape guide on the upstream side in the conveying direction with respect to the needle of the second sewing machine, the tape guide is inserted between the pair of tapes of the fastener, and thus the pair of tapes can be positioned before sewing, and therefore, the finished state of the sewing between the fly and the fastener can be improved.

In addition, when the sewing device includes the sewing thread cutting device that cuts the sewing thread after the sewing performed by the second sewing machine, a product without the sewing thread after the sewing can be produced.

Figure 39:
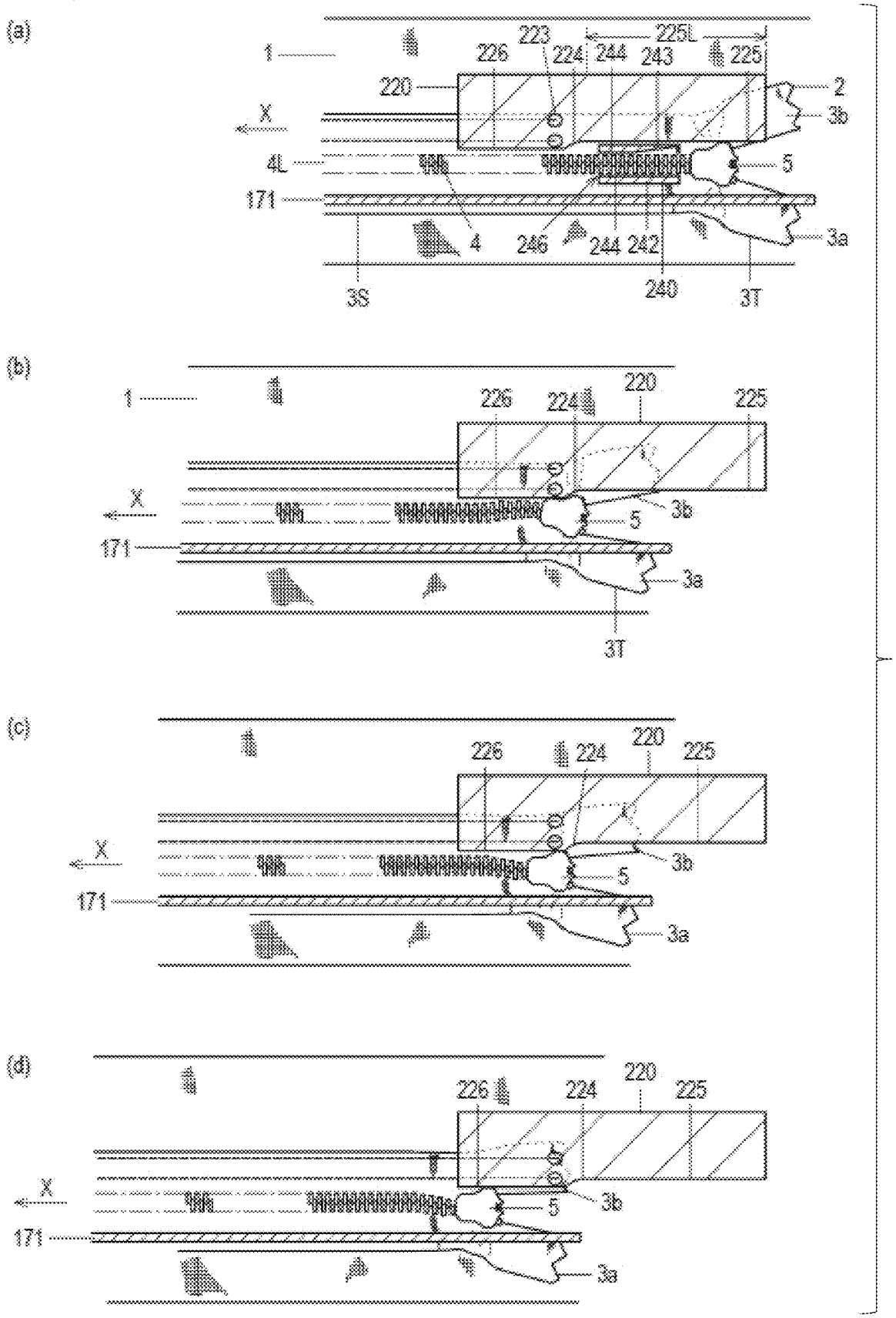

(a) to (d) of FIG. 39 are explanatory diagrams illustrating a sewing procedure performed by the second sewing machine.

Figure 40:
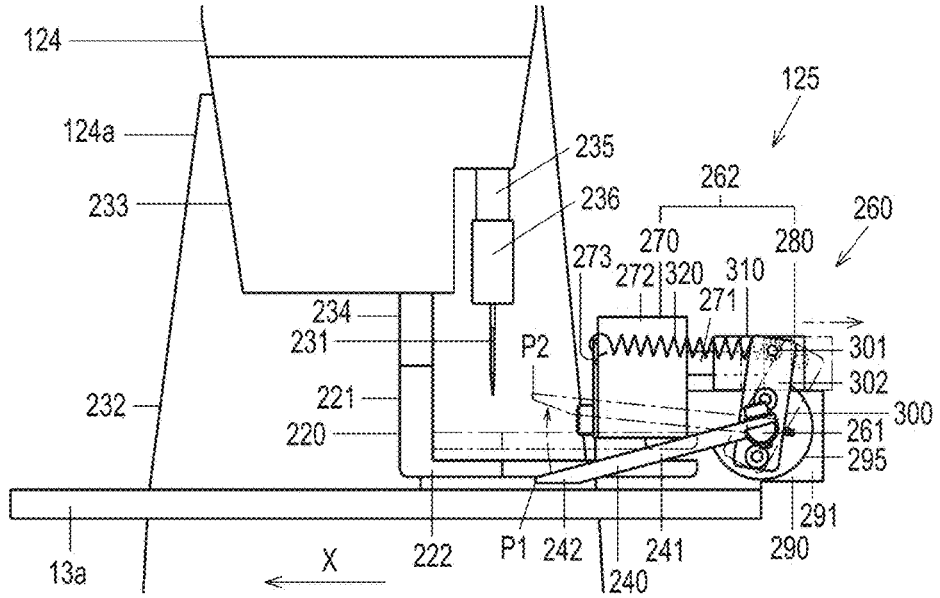

FIG. 40 is an explanatory diagram illustrating an operation of the fastener positioning device.

Figure 41:
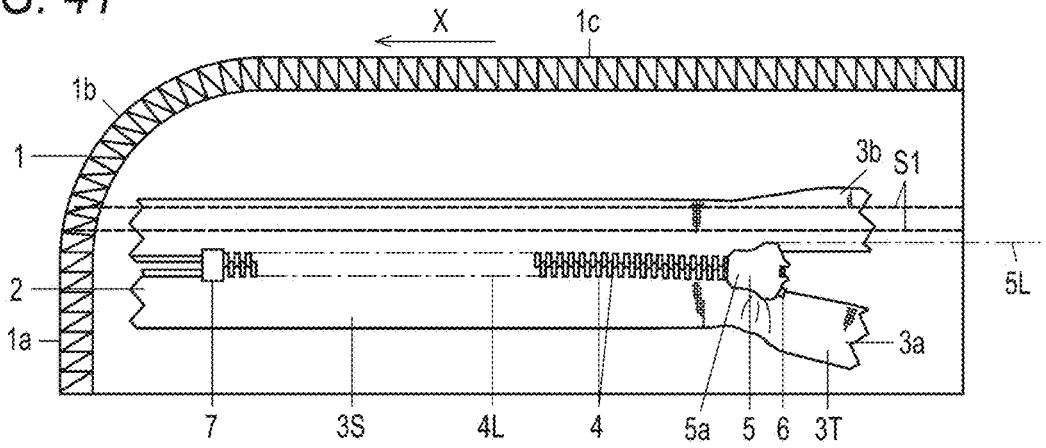

FIG. 41 is a plan view illustrating a sewn state of the fly and the fastener.

Figure 42:
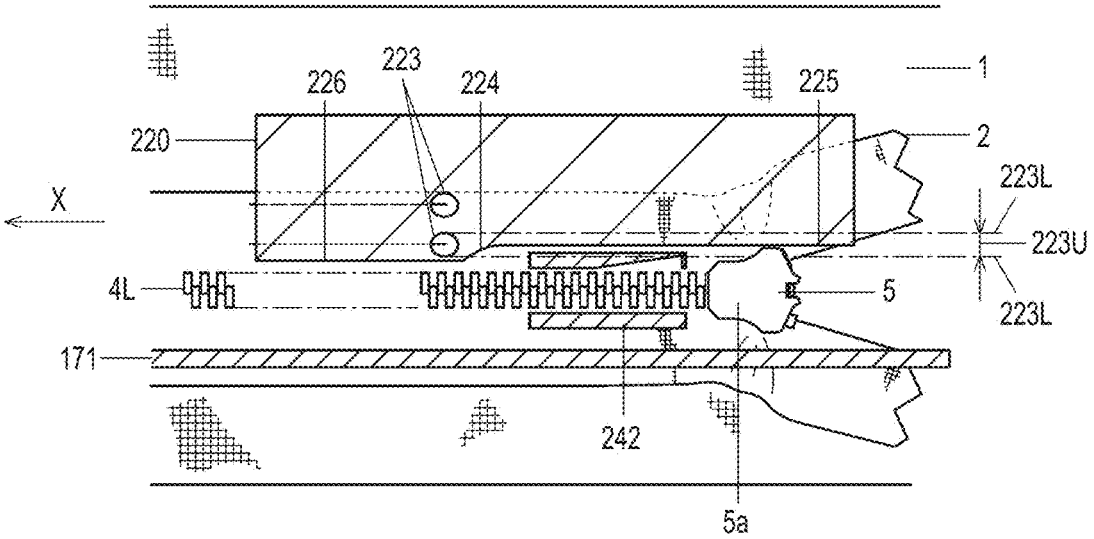

FIG. 42 is an explanatory diagram illustrating a positional relation of portions of the fastener positioning device.

Figure 43:
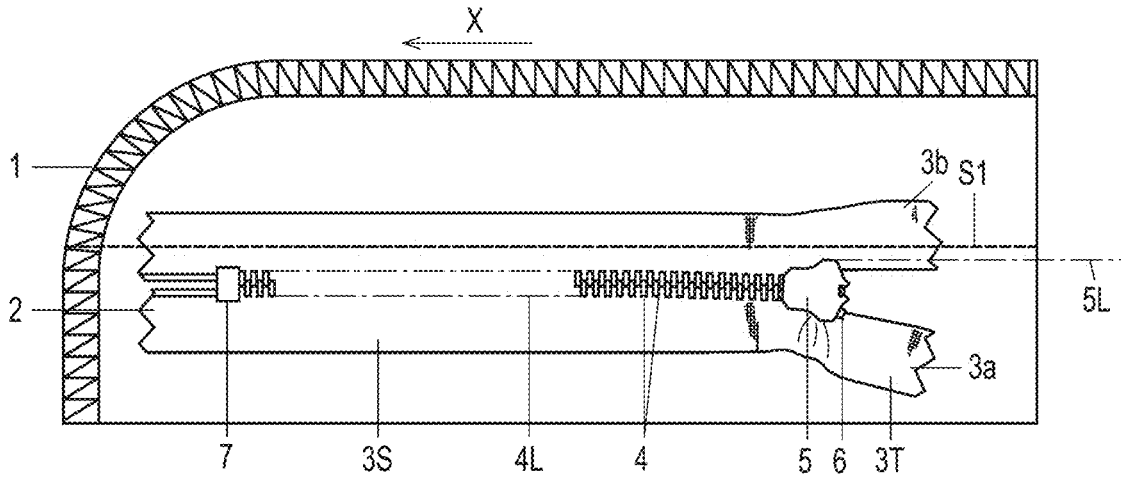

FIG. 43 is an explanatory diagram illustrating an example in which one seam is formed in the sewn state of the fly and the fastener.

Figure 44:
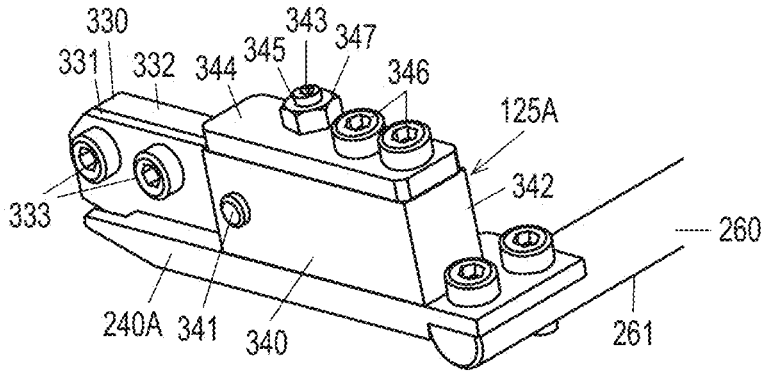

FIG. 44 is a perspective view illustrating a fastener positioning device according to a modification.

Figure 45:
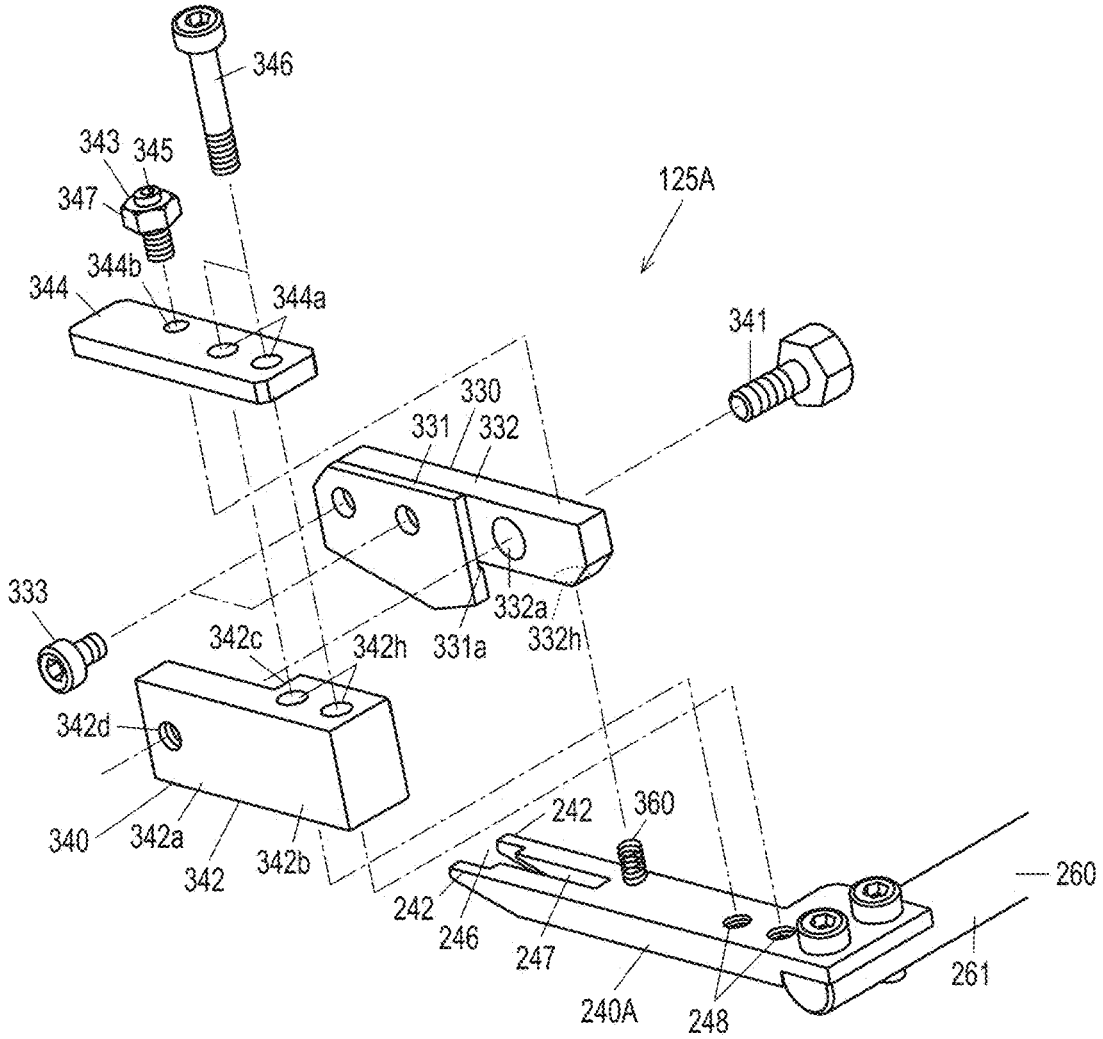

FIG. 45 is a perspective view illustrating a state in which the fastener positioning device according to the modification is exploded.

Figure 46:
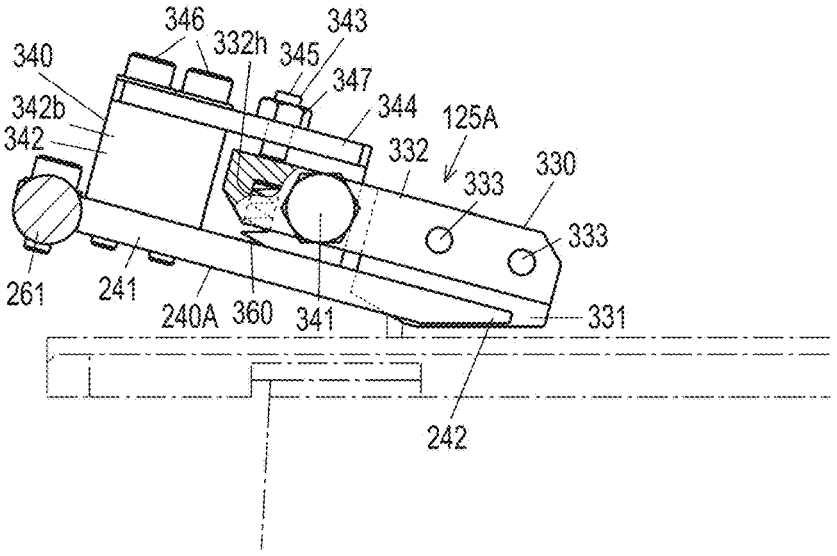

FIG. 46 is a rear view illustrating the fastener positioning device according to the modification.

Figure 47:
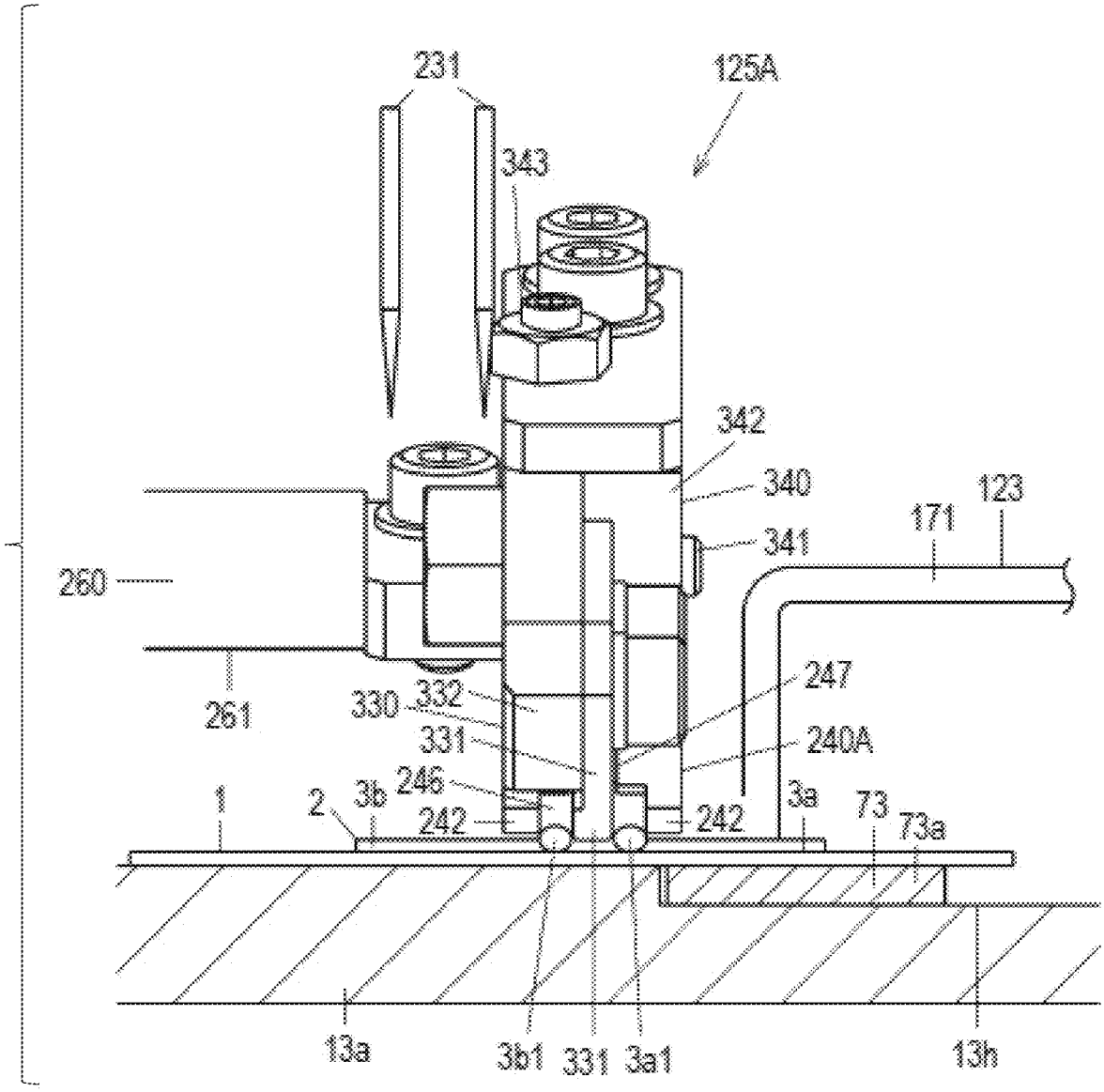

FIG. 47 is a left side view illustrating a use state of the fastener positioning device according to the modification.

Figure 48:
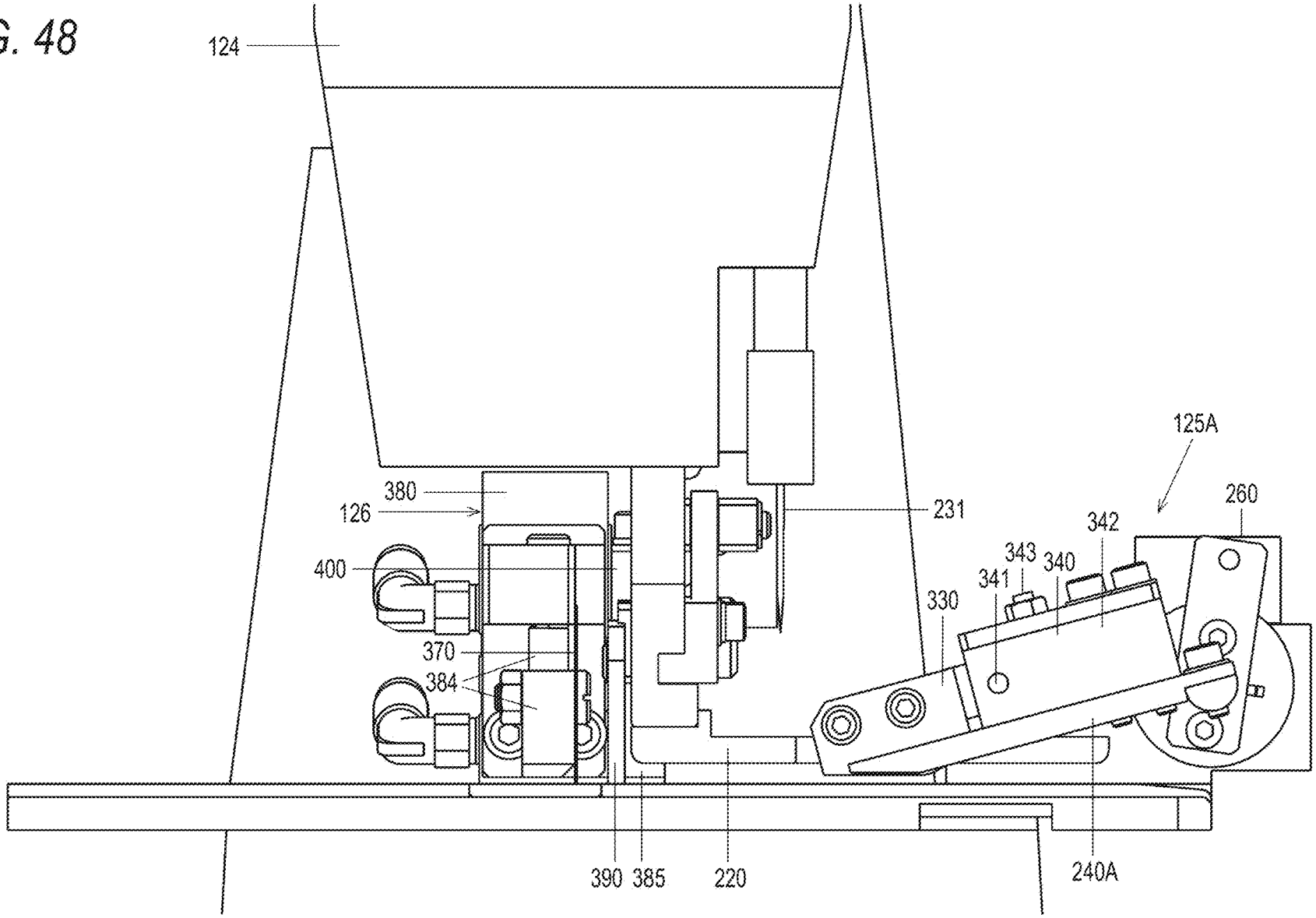

FIG. 48 is a front view illustrating the second sewing machine and a sewing thread cutting device.

Figure 49:
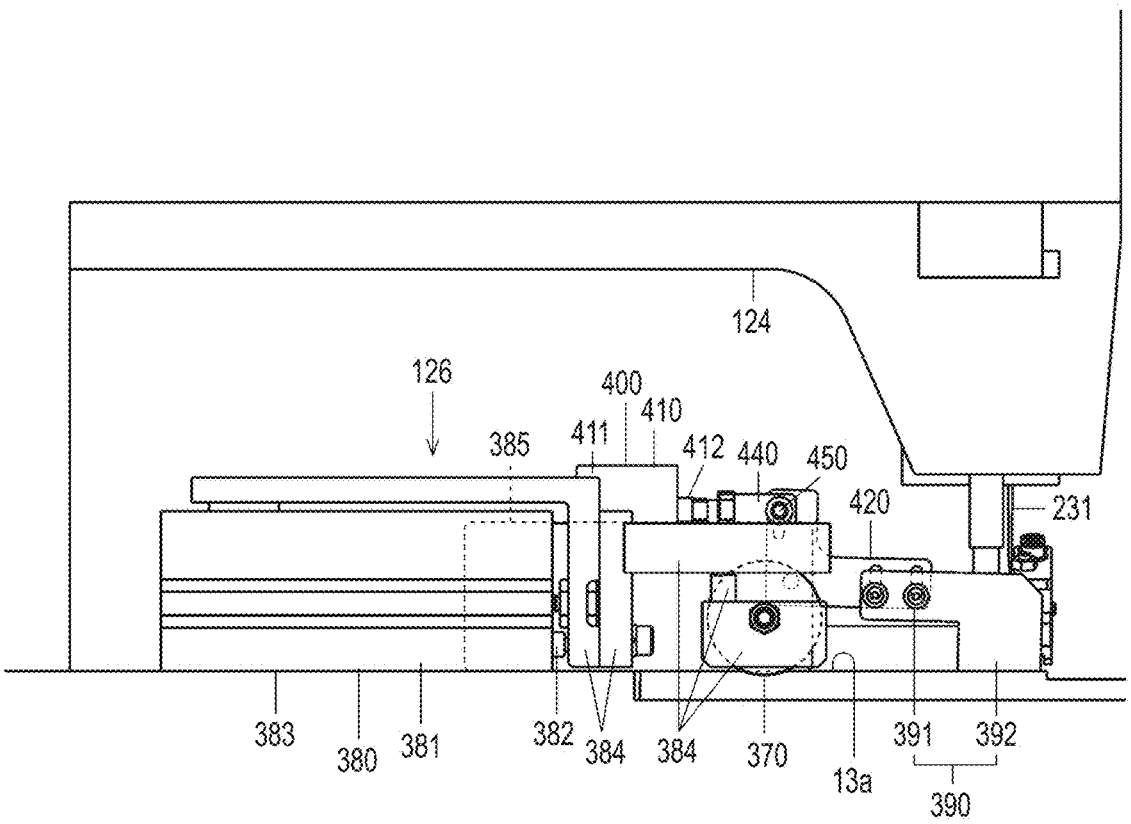

FIG. 49 is a left side view illustrating the sewing thread cutting device.

Figure 50:
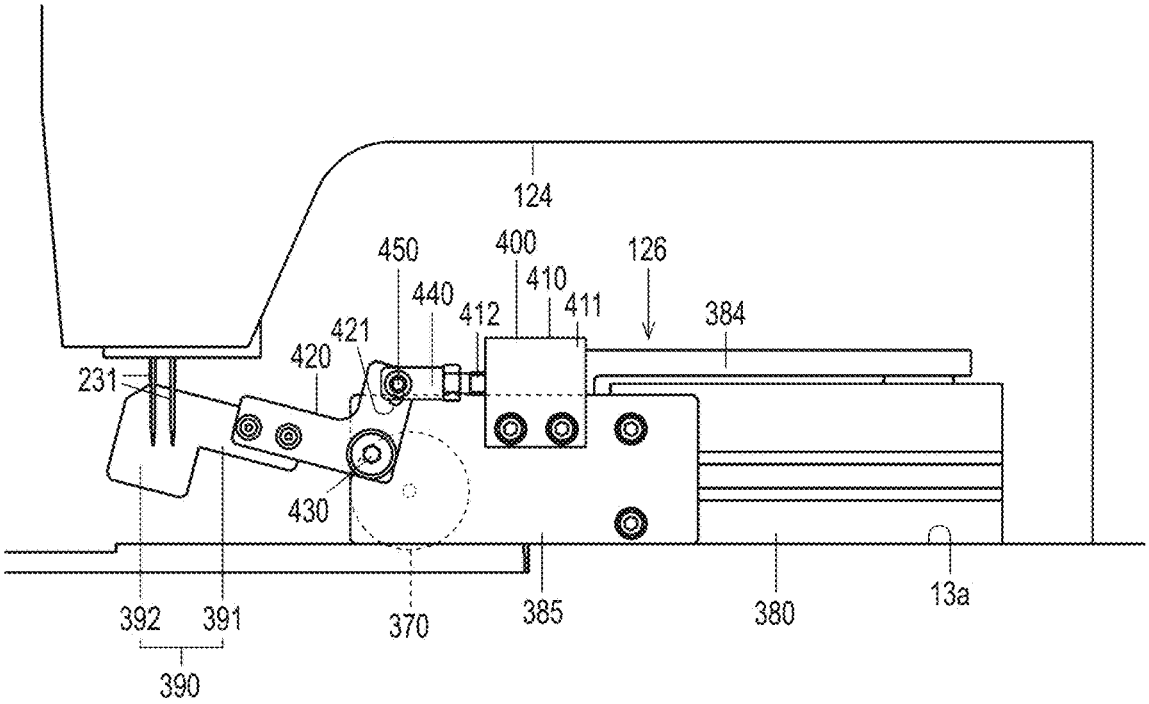

FIG. 50 is a right side view illustrating the sewing thread cutting device.

Figure 51:
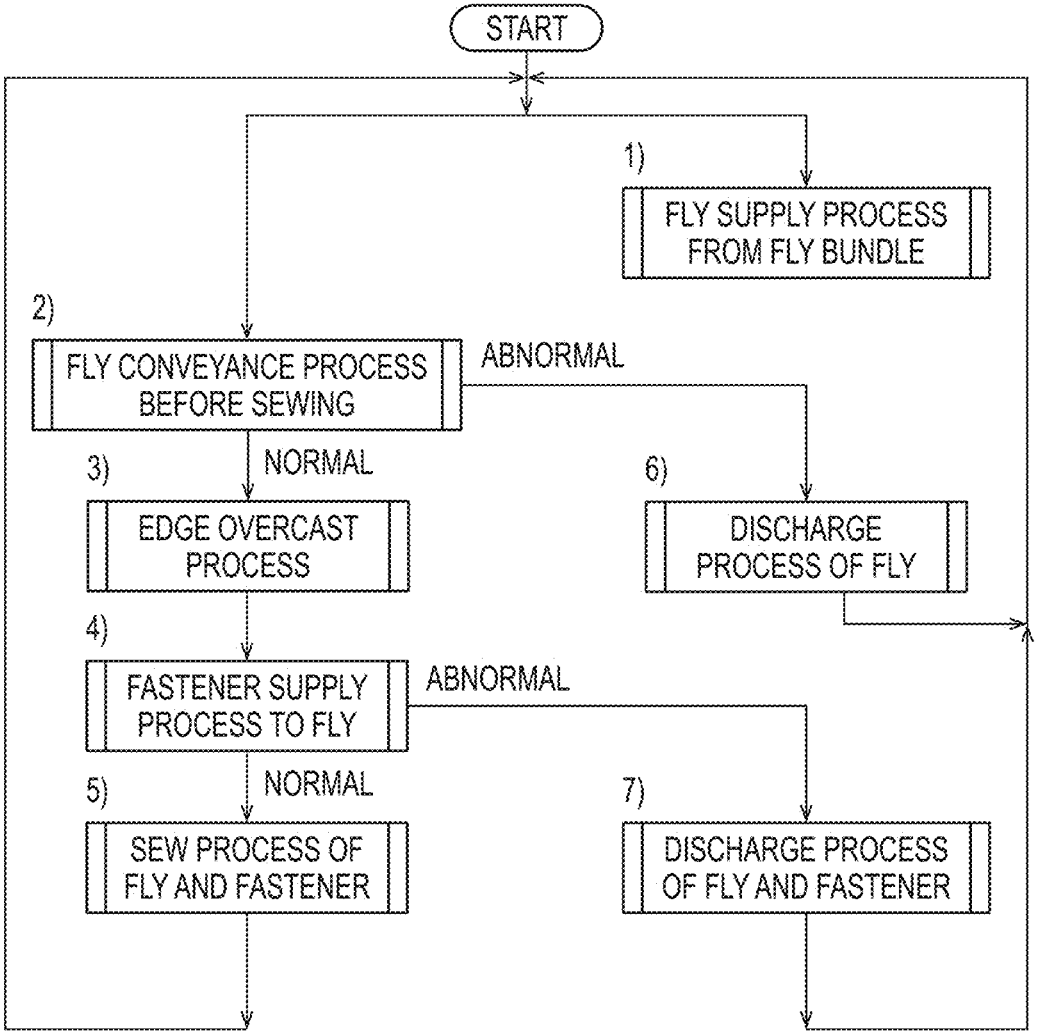

FIG. 51 is a flowchart illustrating an outline of all processes of the sewing device.

DESCRIPTION OF EMBODIMENTS

As illustrated in FIG. 41, in a sewing device according to a first embodiment of the present invention, a fly 1 and a fastener 2 are used as sewn workpieces, edge overcasting is performed while cutting the fly 1, the fastener 2 is placed on and sewn to the fly 1 so as to be integrated, and a product is obtained.

The fly 1 is a flexible fabric. In the present embodiment, the fly 1 is originally rectangular, and includes two sides facing each other in one direction and two sides facing each other in the other direction. More specifically, the fly 1 has a rectangular shape, and includes two long sides and two short sides. Further, the fly 1 has four corners. The fly 1 is cut into a shape in which one of the four corners is smoothly curved before the edge overcasting is performed.

The smoothly curved shape is a trajectory corresponding to ¼ of a circle in the illustrated example, that is, an arc shape. Further, although not shown, the smoothly curved shape also includes a trajectory corresponding to ¼ of an ellipse, that is, an elliptical arc shape. Incidentally, a center of the circle or the ellipse is located on a fly side, and tangent lines of two end points of the arc shape or the elliptical arc shape are the long side and the short side located on both sides of the arc shape or the elliptical arc shape.

Hereinafter, terms related to an edge of the fly 1 are defined as follows. A portion having the smoothly curved shape is referred to as a curved side 1*b*. The long side as a tangent line at one end point of the curved side 1*b* is referred to as a vertical side 1*c*. Further, the short side as a tangent line at the other end point of the curved side 1*b* is referred to as a horizontal side 1*a*. Accordingly, in the illustrated example, a part of the edge of the fly 1 is formed by smoothly joining the horizontal side 1*a* and the vertical side 1*c*, which respectively extend straight in intersecting directions, more specifically, orthogonal directions, at the curved side 1*b*. Further, the edge of the fly 1 is formed by at least the vertical side 1*c* and the curved side 1*b* in addition to the long side and the short side. Accordingly, a case in which the horizontal side 1*a* is located at the edge of the fly 1 and a case in which the horizontal side 1*a* is not located at the edge of the fly 1 are assumed.

The fastener 2 is a slide fastener. The following description will be made with reference to a state in which the fastener is placed on a flat surface. The fastener 2 includes a pair of tapes 3*a* and 3*b* extending in a longitudinal direction and facing each other in a width direction that is a direction orthogonal to the longitudinal direction, a plurality of elements 4 fixed to side edge portions of the pair of tapes 3*a* and 3*b* facing each other in the width direction at intervals in the longitudinal direction, a slider 5 that opens and closes an element row 4L formed by all the elements, and a first stopper 6 and a second stopper 7 that collide with the slider 5 to determine a moving range of the slider 5. The tapes 3*a* and 3*b* are flexible strips. The elements 4 are made of metal as an example.

The first stopper 6 defines a limit position on a closing side of the element row 4L in the moving range of the slider 5, and is fixed to the facing side edge portion of the tape 3*a* in the illustrated example.

The second stopper 7 defines a limit position on an opening side of the element row 4L in the moving range of the slider 5, and is fixed to the facing side edge portions of the pair of tapes 3*a* and 3*b* in the illustrated example. The second stopper 7 is slightly wider than the element row 4L and slightly protrudes in both directions of the width direction with respect to the element row 4L.

The fastener 2 is in a state in which the element row 4L is completely closed, in other words, in a state regarding all the elements 4 in which the adjacent elements 4 mesh with each other, and is in a state in which the slider 5 is in contact with the first stopper 6. In addition, the fastener 2 includes a linear portion 3S in which the pair of tapes 3*a* and 3*b* linearly extend with the slider 5 as a boundary, and a pair of branched portions 3T branched into two portions. Immediately before the fly 1 and the fastener 2 are sewn, the fastener 2 is overlapped on the fly 1, and the fly 1 protrudes to both sides of a width direction of the linear portion 3S. Then, immediately before the fly 1 and the fastener 2 are sewn, the fly 1 and the fastener 2 are conveyed while maintaining a state in which a linear direction of the linear portion 3S is kept parallel to a conveying direction X and a state in which the linear portion 3S is located on a downstream side in the conveying direction X with respect to the slider 5, and the tape 3*b* and the fly 1 are sewn during the conveyance, thereby forming a seam S1.

The slider 5 includes a slider body 5*a* to be movably guided along the element row 4L, and a pull tab (not shown) connected to the slider body 5*a*. When the fastener 2 is placed on the fly 1, the pull tab is overlapped below the slider body 5*a*.

The slider body 5*a* includes, as an internal space thereof, an element passage (not shown) penetrating in a longitudinal direction of the element row 4L, and tape grooves (not shown) communicating with the element passage and opening in a width direction of the element row 4L.

The element passage includes a pair of branched passages, one branched passage in the longitudinal direction is a main passage, and the other branched passage in the longitudinal direction is branched into two passages in the width direction of the element row 4L.

The element row 4L passes through the element passage, and the tape on the corresponding side passes through the corresponding tape groove.

The slider body 5*a* has a shape corresponding to the element passage. That is, a part of the slider body 5*a* corresponding to the pair of branched passages has a shape protruding to both sides of the width direction of the element row 4L as compared with a part of the slider body 5*a* corresponding to the main passage.

In the sewing device according to the first embodiment of the present invention, the fly 1 and the fastener 2 are sewn workpieces as described above. As illustrated in FIG. 51, a process of taking out and supplying one fly 1 from a fly bundle obtained by stacking the flies 1, that is, a fly supply process from the fly bundle in procedure 1), and a process of conveying the fly before the sewing, that is, a fly conveyance process before the sewing in procedure 2) are performed in parallel by the sewing device according to the first embodiment. However, regarding the process in procedure 2), the process does not substantially proceed until the fly 1 is supplied in the process in procedure 1). Further, the sewing device according to the first embodiment is configured to sequentially perform, after the process in procedure 2), a process of performing the edge overcasting on the fly 1 when the fly 1 is normal, that is, an edge overcast process in procedure 3), a process of supplying the fastener 2 onto the fly 1 on which the edge overcasting is finished, that is, a fastener supply process to the fly in procedure 4), a process of sewing the fly 1 and the fastener 2 when the fly 1 and the fastener 2 are normal, that is, a sews process of a fly 1 and the fastener 2 in procedure 5), and then return to the processes in procedure 1) and procedure 2) again.

On the other hand, the sewing device according to the first embodiment performs a discharge process of the fly 1 in procedure 6) when the fly 1 is abnormal in the fly conveyance process before the sewing in procedure 2), and then returns to the process in procedure 1).

Further, the sewing device according to the first embodiment is configured to perform a discharge process of the fly and the fastener in procedure 7) when a state of the fly 1 or the fastener 2 is abnormal in the fastener supply process to the fly in procedure 4), and then return to the process in procedure 1).

Each process in FIG. 51 is obtained by simplifying an actual process, and is a process in which the next fly 1 is not supplied until the sewing of the fly 1 and the fastener 2 is completed after the fly 1 is supplied. In the actual process, in order to improve production efficiency of a product obtained by sewing the fly 1 and the fastener 2, the next fly 1 is supplied after the process proceeds to a certain extent after the fly 1 is supplied, and a process different from those of FIG. 51 is performed.

Figure 1:
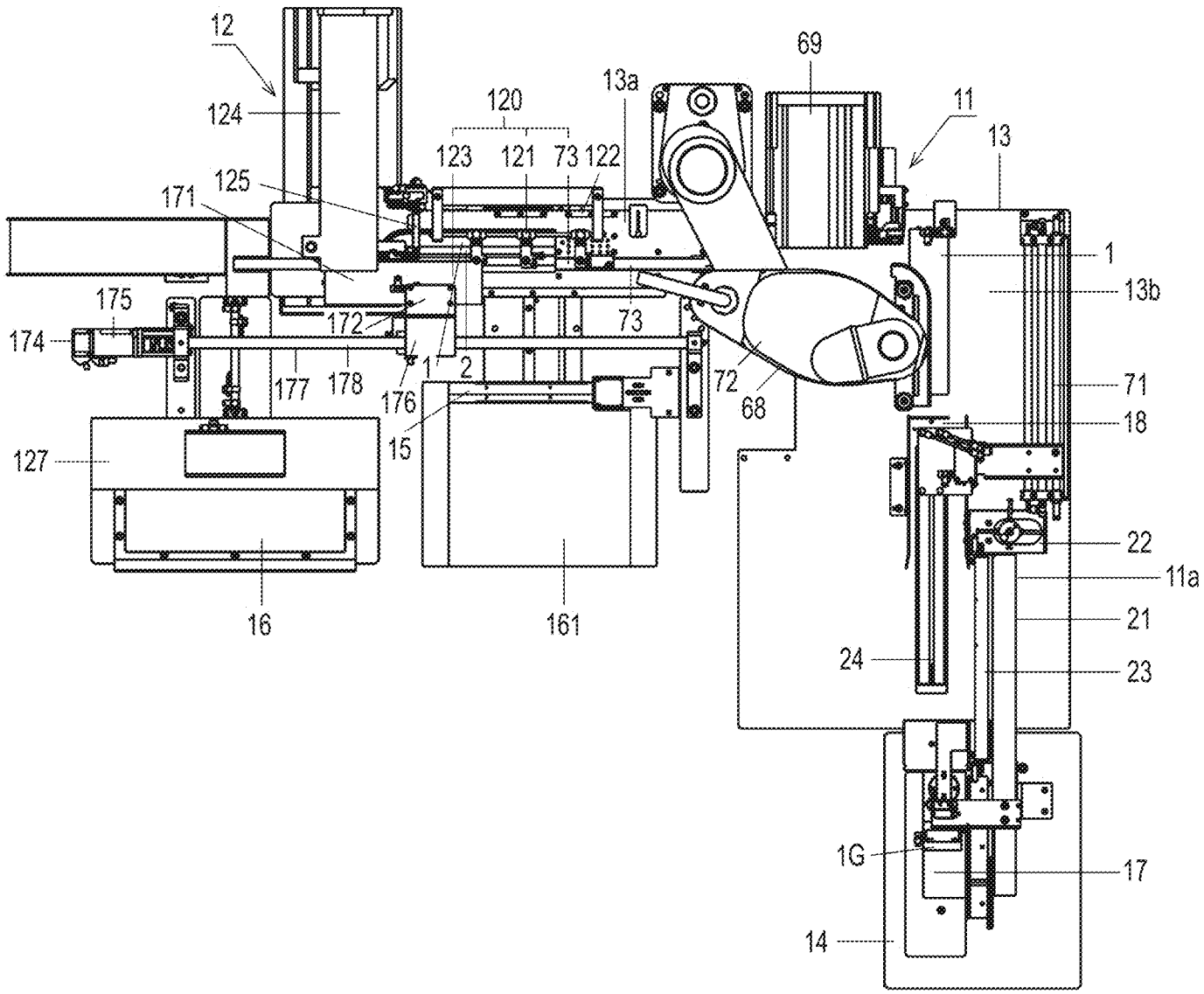
FIG. 1 is a plan view illustrating a sewing device according to a first embodiment of the present invention.

As illustrated in FIG. 1, the sewing device according to the first embodiment includes an edge overcasting portion 11 that performs the edge overcasting on the fly 1, and a sewing portion 12 that sews the fly 1 on which the edge overcasting is finished and the fastener 2. Although not shown, the sewing device includes a frame that supports components constituting the edge overcasting portion 11 and the sewing portion 12, and a control device that controls various devices and the like constituting the edge overcasting portion 11 and the sewing portion 12. The control device controls various devices based on predetermined settings and signals from various sensors.

A main table 13 that supports the sewn workpieces from below during the conveyance is provided in the edge overcasting portion 11 and the sewing portion 12. Further, a sub table 14 that is lower than the main table 13 in a stepped manner is provided in the edge overcasting portion 11.

The main table 13 extends substantially at a right angle in a plan view, and forms a conveyance path for the sewn workpieces. With reference to FIG. 1, the main table 13 includes a sewing table portion 13*a* that extends in a left-right direction, and a fly conveyance table portion 13*b* that extends forward with respect to a right end portion of the sewing table portion 13*a*.

The sub table 14 is in a state of being adjacent to the fly conveyance table portion 13*b* on a front side.

In addition, a fastener base 15 on which the fastener 2 is placed, an iron base 16 on which the fastener 2 before being placed on the fastener base 15 is placed, and a temporary placement base 161 on which the fastener 2 can be temporarily placed are provided as a part of the sewing portion 12 at positions facing two side portions (the sewing table portion 13*a* and the fly conveyance table portion 13*b*) of the main table 13 that extend substantially at a right angle. The fastener base 15 is provided on a rear side with respect to the temporary placement base 161. The temporary placement base 161 is provided on a right side with respect to the iron base 16, that is, on a fly conveyance table portion 13*b* side at an interval. Further, a fly bundle base 17 on which a fly bundle 1G formed by stacking a plurality of flies 1 is placed is provided above the sub table 14 as a part of the edge overcasting portion 11. A worker position is on a front side with respect to the fastener base 15 and the iron base 16. The worker position is on a left side with respect to the fly bundle base 17.

The edge overcasting portion 11 includes a fly supplying portion 11*a* that accommodates the fly bundle 1G on the fly bundle base 17, and that takes out and supplies the fly 1 one by one from the fly bundle base 17.

The fly supplying portion 11*a* includes, in addition to the fly bundle base 17 described above, a fly conveying device 21 that takes out the fly 1 one by one from the fly bundle base 17 and conveys the fly 1 to a fly base 18 that is a part of the fly conveyance table portion 13*b*, and a fly positioning device 22 that positions the fly 1 supplied to the fly base 18. The main table 13 including the fly base 18 as a part is supported in a state in which an upper surface is set to a horizontal surface.

The fly conveying device 21 includes a first supplying device 23 that takes out and supplies the fly 1 one by one from the fly bundle base 17, and a first conveyor 24 that conveys the fly 1 supplied from the first supplying device 23 to the fly base 18.

Figure 2:
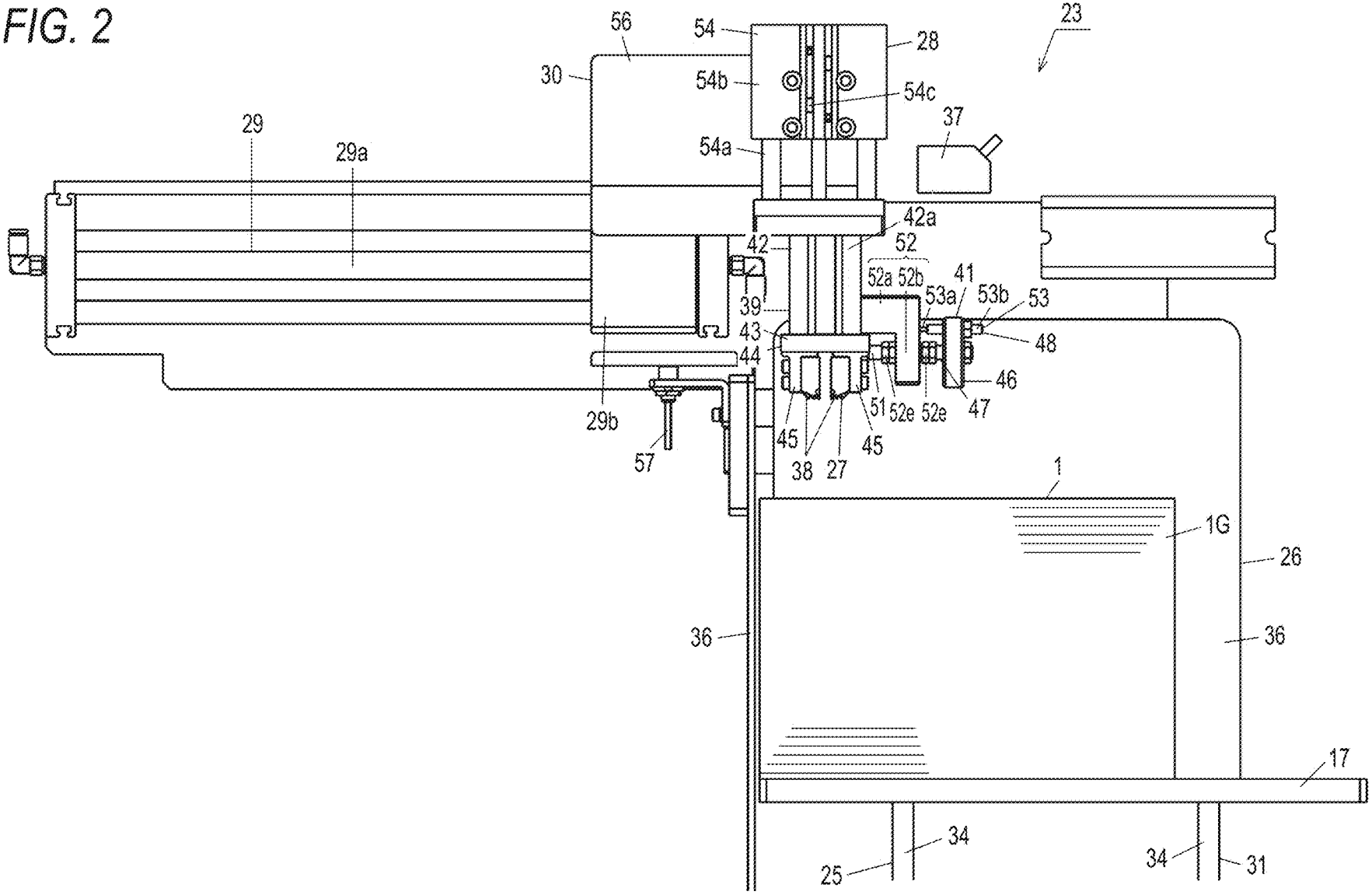
FIG. 2 is a left side view illustrating a configuration for taking out a fly from a fly bundle and conveying the fly.
Figure 3:
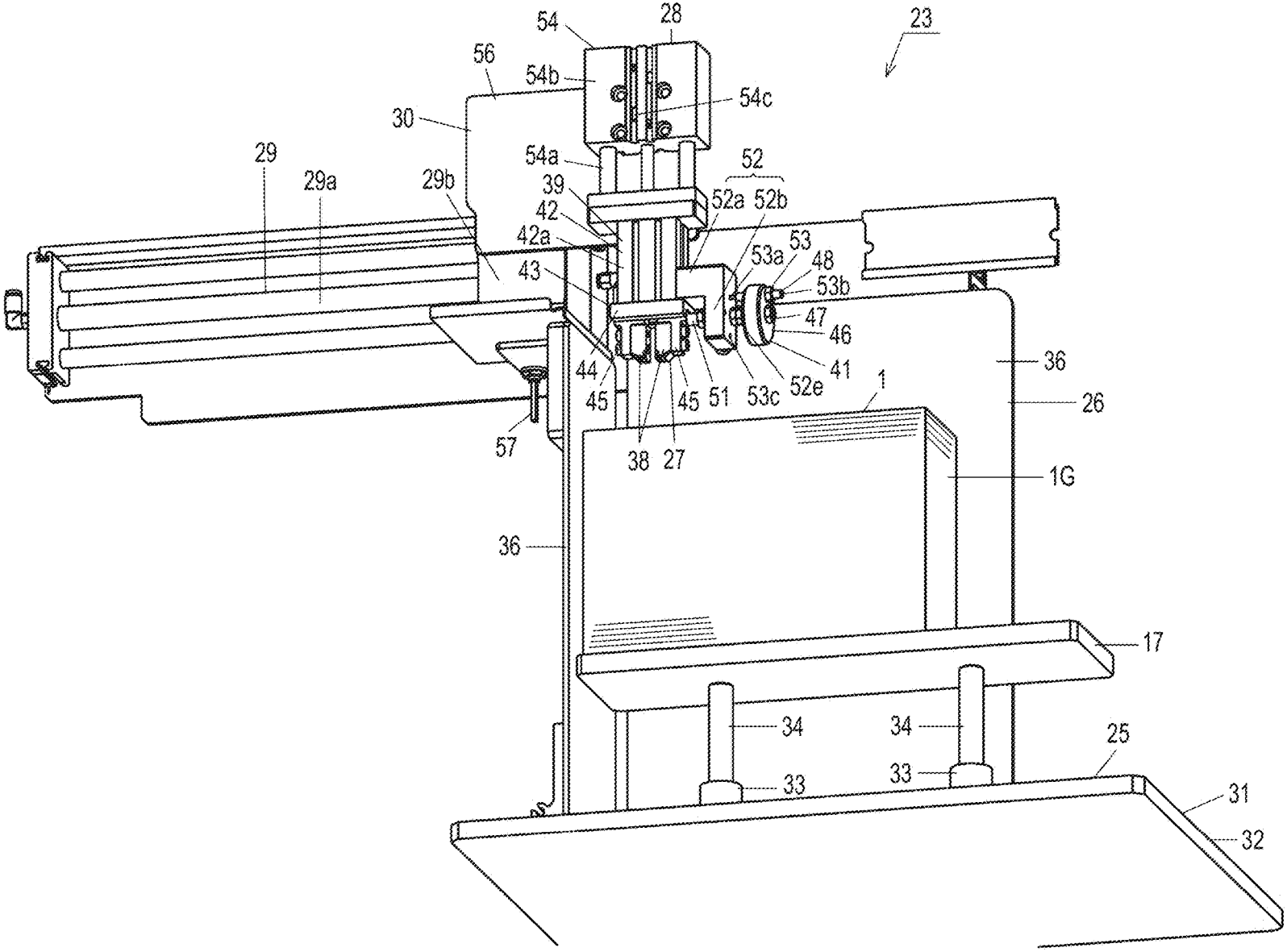
FIG. 3 is a perspective view illustrating the configuration for taking out the fly from the fly bundle and conveying the fly.

As illustrated in FIGS. 2 and 3, the first supplying device 23 includes a lifting device 25 that supports the fly bundle base 17 so as to be movable in an upward-downward direction, a fly bundle positioning portion 26 that can position the fly bundle 1G on the fly bundle base 17, a fly taking-out portion 27 that takes out the fly 1 at the top of the fly bundle 1G, a fly bundle pressing portion 28 that presses the fly bundle 1G from above, and a fly supplying portion 29 that supplies the fly taking-out portion 27 and the fly bundle pressing portion 28 together to an upstream portion of the first conveyor 24. The fly taking-out portion 27 and the fly bundle pressing portion 28 are integrated to obtain a fly taking-out unit 30.

The lifting device 25 includes a motor (not shown) and a conversion mechanism 31 that converts a rotational motion of the motor into an upward and downward motion of the fly bundle base 17. The conversion mechanism 31 is well known, and only a part thereof is shown in the figure. The part thereof includes a fixed plate 32 fixed to the frame, a pair of guide sleeves 33 fixed on the fixed plate 32 at an interval, and a pair of guide posts 34 that are passed through the pair of guide sleeves 33 separately and move upward and downward along the pair of guide sleeves 33. The fly bundle base 17 is fixed to upper end portions as tip portions of the pair of guide posts 34. Further, although not shown, the lifting device 25 is provided with a lower limit sensor that detects a limit position at which the fly bundle base 17 moves downward, that is, a lower limit value, and an upper limit sensor that detects a limit position at which the fly bundle base 17 moves upward, that is, an upper limit value.

The fly bundle base 17 is supported in a state in which an upper surface is horizontal. The fly bundle base 17 is rectangular in a plan view. Four sides of the rectangular fly bundle base 17 are disposed parallel to the two side portions of the main table 13 extending in a substantially orthogonal state. The fly bundle positioning portion 26 is provided at a position close to end surfaces of two orthogonal sides among the four sides of the fly bundle base 17.

The fly bundle positioning portion 26 includes two vertical positioning plates 36. The two positioning plates 36 are disposed to partially surround the periphery of an upper space portion of the fly bundle base 17. More specifically, the two positioning plates 36 are disposed around the fly bundle base 17 so as to cover two orthogonal surfaces on sides of the rectangular parallelepiped fly bundle 1G placed on the fly bundle base 17. Further, the two positioning plates 36 are positioned on a right side (a side opposite to the worker position) and a rear side with respect to the fly bundle base 17. The fly bundle 1G is positioned by bringing the two surfaces of the fly bundle 1G into contact with the two positioning plates 36.

The fly bundle positioning portion 26 is fixed to the fixed plate 32, but is not fixed to the fly bundle base 17. Accordingly, the fly bundle positioning portion 26 does not change a height position in contrast to a portion such as the fly bundle base 17 that can move upward and downward to change the height position. That is, the fly bundle positioning portion 26 does not move with the upward and downward movement of the fly bundle base 17. A fly bundle presence sensor 37 for detecting the presence or absence of the fly bundle 1G placed on the fly bundle base 17 is disposed above the fly bundle base 17 (see FIG. 2). The fly bundle presence sensor 37 is provided such that a detection surface thereof faces downward.

The fly taking-out portion 27 includes a pair of claws 38 that pinch the fly 1, an opening and closing portion 39 that is capable of opening and closing the pair of claws 38, and an interval adjusting portion 41 that is capable of adjusting an interval between the pair of claws 38.

The opening and closing portion 39 is well known, and includes a cylinder device 42 and a conversion mechanism 43 that converts a linear reciprocating motion of a piston rod (not shown) of the cylinder device 42 into an opening and closing motion of the pair of claws 38.

The conversion mechanism 43 is also well known, and includes, as essential parts thereof, rails 44 that extend in a horizontal direction and a pair of slide blocks 45 that are separately movable along the rails 44. The pair of claws 38 are separately fixed to the pair of slide blocks 45. The pair of claws 38 protrude downward of the slide blocks 45 and come into contact with an upper surface of the fly bundle 1G.

The conversion mechanism 43 is well known, and thus components other than the pair of rails 44 and the pair of slide blocks 45 is not shown, but for example, a pair of levers forming an L shape are included. Bent portions of the pair of levers are supported as supporting points for swingably supporting the respective levers, one end portion of each of the pair of levers is connected to the piston rod, and the other end portion of each of the pair of levers is connected to the corresponding one of the pair of slide blocks 45. When the opening and closing portion 39 moves the piston rod of the cylinder device 42 forward, the pair of slide blocks 45 approach each other, and as a result, the pair of claws 38 are closed to pinch the fly 1. On the other hand, when the opening and closing portion 39 moves the piston rod backward, the pair of slide blocks 45 are separated from each other, and as a result, the pair of claws 38 are opened to release the fly 1.

The interval adjusting portion 41 converts a rotational motion into a linear reciprocating motion. The interval adjusting portion 41 includes a rotary dial 46 that sets a maximum opening width of the pair of claws 38, a pushing mechanism 47 that moves in a linear direction in accordance with a rotation direction and a rotation amount of the rotary dial 46 and pushes one of the pair of claws 38, and an indexing portion 48 that determines a rotation angle position of the rotary dial 46.

The pushing mechanism 47 includes a male screw portion 51 that pushes the claw 38 from a side on which the pair of claws 38 are opened, that is, from an outer side, and a block 52 that is provided with a female screw portion (not shown) to be screwed in a state in which the male screw portion 51 penetrates therethrough.

The male screw portion 51 is a center when the rotary dial 46 rotates.

The block 52 is fixed to a side surface of a cylinder 42*a* of the cylinder device 42 in the opening and closing portion 39. The block 52 has an L shape in the illustrated example, and includes a first block piece portion 52*a* that horizontally extends from the side surface of the cylinder 42*a* in a direction in which the claw 38 to be pushed opens, and a second block piece portion 52*b* that extends downward from an end portion (an end portion away from the cylinder 42*a*) of the first block piece portion 52*a* and faces one claw 38.

The male screw portion 51 is screwed to the second block piece portion 52*b* in the state of penetrating therethrough. Nuts 52*e* are screwed to the male screw portion 51 in a state of sandwiching the second block piece portion 52*b* from both sides with a slight gap therebetween. In accordance with the amount of the rotation angle of the rotary dial 46, the male screw portion 51 can rotate and reciprocate by only an amount corresponding to the gap, and the maximum opening width of the pair of claws 38 can be adjusted by only the amount corresponding to the gap.

The indexing portion 48 includes an indexing plunger 53 and positioning holes 53*c* into which a positioning pin 53*a* of the indexing plunger 53 can be fitted.

The indexing plunger 53 includes an eccentric shaft 53*b* that is fixed to an eccentric position of the rotary dial 46, the positioning pin 53*a* that is movable in a direction in which the positioning pin 53*a* protrudes into and retracts from a hole of a tip portion of the eccentric shaft 53*b*, and a spring (not shown) that is incorporated in the hole of the tip portion of the eccentric shaft 53*b* and pushes the positioning pin 53*a* toward a protruding direction. Incidentally, in order to suppress the positioning pin 53*a* from being detached from the tip portion of the eccentric shaft 53*b*, for example, the hole formed in the tip portion of the eccentric shaft 53*b* has a smaller diameter on a tip side than that on a deep side. The positioning pin 53*a* includes a pin main body that protrudes into and retracts from the hole of the eccentric shaft 53*b*, and a pin flange at which an end portion (an end portion accommodated in the hole of the eccentric shaft 53*b*) of the pin main body protrudes in a flange shape.

On the other hand, positioning holes 53*c* into which the positioning pin 53*a* is fitted are formed in the second block piece portion 52*b* of the block 52. In the second block piece portion 52*b*, the plurality of positioning holes 53*c* are formed at positions eccentric in a radial direction with respect to the male screw portion 51, which serves as the center of the rotary dial 46, at intervals in a circumferential direction.

The fly taking-out portion 27 described above is set by rotating the rotary dial 46 such that the interval between the pair of claws 38 is an appropriate interval according to a thickness of the fly 1, so that only the fly 1 at the top can be pinched by the pair of claws 38 from the fly bundle 1G. By fitting the positioning pin 53*a* into one of the positioning holes 53*c*, a position at which the rotary dial 46 is stopped is easily adjusted.

The fly bundle pressing portion 28 includes a cylinder device 54 in which a piston rod 54*a* moves downward, and the fly taking-out portion 27 fixed to a tip end portion (a lower end portion) of the piston rod 54*a*. Since the pair of claws 38 of the fly taking-out portion 27 are pressed on the fly bundle 1G, the fly taking-out portion 27 also serves as a part of the fly bundle pressing portion 28.

A fly bundle press sensor 54*c* for detecting whether the fly bundle 1G is pressed is fixed to a cylinder 54*b* of the cylinder device 54. Further, the cylinder 54*b* of the cylinder device 54 is fixed to a fixed plate 56 to be described later. Since a height position of the fixed plate 56 is fixed, a height position of the cylinder 54*b* is fixed. Further, as described above, the fly taking-out portion 27 is fixed to the tip end portion of the piston rod 54*a*. Accordingly, the fly taking-out portion 27 is suspended with respect to a cylinder device 54. In addition, the fly supplying portion 29 reciprocates, between the fly bundle base 17 and the upstream portion of the first conveyor 24, the fly taking-out unit 30 in which the fly bundle pressing portion 28 and the fly taking-out portion 27 are integrated.

A rodless cylinder is used as the fly supplying portion 29. The rodless cylinder includes a tubular cylinder 29*a* that is provided to face an upstream portion of the fly conveyance table portion 13*b* in the conveying direction and the sub table 14 from above, a piston rod (not shown) reciprocating in the cylinder 29*a*, and a slide block 29*b* that is integrated with the piston rod and moves along the cylinder 29*a*. The fly bundle pressing portion 28 is fixed to the slide block 29*b* via the fixed plate 56. When the rodless cylinder reciprocates the slide block 29*b*, the fly taking-out unit 30 reciprocates between the fly bundle base 17 and the upstream portion of the first conveyor 24. A fly passage sensor 57 for detecting whether the fly 1 has passed is provided below a path of the fly 1 associated with the reciprocating movement of the slide block 29*b*. The fly passage sensor 57 is provided such that a detection surface thereof faces upward.

Figure 4:
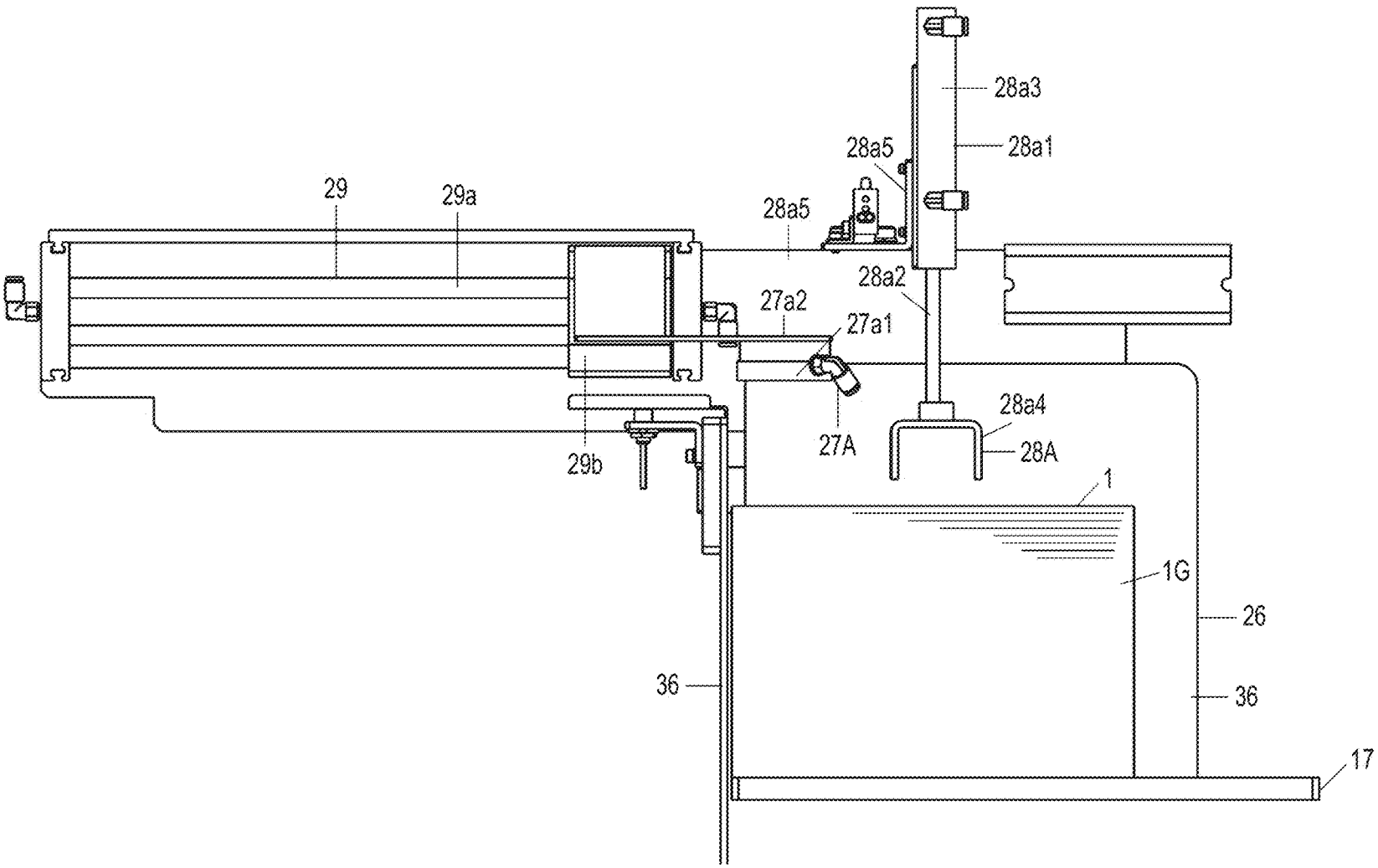
FIG. 4 is a left side view illustrating a modification of the configuration for taking out the fly from the fly bundle and conveying the fly.

The fly supplying portion 29 described above performs the process in procedure 1), that is, the fly supply process from the fly bundle as follows. As illustrated in FIG. 4, the process in procedure 1) is a process of taking out one fly 1 from the fly bundle 1G and supplying the fly 1 to the first conveyor 24 according to the following processing procedures in procedure 1-1) to procedure 1-15).

In procedure 1-1), the fly bundle presence sensor 37 detects the presence or absence of the fly bundle 1G.

In procedure 1-1A), when the fly bundle presence sensor 37 is turned OFF and the fly bundle 1G is not detected, the fly bundle base 17 moves downward.

In procedure 1-1B), the downward movement is continued when the lower limit sensor is turned OFF, that is, while the fly bundle base 17 is not detected.

In procedure 1-1C), then, when the lower limit sensor detects the fly bundle base 17 during the downward movement and is turned ON, the fly bundle base 17 stops. Then, the process returns to the process in procedure 1-1).

In procedure 1-2), after the fly bundle presence sensor 37 is turned ON and detects the fly bundle 1G, when the worker presses a start button for fly supply, the process proceeds to the next process. The start button is provided around the worker position.

In procedure 1-3), the lifting device 25 used for the fly bundle base 17 is driven, and the fly bundle base 17 moves upward. When the upper limit sensor is turned ON while the fly bundle base 17 moves upward, the lifting device 25 is stopped and the fly bundle base 17 is stopped regardless of the process in procedure 1-4).

In procedure 1-4), the detection is repeated until the fly bundle press sensor 54*c* is turned ON.

In procedure 1-5), when the fly bundle 1G moving upward comes into contact with the pair of claws 38, and the pair of claws 38 slightly move upward by a force provided by the fly bundle 1G, the fly bundle press sensor 54*c* is turned ON, the lifting device 25 is stopped, and the fly bundle base 17 is stopped.

In procedure 1-6), the cylinder device 42 of the fly taking-out portion 27 is driven, the pair of claws 38 close to narrow the interval therebetween, and the fly 1 is sandwiched between the pair of claws 38.

In procedure 1-7), the cylinder device 54 of the fly bundle pressing portion 28 is driven, and the fly taking-out portion 27 moves upward. The pair of claws 38 are a part of the fly taking-out portion 27, and thus the pair of claws 38 move upward with the fly 1 sandwiched therebetween.

In procedure 1-8), the lifting device 25 used for the fly bundle base 17 is driven, and the fly bundle base 17 moves downward.

In procedure 1-9), a detection regarding whether the fly bundle base 17 has passed through a lower limit value is repeated. The lower limit value is different from that of the lower limit sensor, and is above a position at which a fly bundle base 17 is detected by the lower limit sensor.

In procedure 1-10), when the fly bundle base 17 moving downward reaches the lower limit value, the fly bundle base 17 is stopped.

In procedure 1-11), the fly supplying portion 29 is driven, and the fly taking-out unit 30 advances.

In procedure 1-12), the fly passage sensor 57 detects whether the fly 1 has passed. The fly passage sensor 57 detects the passage as ON, and detects the non-passage as OFF.

In procedure 1-12A), when the fly passage sensor 57 remains OFF even after the elapse of a set time, a warning is issued to notify that an abnormality has occurred. The warning indicates the non-passage of the fly 1 on an operation panel of the control device, for example.

In procedure 1-13), when the fly passage sensor 57 is turned ON, the cylinder device 42 of the fly taking-out portion 27 is driven, the pair of claws 38 open, and the fly 1 falls to the upstream portion of the first conveyor 24.

In procedure 1-14), the fly supplying portion 29 is driven, the fly taking-out unit 30 retracts, and the fly taking-out portion 27 returns to a position immediately above the fly bundle base 17.

In procedure 1-15), the cylinder device 54 of the fly bundle pressing portion 28 is driven, the fly taking-out portion 27 (the pair of claws 38) of the fly taking-out unit 30 moves downward. Then, the pair of claws 38 of the fly taking-out portion 27 return to initial positions. Hereinafter, the process returns to the process in procedure 1-3).

The first supplying device 23 described above may include modifications described below. FIG. 4 illustrates a fly taking-out portion 27A and a fly bundle pressing portion 28A in the first supplying device 23 according to a first modification.

The fly taking-out portion 27A according to the first modification is a suction mechanism 27*al* that sucks the fly 1. The suction mechanism 27*al* is fixed to the slide block 29*b* of the fly supplying portion 29 via a fixed plate 27*a*2. The suction mechanism 27*al* is well known. When compressed air flows into the suction mechanism 27*al*, the air is drawn into the inside from a lower surface of the suction mechanism 27*al*, and the fly 1 on a fly bundle base 17 is adsorbed to the lower surface of the suction mechanism 27*al*.

The fly bundle pressing portion 28A according to the first modification includes a cylinder device 28*a*1 in which a piston rod 28*a*2 moves downward, and a pressing metal fitting 28*a*4 fixed to a tip end portion (a lower end portion) of the piston rod 28*a*2.

A cylinder 28*a*3 of the cylinder device 28*a*1 is fixed to the frame via a plurality of metal fittings 28*a*5.

The pressing metal fitting 28*a*4 is a metal plate bent in a U-shape in the illustrated example, and is fixed to the piston rod 28*a*2 in a state of being opened downward.

Figure 5:
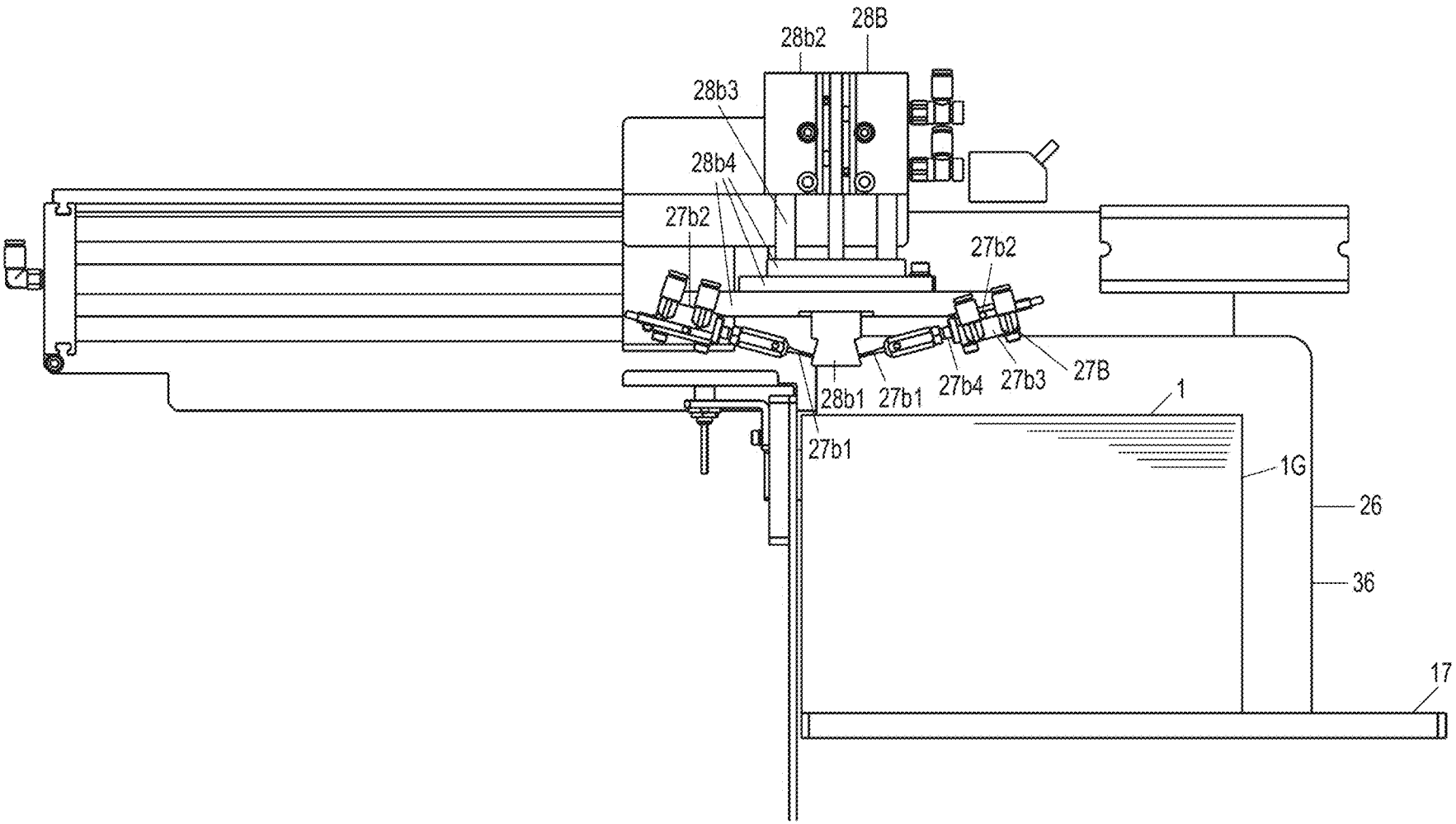
FIG. 5 is a left side view illustrating another modification of the configuration for taking out the fly from the fly bundle and conveying the fly.

FIG. 5 illustrates a fly taking-out portion 27B and a fly bundle pressing portion 28B in the first supplying device 23 as a second modification.

The fly bundle pressing portion 28B as the second modification includes a pressing block 28*b*1 having a substantially horizontal lower surface, and a cylinder device 28*b*2 that is disposed above the pressing block 28*b*1 and can move the pressing block 28*b*1 upward and downward. A plurality of plates 28*b*4 are fixed to a tip end portion (a lower end portion) of a piston rod 28*b*3 of the cylinder device 28*b*2 in an overlapped state. The pressing block 28*b*1 is fixed to a lower surface of the lowermost plate 28*b*4 among the plurality of plates 28*b*4 at an intermediate portion in a forward-rearward direction.

The fly taking-out portion 27B as the second modification includes a pair of needles 27*b*1 for piercing the fly 1, and a pair of cylinder devices 27*b*2 that separately reciprocate the pair of needles 27*b*1. The pair of cylinder devices 27*b*2 are symmetrically fixed to both sides in the forward-rearward direction (a direction opposite to the conveying direction and the conveying direction) with the pressing block 28*b*1 as a center with respect to the plurality of plates 28*b*4 of the fly bundle pressing portion 28.

Each of the cylinder devices 27*b*2 includes a cylinder 27*b*3 that is fixed to the lowermost plate 28*b*4 among the plurality of plates 28*b*4 of the fly bundle pressing portion 28, and a piston rod 27*b*4 to which the corresponding needle 27*b*1 is fixed at a tip portion thereof.

The pair of needles 27*b*1 protrude and retract from the lower surface of the pressing block 28*b*1 in response to the reciprocating movement of the piston rods 27*b*4. The lower surface of the pressing block 28*b*1 is formed with needle passage holes (not shown) separately communicating with both front and rear surfaces of the pressing block 28*b*1. When the pair of needles 27*b*1 protrude from the lower surface of the pressing block 28*b*1, the tip portions of the pair of needles 27*b*1 intersect with each other. Then, the pair of needles 27*b*1 pierce the fly 1 in an intersecting manner to stably support the fly 1.

Figure 6:
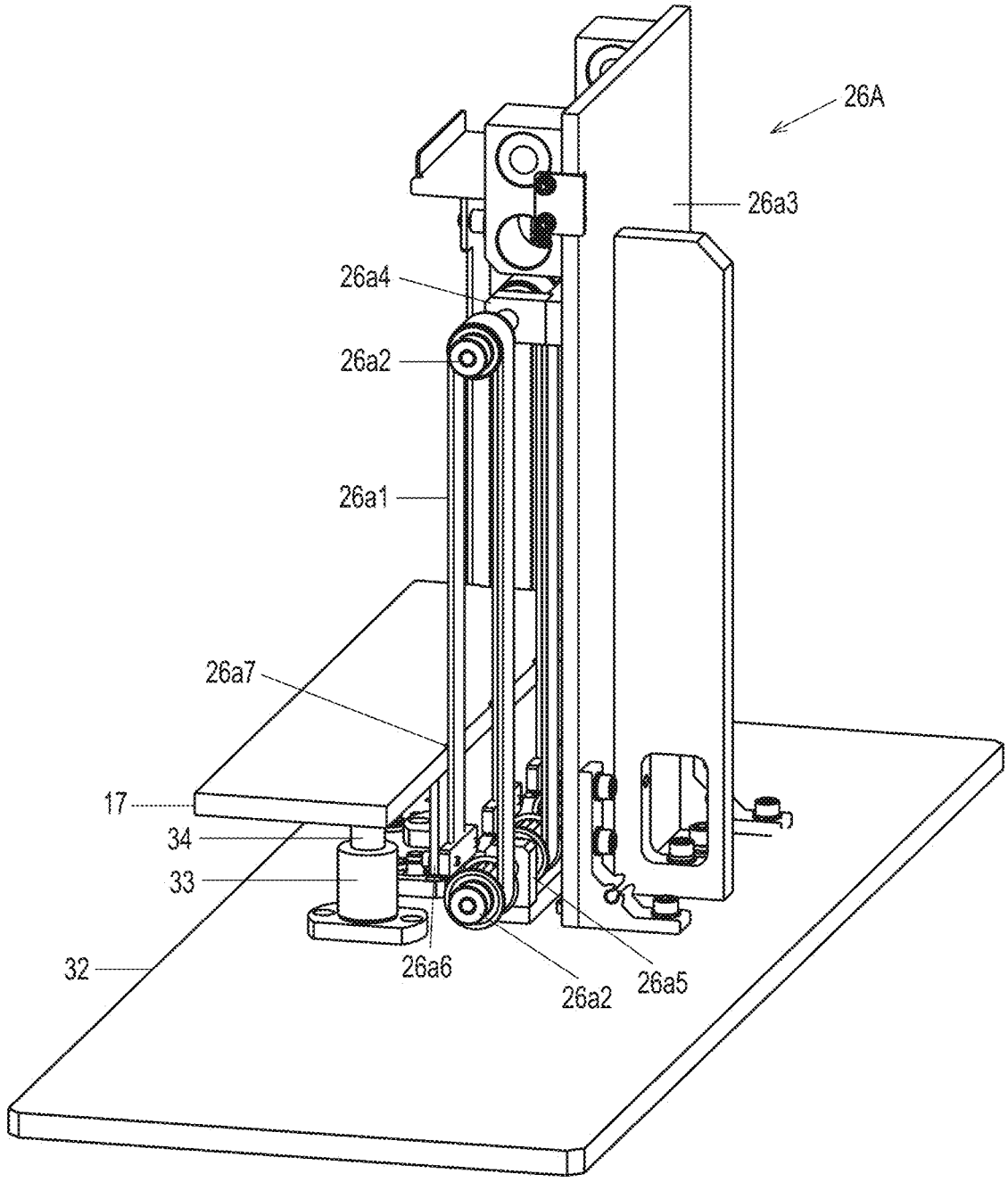
FIG. 6 is a perspective view illustrating a modification of a configuration for positioning the fly bundle.
Figure 7:
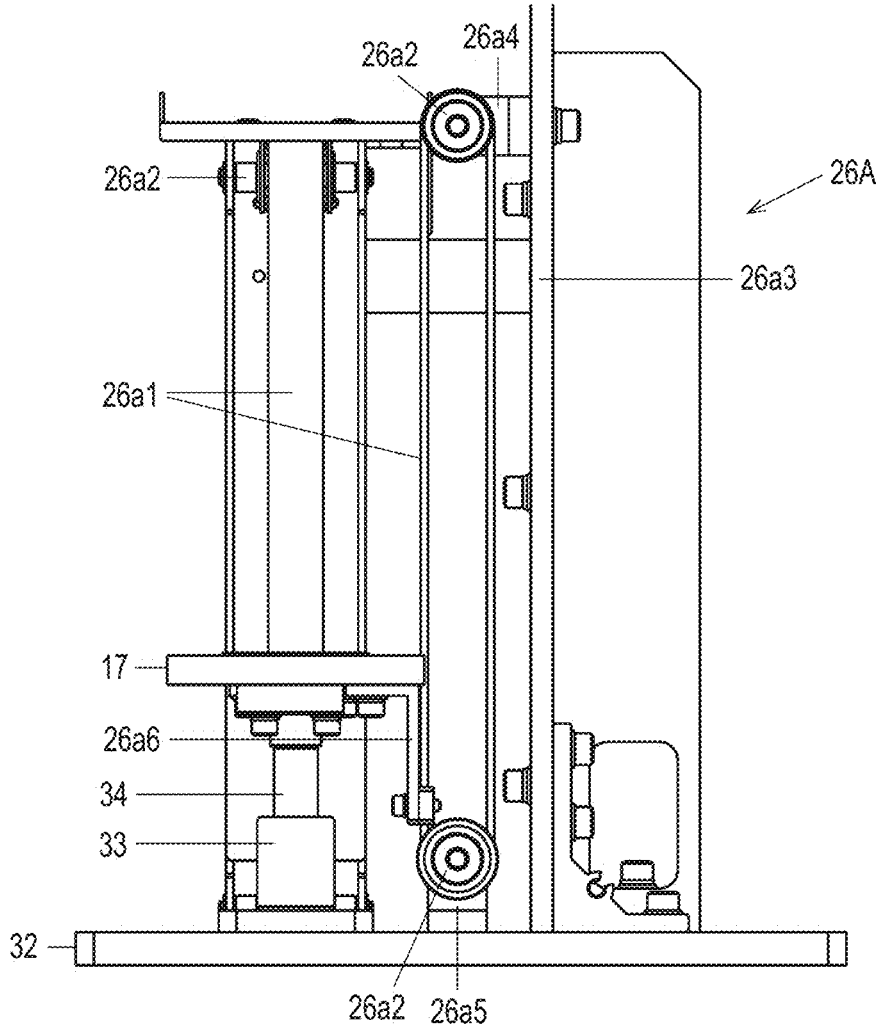
FIG. 7 is a front view illustrating the modification of the configuration for positioning the fly bundle.

FIGS. 6 and 7 illustrate a fly bundle positioning portion 26A in the first supplying device 23 according to the first modification. The fly bundle positioning portion 26A according to the first modification is partially fixed to the fly bundle base 17, and partially moves upward and downward with the upward and downward movement of the fly bundle base 17. More specifically, the fly bundle positioning portion 26A according to the first modification includes annular belts 26*a*1 that separately position two orthogonal surfaces among four side surfaces of the rectangular parallelepiped fly bundle 1G, and upper and lower rollers 26*a*2 around which the belts 26*a*1 are wound.

The upper and lower rollers 26*a*2 are disposed inside the annular shape of the belts 26*a*1. A support plate 26*a*3 for supporting the upper rollers 26*a*2 is fixed to the fixed plate 32 of the lifting device 25 in a standing state. A support arm 26*a*4 is supported on an upper portion of the support plate 26*a*3 in a state of extending horizontally. The upper rollers 26*a*2 are rotatably supported by a tip portion of the support arm 26*a*4. On the other hand, a support arm 26*a*5 for supporting the lower rollers 26*a*2 is fixed to the fixed plate 32 in a standing state. The lower rollers 26*a*2 are rotatably supported by the support arm 26*a*5.

The belts 26*a*1 are separately fixed to one side (the right side) opposite to the worker position and a rear side among the four sides of the fly bundle base 17 that is rectangular in the plan view. The plurality of belts 26*a*1 are fixed to the right side among the four sides of the rectangular fly bundle base 17 at an interval in a longitudinal direction (the forward-rearward direction) of the side. The belts 26*a*1 are disposed in a state of extending in the upward-downward direction with respect to the fly bundle base 17. A portion of each belt 26*a*1 extending downward with respect to the fly bundle base 17 is fixed to the fly bundle base 17 via a bracket 26*a*6.

Grooves 26*a*7 are formed in the right side and the rear side of the fly bundle base 17 that is rectangular in the plan view so as to penetrate in the upward-downward direction. The belts 26*a*1 are inserted into the grooves 26*a*7 such that a thickness direction of the belts 26*a*1 is aligned with a depth direction of the grooves 26*a*7.

The fly bundle positioning portion 26A according to the first modification described above positions the fly bundle 1G by bringing the fly bundle 1G into contact with the belts 26*al* positioned on the right side and the rear side of the fly bundle base 17. Further, since the fly bundle base 17 and the belts 26*al* are fixed, the fly bundle 1G and the belts 26*al* move upward and downward together when the fly bundle base 17 moves upward and downward, and a state in which the fly bundle 17 and the belts 26*al* are positioned is maintained.

Figure 8:
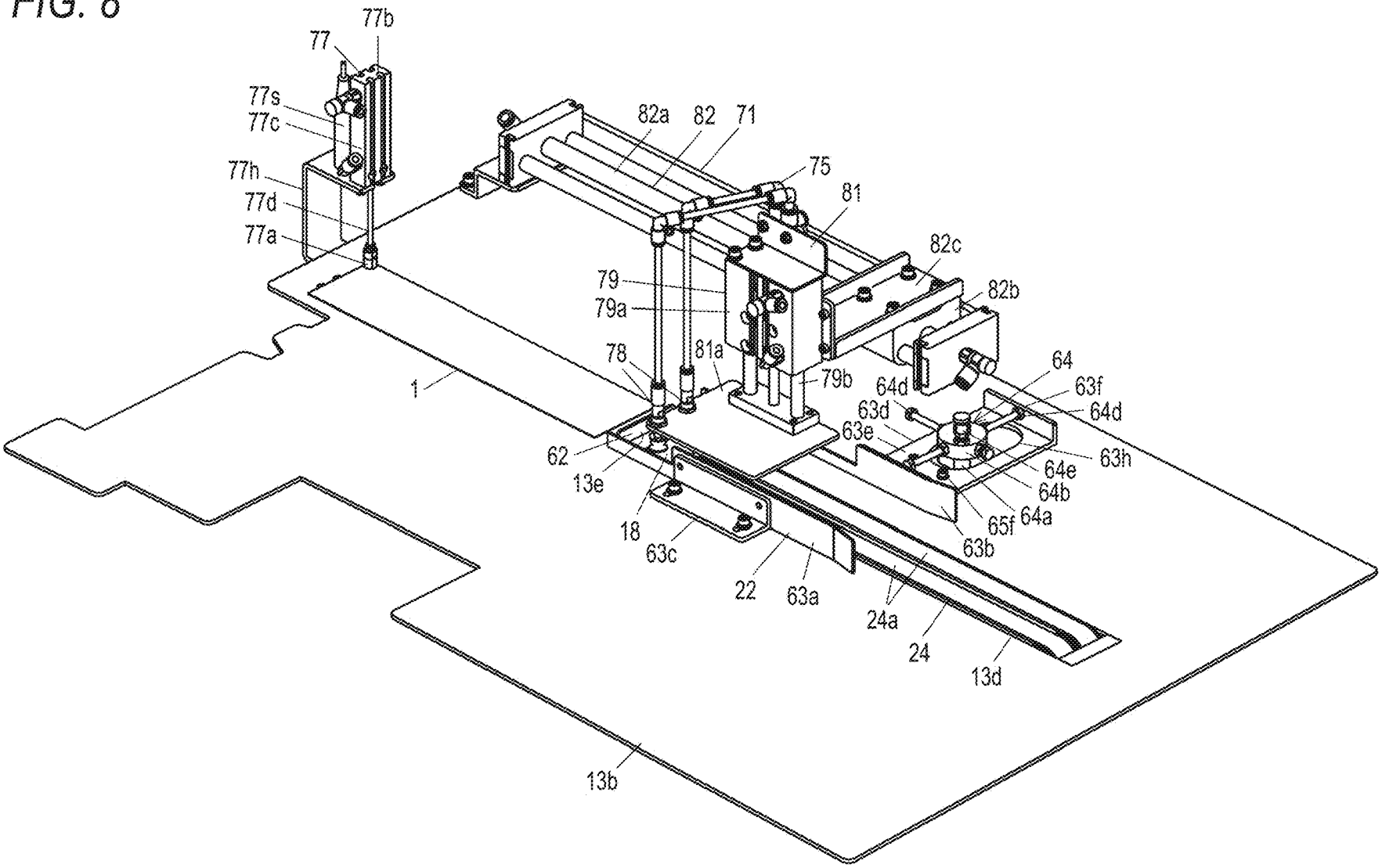
FIG. 8 is a perspective view illustrating a configuration for conveying the fly toward a first sewing machine.
Figure 9:
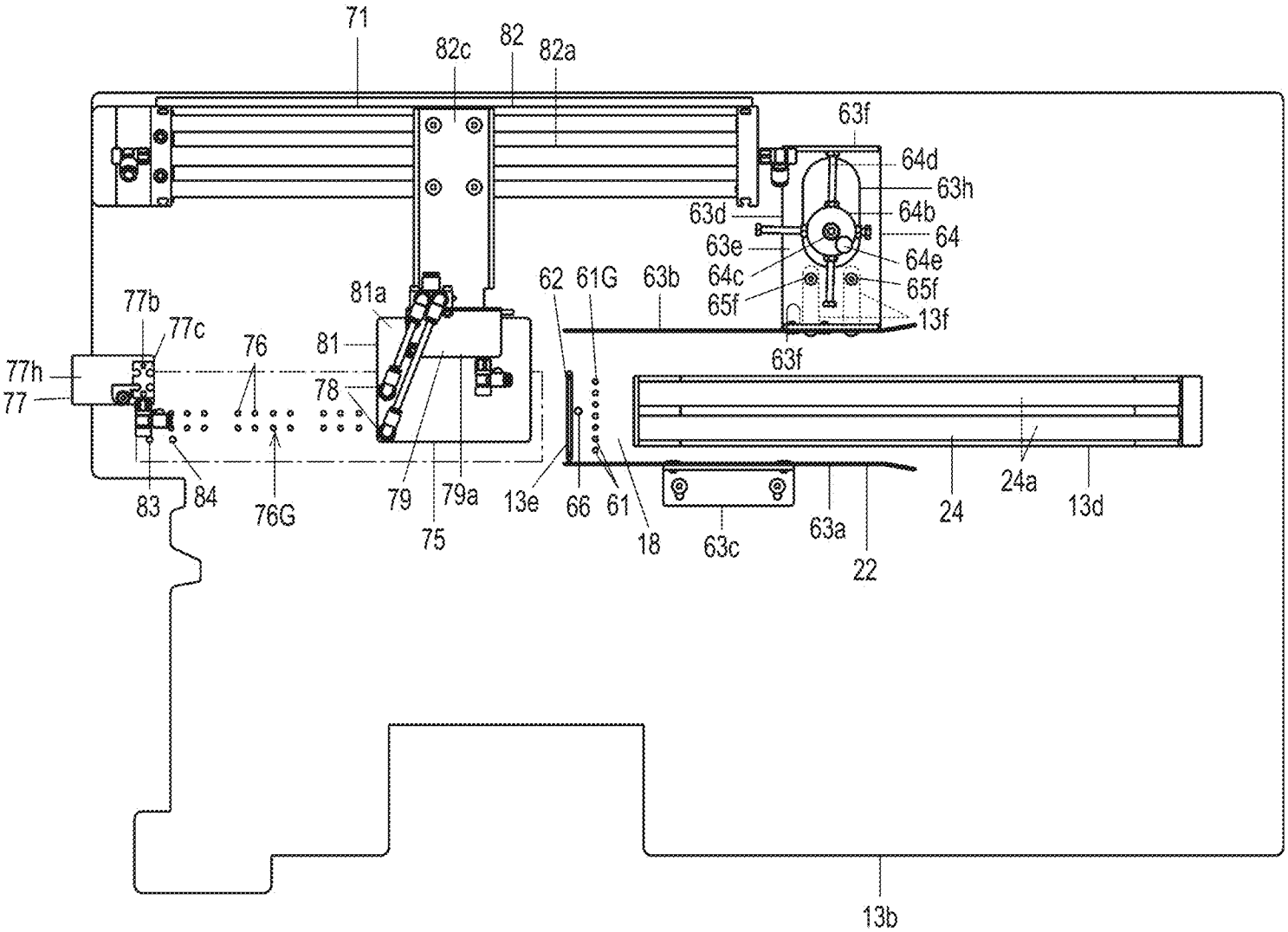
FIG. 9 is a plan view illustrating the configuration for conveying the fly toward the first sewing machine.

As illustrated in FIGS. 8 and 9, the fly 1 is supplied from the first supplying device 23 including the modifications described above to a belt conveyor as the first conveyor 24. A part of each belt 24*a* of the first conveyor 24 is provided to linearly convey the fly 1 rearward. In addition, each belt 24*a* includes a portion provided above a groove portion 13*d* that is formed in a part of the fly conveyance table portion 13*b* and is low in a stepped manner, and a portion provided to be guided from vicinities of front and rear ends of the groove portion 13*d* below the fly conveyance table portion 13*b*. The first conveyor 24 includes the plurality of belts 24*a* arranged in parallel in the left-right direction. When the first conveyor 24 is driven, the belts 24*a* move, and the fly 1 on the belts 24*a* also moves from an upstream side to a downstream side of the first conveyor 24 and is conveyed to the fly base 18.

The fly base 18 is a part of the fly conveyance table portion 13*b*, and is a portion positioned on a downstream side (a rear side) in the conveying direction with respect to the groove portion 13*d*. Then, the fly 1 conveyed to the fly base 18 is positioned by the fly positioning device 22.

Figure 10:
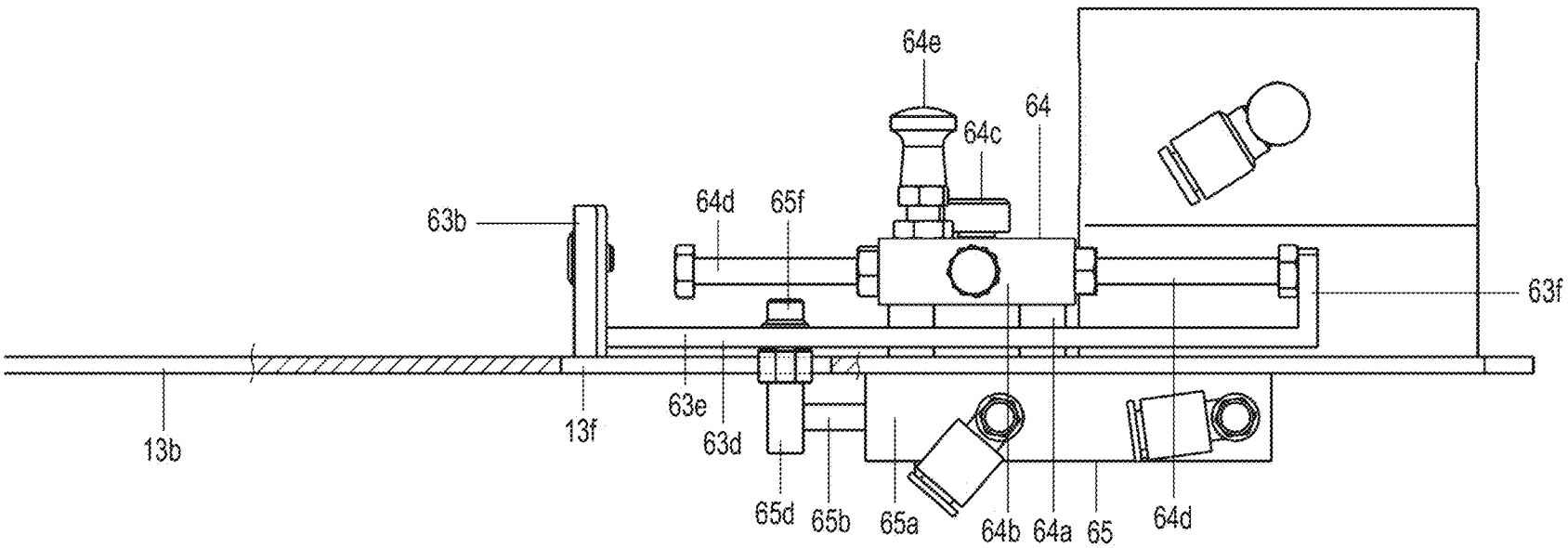
FIG. 10 is a front view illustrating a configuration for positioning the fly.

As illustrated in FIGS. 8 to 10, the fly positioning device 22 includes: a first suction hole group 61G that penetrates the fly base 18 in the upward-downward direction and sucks and positions the fly 1, a fly stopper 62 that is provided on the downstream side in the conveying direction with respect to the first suction hole group 61G and can protrude and retract above the fly conveyance table portion 13*b*, a cylinder device (not shown) used for the fly stopper 62 that supports the fly stopper 62 so as to be able to move upward and downward, a pair of width correcting guides 63*a* and 63*b* that are provided on the upstream side in the conveying direction with respect to the fly stopper 62 and face each other in a direction orthogonal to the conveying direction in a plan view, a width adjusting portion 64 that adjusts an interval between the pair of width correcting guides 63*a* and 63*b* to correspond to the width of the fly 1, and a cylinder device 65 that reciprocates one of the width correcting guides 63*a* and 63*b* in the direction orthogonal to the conveying direction.

The fly stopper 62 is a flat plate in the illustrated example. In order to allow the fly stopper 62 to protrude and retract, a through hole 13*e* penetrating in the upward-downward direction is formed in the fly conveyance table portion 13*b*. Although not shown, a plurality of pins may be used as the fly stopper 62 instead of the flat plate. The plurality of pins are arranged at intervals in the direction orthogonal to the conveying direction in the plan view.

The first suction hole group 61G is formed on the upstream side in the conveying direction with respect to the through hole 13*e* used for the fly stopper 62. The first suction hole group 61G is constituted by a plurality of through holes 61 penetrating the fly conveyance table portion 13*b* in the upward-downward direction.

The pair of width correcting guides 63*a* and 63*b* are provided over a range between the fly stopper 62 and a downstream portion of the first conveyor 24. Further, the width correcting guide 63*a* is unmovable so that a position thereof does not change, and a position of the width correcting guide 63*b* is movable in the direction orthogonal to the conveying direction. When the pair of width correcting guides 63*a* and 63*b* are distinguished from each other, the unmovable width correcting guide is referred to as the fixed guide 63*a*, and the movable width correcting guide is referred to as the movable guide 63*b*.

Both the fixed guide 63*a* and the movable guide 63*b* are vertical plates extending in the forward-rearward direction (the conveying direction). Further, upstream portions (front portions) of the fixed guide 63*a* and the movable guide 63*b* are inclined such that the interval therebetween increases toward the upstream side.

The fixed guide 63*a* is fixed to an upper surface of the fly conveyance table portion 13*b* on an upper side via a metal fitting 63*c*. The metal fitting 63*c* is bent at a right angle.

A metal fitting 63*d* for fixing the movable guide 63*b* is bent at a right angle such that both end portions thereof face an originally rectangular plate. That is, the metal fitting 63*d* includes a central plate portion 63*e* facing the fly conveyance table portion 13*b*, and a pair of end plate portions 63*f* bent with respect to the central plate portion 63*e*. The pair of end plate portions 63*f* face each other in the left-right direction (the direction orthogonal to the conveying direction). The movable guide 63*b* is fixed to the end plate portion 63*f* on a left side. The central plate portion 63*e* is disposed above the fly conveyance table portion 13*b*. Further, as illustrated in FIG. 10, a cylinder 65*a* of the cylinder device 65 is fixed to a lower surface of the fly conveyance table portion 13*b*.

A piston rod 65*b* of the cylinder device 65 reciprocates in the left-right direction. A long hole 13*f*, which is long in the left-right direction, is formed in the fly conveyance table portion 13*b* to penetrate in the upward-downward direction immediately above a range in which a tip portion of the piston rod 65*b* reciprocates. A connecting portion 65*d* is fixed to the tip portion of the piston rod 65*b*. The connecting portion 65*d* penetrates the long hole 13*f* and is fixed to the central plate portion 63*e* of the metal fitting 63*d* via a bolt 65*f*. Therefore, when the piston rod 65*b* reciprocates, the movable guide 63*b* connected to the piston rod 65*b* via the connecting portion 65*d* and the metal fitting 63*d* also reciprocates. Further, as illustrated in FIG. 9, a window hole 63*h* penetrating in the upward-downward direction is formed in the central plate portion 63*e* of the metal fitting 63*d* on a side opposite to the fixed guide 63*a* with respect to the bolt 65*f*. The width adjusting portion 64 is fixed to the upper surface of a fly conveyance table portion 13*b* in a state of protruding upward from the window hole 63*h*.

As illustrated in FIG. 10, the width adjusting portion 64 includes a fixed plate 64*a* that is fixed above the fly conveyance table portion 13*b* at a position of the window hole 63*h* of the metal fitting 63*d*, a rotating plate 64*b* that is overlapped on the fixed plate 64*a*, a shaft 64*c* that rotatably fixes the rotating plate 64*b* to the fixed plate 64*a*, a plurality of bars 64*d* that have different lengths and are fixed to an outer peripheral surface of the rotating plate 64*b* at intervals, and a knob 64*e* that is fixed above the rotating plate 64*b*.

As illustrated in FIG. 9, a position of the knob 64*e* is an eccentric position on the rotating plate 64*b* around the shaft 64*c*.

The number of bars 64*d* is four in total. The four bars 64*d* are fixed to the outer peripheral surface of the rotating plate 64*b* at intervals of 90 degrees in a circumferential direction around a shaft 64*c* in the plan view. Positions of the four bars 64*d* in the circumferential direction around the shaft 64*c* are changed by an operation of the knob 64*e*. In addition, the bar 64*d* on the right side faces the end plate portion 63*f* on the right side with respect to the rotating plate 64*b*, and sets a minimum width of the pair of width correcting guides 63*a* and 63*b*. Therefore, the knob 64*e* is operated to set the bar 64*d* disposed on the right side with respect to the shaft 64*c* in correspondence with the width of the fly 1 to be conveyed.

In addition to the first suction hole group 61G and the fly stopper 62 and the like, the fly positioning device 22 includes a fly arrival sensor 66 that detects whether the fly 1 has arrived (the presence or absence of the fly). The fly arrival sensor 66 is embedded in the fly base 18 such that a detection surface thereof is exposed upward. The fly arrival sensor 66 is disposed between the pair of width correcting guides 63*a* and 63*b* in the direction orthogonal to the conveying direction, and is disposed between the first suction hole group 61G and the through hole 13*e* used for the fly stopper 62 in the conveying direction. The above is the descriptions of the fly supplying portion 11*a*.

As illustrated in FIG. 1, the edge overcasting portion 11 includes, in addition to the fly supplying portion 11*a*, a first conveying device 68 that conveys the fly 1 supplied from the fly supplying portion 11*a* to the fly base 18, and a first sewing machine 69 that performs the edge overcasting on the fly 1 during conveyance by the first conveying device 68.

The first conveying device 68 includes a pre-sewing conveying portion 71 that linearly conveys the fly 1 from the fly base 18 along a conveying direction of the first conveyor 24, a conveying portion 72 for edge overcasting that conveys the fly 1 conveyed from the pre-sewing conveying portion 71 toward the first sewing machine 69 along the sewing table portion 13*a*, and a second conveyor 73 that conveys the fly 1 on which the edge overcasting is finished in cooperation with the conveying portion 72 for edge overcasting.

As illustrated in FIGS. 8 and 9, the pre-sewing conveying portion 71 includes a suction conveyor 75 that sucks the fly 1 on the fly base 18 from above and conveys the fly 1 to a corner of the main table 13, a second suction hole group 76G that is provided immediately below a conveying destination of the suction conveyor 75, penetrates the corner of the main table 13 in the upward-downward direction, and sucks and positions the fly 1, and a thickness detection device 77 that detects the thickness of the fly 1 at the conveying destination of the suction conveyor 75.

The suction conveyor 75 includes suction port portions 78 that suck the fly 1, a lifting device 79 that is capable of moving the suction port portions 78 upward and downward, and a suction unit conveying device 82 that is capable of reciprocating a suction unit 81 in which the lifting device 79 and the suction port portions 78 are integrated in the conveying direction (the forward-rearward direction).

A rodless cylinder is used as the suction unit conveying device 82. The rodless cylinder includes a tubular cylinder 82*a* that is provided above the fly conveyance table portion 13*b* to extend in the forward-rearward direction, a piston (not shown) reciprocating in the cylinder 82*a*, and a slide block 82*b* that is integrated with the piston and moves along the cylinder 82*a*. The suction unit 81 is fixed to the slide block 82*b* via a metal fitting 82*c*.

A cylinder device is used as the lifting device 79. The cylinder device includes a cylinder 79*a* vertically fixed to the metal fitting 82*c*, and piston rods 79*b* moving downward with respect to the cylinder 79*a*.

The suction unit 81 includes, in addition to the suction port portions 78 and the lifting device 79, a fixed plate 81*a* that faces the fly conveyance table portion 13*b* from above. The suction port portions 78 in a state of sucking in the air from below and tip portions of the piston rods 79*b* are fixed to the fixed plate 81*a*. Tip portions of the suction port portions 78 preferably have elasticity, and for example, a bellows-shaped rubber tube is used. An impact when the suction port portions 78 are pressed against the fly 1 on the fly base 18 is absorbed by the elasticity of the tip portions of the suction port portions 78.

The thickness detection device 77 includes a fly presser 77*a* that presses the fly 1 on the corner of the main table 13, which is the conveying destination of the suction conveyor 75, at the corner, a lifting device 77*b* that is capable of moving the fly presser 77*a* upward and downward, and a thickness detection sensor 77*s*. A cylinder device is used as the lifting device 77*b*. The cylinder device includes a cylinder 77*c* that is supported above the main table 13 via a metal fitting 77*h* with respect to the main table 13, and a piston rod 77*d* that moves downward with respect to the cylinder 77*c*. The fly presser 77*a* is fixed to a tip portion of the piston rod 77*d*. The thickness detection sensor 77*s* that detects the thickness of the fly 1 based on a movement amount of the piston rod 77*d* is fixed to the cylinder 77*c*.

In addition, the pre-sewing conveying portion 71 includes two fly presence sensors 83 and 84 that are embedded at the corner of the main table 13, which is the conveying destination of the suction conveyor 75, in a state in which upper surfaces thereof are exposed, and that detect the presence or absence of the fly 1. The two fly presence sensors 83 and 84 are provided at an interval in the forward-rearward direction in a state in which detection surfaces thereof face upward.

Figure 11:
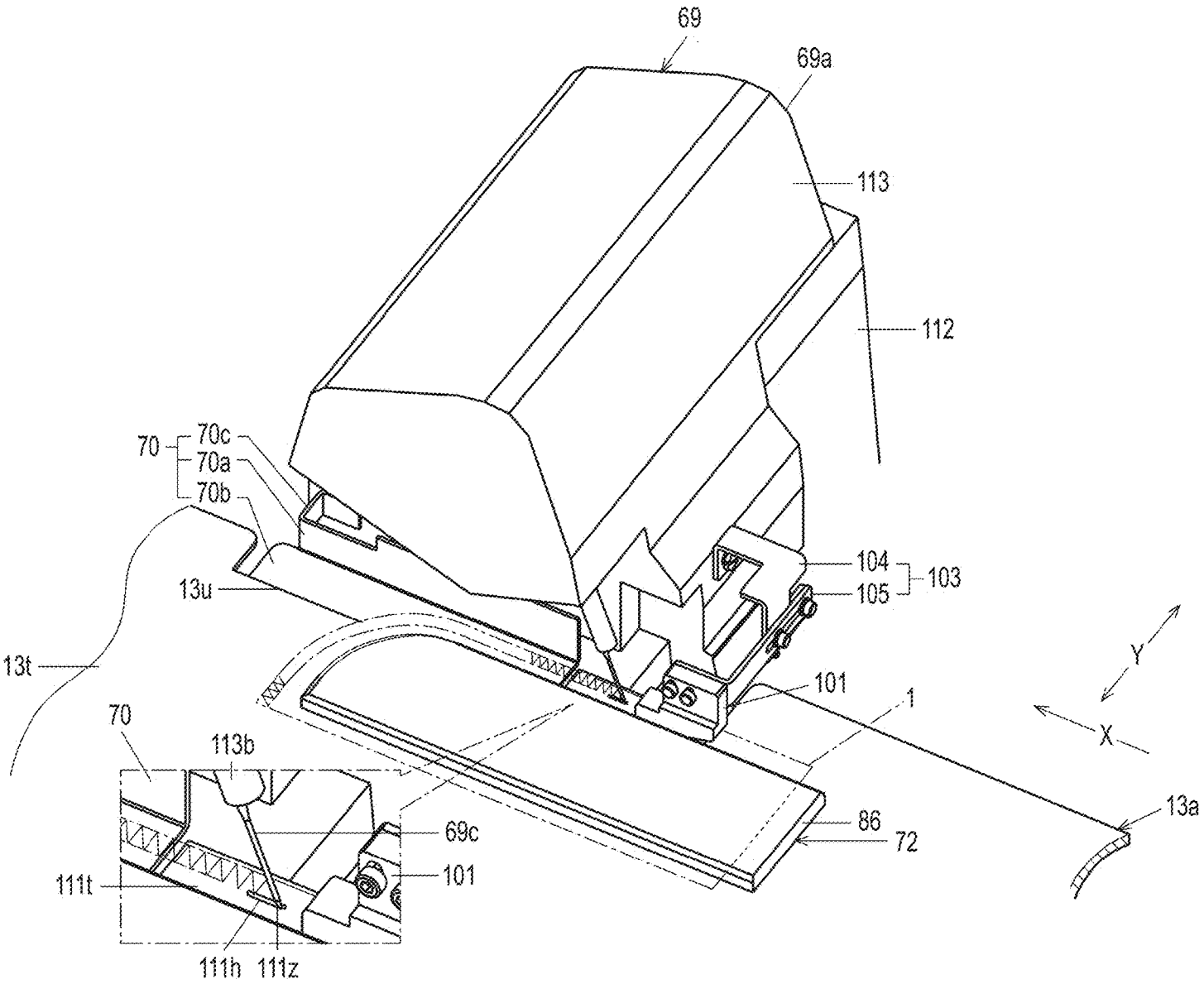
FIG. 11 is a perspective view illustrating the first sewing machine and a vicinity thereof.
Figure 15:
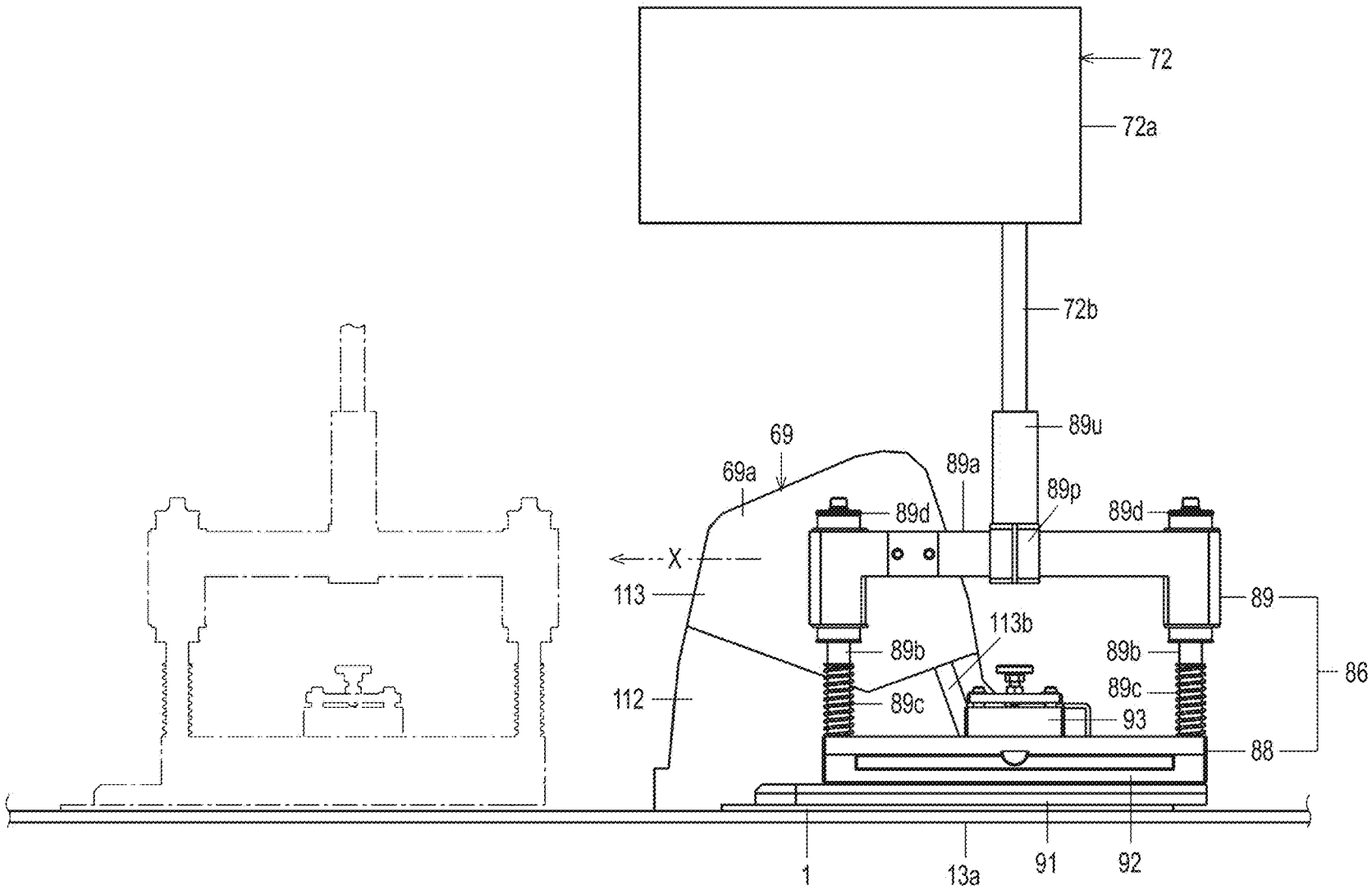
FIG. 15 is a front view illustrating a state in which the fly is sewn by the first sewing machine.

Incidentally, as illustrated in FIGS. 11 and 15, at the time of performing the edge overcasting, the fly 1 is conveyed while being pressed by a clamp portion 86 of the conveying portion 72 for edge overcasting. In addition to a clamp conveying portion 72*a*, the conveying portion 72 for edge overcasting includes the clamp portion 86 that is connected to the clamp conveying portion 72*a* and that presses the fly 1 against the sewing table portion 13*a*.

In order to accurately perform the edge overcasting on a rear end (a downstream end in the conveying direction) of the fly 1, it is desirable that the clamp portion 86 presses the fly 1 in a state of protruding forward with respect to the fly 1. In this case, the fly presence sensor 83 on the rear side functions as a first fly-rear end sensor that detects the presence or absence of the rear end of the fly 1 during the edge overcasting. On the other hand, the fly presence sensor 84 on the front side functions as a clamp portion sensor that detects the presence or absence of the clamp portion 86 during the edge overcasting.

The second suction hole group 76G is formed on the upstream side (a fly stopper 62 side) in the conveying direction with respect to the fly presence sensor 83. Similarly to the first suction hole group 61G, the second suction hole group 76G is constituted by a plurality of through holes 76 penetrating the fly conveyance table portion 13*b* in the upward-downward direction.

The first conveyor 24, the fly positioning device 22, and the pre-sewing conveying portion 71 perform the fly conveyance process before the sewing in procedure 2) as followings. The fly conveyance process before the sewing is a process in which the fly 1 is conveyed to the fly base 18 and positioned on the fly base 18, and then the fly 1 is conveyed to the conveying portion 72 for edge overcasting in the order of the following procedures 2-1) to 2-19).

In procedure 2-1), the first conveyor 24 is driven. When the fly 1 falls to the upstream portion of the first conveyor 24, the fly 1 is conveyed by the first conveyor 24.

In procedure 2-1A), the cylinder device used for the fly stopper 62 is driven together with the process in procedure 2-1), and the fly stopper 62 moves upward onto the fly base 18.

In procedure 2-2), the detection is repeated until the fly arrival sensor 66 is turned ON.

In procedure 2-3), when the fly arrival sensor 66 is turned ON and detects the arrival of the fly 1, the first conveyor 24 stops. The fly 1 conveyed by the first conveyor 24 collides with the fly stopper 62 and is positioned with respect to the conveying direction.

In procedure 2-4), the cylinder device 65 is driven, the movable guide 63*b* of the pair of width correcting guides 63*a* and 63*b* advances, the end plate portion 63*f* of the metal fitting 63*d* on the right side collides with a bolt on the right side of the width adjusting portion 64, and the advancing movement of the movable guide 63*b* is stopped. The interval between the pair of width correcting guides 63*a* and 63*b* is narrowed, the fly 1 is held between the pair of width correcting guides 63*a* and 63*b*, and then is positioned in the direction orthogonal to the conveying direction.

In procedure 2-5), the air is sucked from the through holes 61 of the first suction hole group 61G on the fly base 18, and the fly 1 is stuck to the fly base 18 to maintain a positioned state.

In procedure 2-6), the cylinder device used for the fly stopper 62 is driven, and the fly stopper 62 moves downward below the fly base 18.

In procedure 2-7), the lifting device 79 used for the suction unit 81 is driven, and the suction port portions 78 of the suction unit 81 move downward.

In procedure 2-8), the suction of the air from the through holes 61 of the first suction hole group 61G on the fly base 18 is stopped.

In procedure 2-9), the air is sucked from the suction port portions 78 of the suction unit 81, and the fly 1 is adsorbed to the suction port portions 78.

In procedure 2-10), the lifting device 79 for the suction unit 81 is driven, and the suction port portions 78 of the suction unit 81 move upward together with the fly 1.

In procedure 2-11), the suction unit conveying device 82 is driven, and the suction unit 81 advances together with the fly 1.

In procedure 2-12), the lifting device for the suction unit 81 is driven, and the suction port portions 78 move downward together with the fly 1. After this downward movement process, the process returns to the processes in procedure 2-1) and procedure 2-1A), and proceeds to procedure 2-13).

In procedure 2-13), the fly presence sensor 83 detects the presence or absence of the fly 1.

In procedure 2-13A), when the fly presence sensor 83 is turned OFF and the fly 1 is not detected, a warning is issued to notify that an abnormality has occurred.

In procedure 2-14) when the fly presence sensor 83 on the rear side (the upstream side in the conveying direction) is turned ON and the fly 1 is detected, the air is sucked from the second suction hole group 76G and the fly 1 is attracted.

In procedure 2-15), the suction of the air from the suction port portions 78 is stopped, and the fly 1 is separated from the suction port portions 78.

In procedure 2-16), the lifting device 79 for the suction unit 81 is driven, and the suction port portions 78 move upward.

In procedure 2-17), subsequently, the suction unit conveying device 82 is driven, and the suction unit 81 retracts and returns to an initial position (a starting position) located on the upstream side in the conveying direction.

In procedure 2-18), the lifting device 77*b* of the thickness detection device 77 is driven at the same time as the process in procedure 2-16), the fly presser 77*a* is moved downward toward the main table 13, the fly 1 is sandwiched between the main table 13 and the fly presser 77*a*, and the fly presser 77*a* is moved upward. Based on a detection result of the thickness detection sensor 77*s* when the fly 1 is sandwiched, it is detected whether the number of the fly 1 is normal, that is, one.

In procedure 2-19), the suction of the air from the second suction hole group 76G is stopped regardless of whether the number of the fly 1 is normal. Hereinafter, the process proceeds to the edge overcast process in procedure 3) and the fly discharge process in procedure 6).

Figure 14:
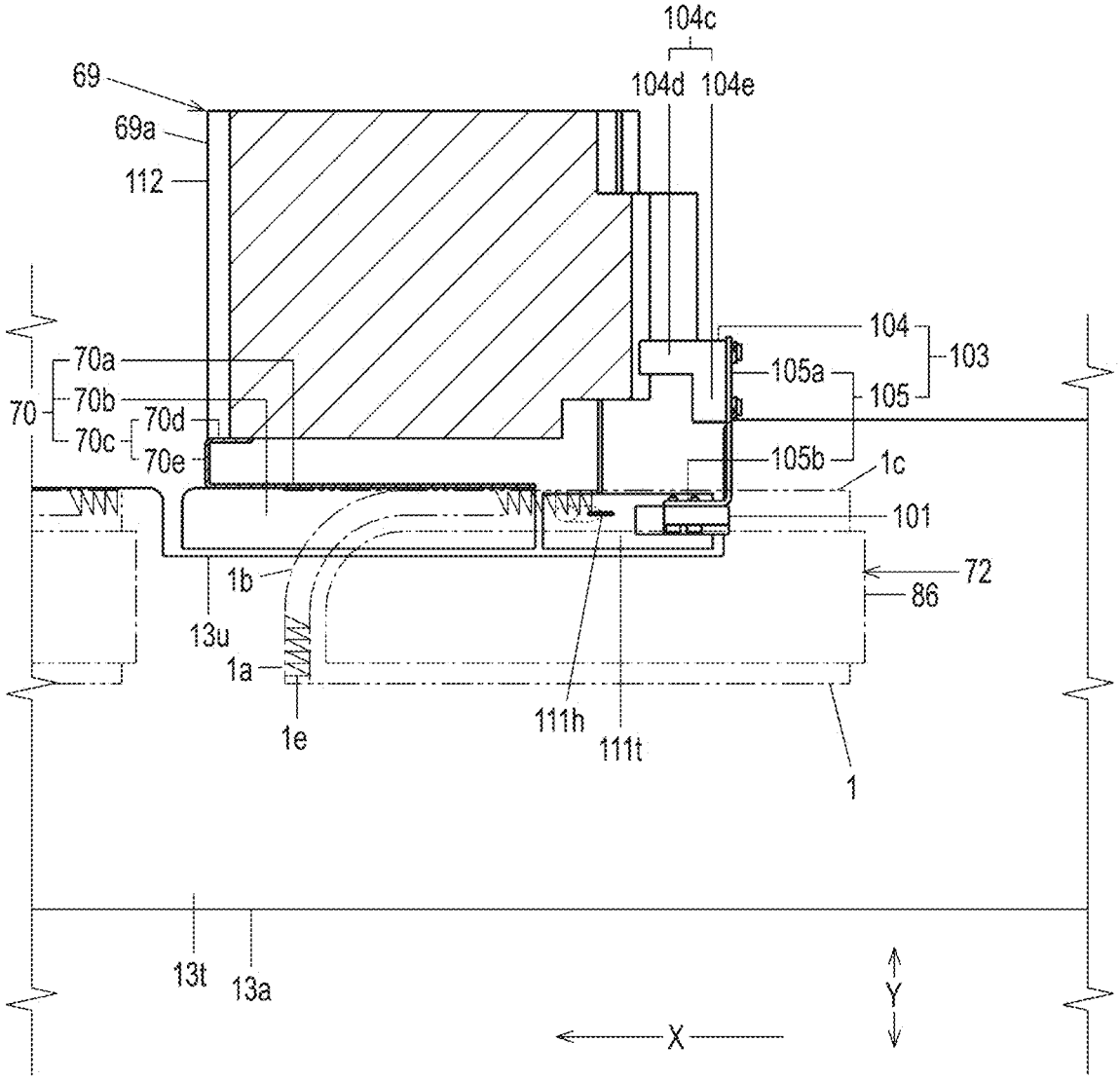
FIG. 14 is a cross-sectional view taken along a line XIV-XIV in FIG. 12.

As illustrated in FIG. 14, the sewing table portion 13*a* includes a needle plate 111*t* disposed under a needle of the first sewing machine 69, and a conveying table main body 13*t* that is a component separate from the needle plate 111*t*. In the present embodiment, in addition to the needle plate 111*t* and the conveying table main body 13*t*, the sewing table portion 13*a* includes, as a separate component, a part of a conveying direction mark 70 that is an accessory of the first sewing machine 69. All of the needle plate 111*t*, the conveying table main body 13*t*, and the part of the conveying direction mark 70 have a horizontal upper surface, and are aligned to be positioned on substantially the same plane.

The conveying direction mark 70 is a mark of a linear direction when the fly 1 is sewn while being linearly conveyed. The conveying direction mark 70 includes a mark main body portion 70*a* having a vertical surface, a lower plate portion 70*b* that extends to be bent at a right angle with respect to the mark main body portion 70*a* and can guide a lower surface side of the fly 1, and a fixed plate portion 70*c* that is continuous with the mark main body portion 70*a* and is fixed to a first sewing machine main body 69*a* of the first sewing machine 69. The lower plate portion 70*b* is a portion constituting a part of the sewing table portion 13*a*.

The mark main body portion 70*a* is a vertical plate and extends in the left-right direction. The lower plate portion 70*b* is continuous with a lower end portion of the mark main body portion 70*a*, and the fixed plate portion 70*c* for fixing to the first sewing machine main body 69*a* is continuous with an upper end portion of the mark main body portion 70*a*.

The fixed plate portion 70*c* is a plate that is bent at a right angle in a plan view, and includes a first fixed plate portion 70*d* that is fixed to the first sewing machine main body 69*a*, and a second fixed plate portion 70*e* that extends to be bent at a right angle with respect to the first fixed plate portion 70*d* and is continuous with the mark main body portion 70*a*. The second fixed plate portion [75*e*] 70*e* extends on a side opposite to the lower plate portion 70*b* with respect to the mark main body portion 70*a*. In addition, the first fixed plate portion 70*d* is parallel to the mark main body portion 70*a*.

The lower plate portion 70*b* is disposed on the downstream side in the conveying direction X with respect to the needle plate 111*t*.

The conveying table main body 13*t* extends linearly in the conveying direction X in a plan view, and extends in the left-right direction over a range between the upstream side and the downstream side with respect to the first sewing machine 69. A recess 13*u* recessed in a direction away from the first sewing machine 69 is formed in the conveying table main body 13*t*, and the lower plate portion 70*b* of the conveying direction mark 70 and the needle plate 111*t* are disposed in the recess 13*u*.

Figure 13:
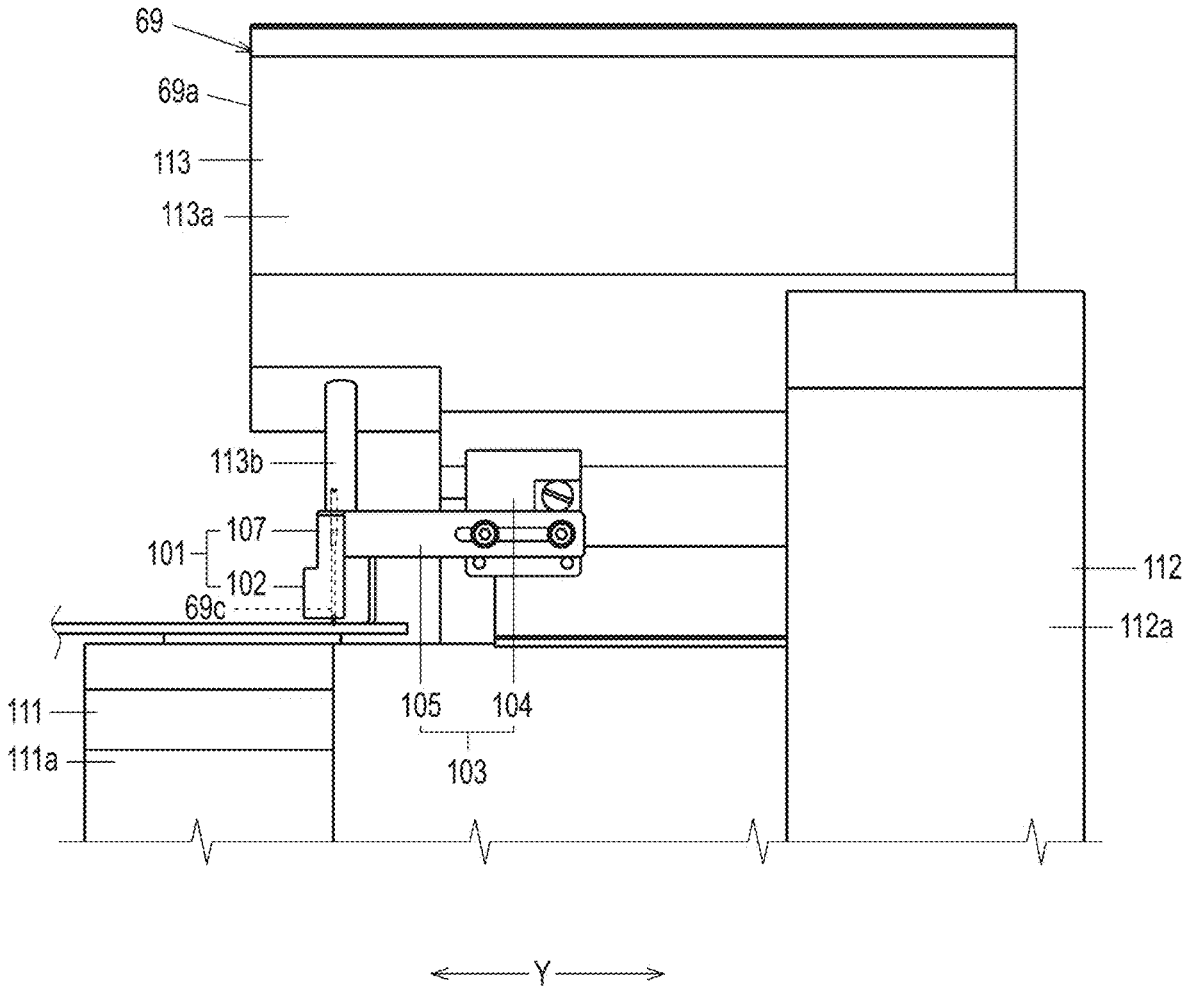
FIG. 13 is a right side view illustrating the first sewing machine and the vicinity thereof.

As illustrated in FIGS. 13 and 14, the first sewing machine 69 includes the first sewing machine main body 69*a* that performs the edge overcasting on the fly 1, a guide 101 that guides the fly 1 to approach an upper surface of the sewing table portion 13*a*, a bracket 103 that attaches the guide 101 to the first sewing machine main body 69*a*, and the conveying direction mark 70 described above. A reference numeral 1*e* in FIG. 14 denotes a sewing thread used for the edge overcasting. Further, the first sewing machine 69 is provided to be movable in the forward-rearward direction. When the first sewing machine 69 moves rearward, a needle 69*c* and the like of the first sewing machine 69 are detached from above a sewing table portion 13*a*, and the maintenance of the first sewing machine 69 is facilitated.

The conveying direction of the fly 1 with respect to the first sewing machine 69 depends on movement of the clamp conveying portion 72*a* of the conveying portion 72 for edge overcasting (a setting of the control device that controls the driving of the clamp conveying portion 72*a*). The clamp conveying portion 72*a* is, for example, an articulated robot. The clamp conveying portion 72*a* can be moved not only in a linear direction but also in various directions, and thus it seems that the conveying direction X is undefined at a glance. When the first sewing machine 69 performs the edge overcasting on the fly 1, the first sewing machine 69 sews the fly 1 while moving the clamp conveying portion 72*a* to match the horizontal side 1*a*, the curved side 1*b*, and the vertical side 1*c* of the fly 1. In the description of the first sewing machine 69, it is assumed that the linear direction along which the clamp conveying portion 72*a* is moved when the horizontal side 1*a* or the vertical side 1*c* is sewn is the conveying direction X of the fly 1. The "conveying direction X of the fly 1" coincides with a direction in which the conveying direction mark 70 can linearly guide an end of the fly 1.

The "conveying direction X of the fly 1" is a direction from right toward left in FIG. 14. In addition, the "upstream side in the conveying direction X" with respect to an object is the right side with respect to the object in FIG. 14. The "downstream side in the conveying direction X" with respect to the object is the left side with respect to the object in FIG. 14. A "direction Y orthogonal to the conveying direction X of the fly 1" is the forward-rearward direction. The direction Y is the upward-downward direction in FIG. 14. The upward direction in FIG. 14 is the rearward direction, and the downward direction in FIG. 14 is the forward direction.

The first sewing machine main body 69*a* is well-known, and forms a seam on the fly 1 placed on the needle plate 111*t* by entangling an upper thread passed through the needle 69*c* and a lower thread supplied to a lower side of the needle plate 111*t* of the sewing table portion 13*a*. Incidentally, in the present embodiment, the first sewing machine main body 69*a* is a chain stitch sewing machine, and is configured to perform the edge overcasting on the fly 1 in cooperation with a conveying portion 72 for edge overcasting.

Figure 12:
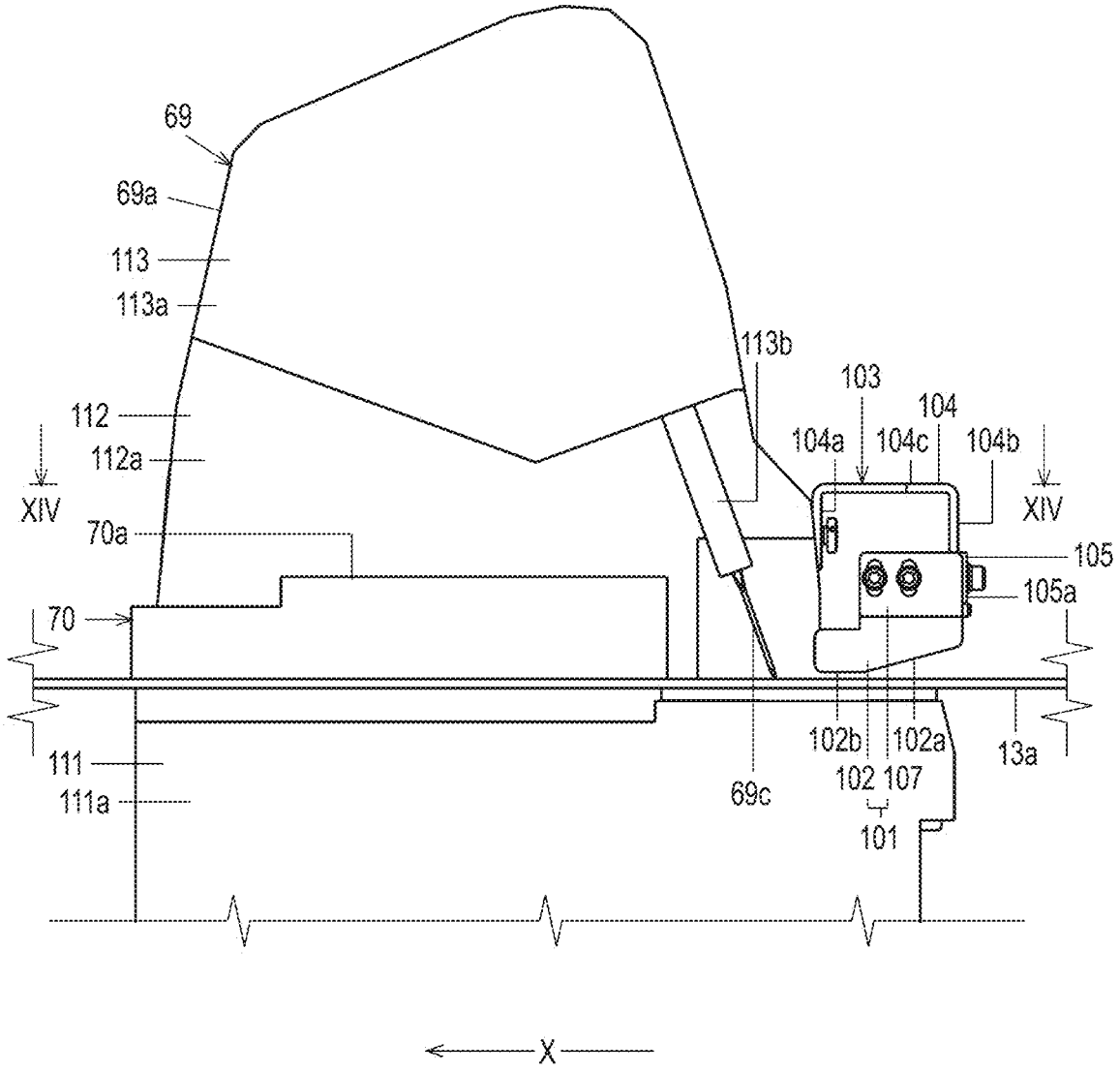
FIG. 12 is a front view illustrating the first sewing machine and the vicinity thereof.

As illustrated in FIGS. 12 and 13, the first sewing machine main body 69*a* includes a bed portion 111 provided on a lower side with respect to the sewing table portion 13*a*, a post portion 112 standing up from the bed portion 111, and a sewing machine head portion 113 that extends from an upper portion of the post portion 112 in a state of facing the bed portion 111 from above.

In the first sewing machine main body 69*a*, the bed portion 111 and the sewing machine head portion 113 extend in the forward-rearward direction in a state of being separated from each other in the upward-downward direction, and the post portion 112 extends in the upward-downward direction in a manner of being sandwiched between the bed portion 111 and a rear portion of the sewing machine head portion 113.

The bed portion 111 includes a bed case 111*a* forming a contour of the bed portion 111, and an internal mechanism accommodated in the bed case 111*a*. The internal mechanism is a mechanism for entangling the lower thread and the upper thread. The needle plate 111*t* formed with a needle hole 111*h* is provided as a part of the bed case 111*a* on an upper surface of the bed case 111*a*.

The sewing machine head portion 113 includes a sewing machine head case 113*a* forming a contour of the sewing machine head portion 113, and an internal mechanism accommodated in the sewing machine head case 113*a*. Incidentally, the internal mechanism is a needle bar upward-and-downward movement mechanism, a balance driving mechanism, or the like. Further, the sewing machine head portion 113 is disposed in a state in which a needle bar 113*b* of a needle bar driving mechanism protrudes downward from a lower surface of a tip portion of the sewing machine head case 113*a*. The needle 69*c* is attached to a lower end portion of the needle bar 113*b* in a state of extending downward.

The post portion 112 includes a post case 112*a* forming a contour of the post portion 112, and an internal mechanism accommodated in the post case 112*a*. The internal mechanism is, for example, a mechanism that interlocks the internal mechanism of the sewing machine head portion 113 and the internal mechanism of the bed portion 111. Further, the guide 101 is fixed, via the bracket 103, to a surface that is above the sewing table portion 13*a* and faces the upstream side in the conveying direction X of the fly 1 with respect to the post case 112*a* (the first sewing machine main body 69*a*).

The bracket 103 is constituted by a plurality of components. As illustrated in FIG. 14, the bracket 103 includes a first bracket 104 that is fixed to the post portion 112 of the first sewing machine main body 69*a* in a state of extending toward the upstream side in the conveying direction X in a plan view, and a second bracket 105 that is fixed to a tip portion of the first bracket 104 (an end portion on the upstream side in the conveying direction X) and extends in the direction Y orthogonal to the conveying direction X toward a side immediately above the sewing table portion 13*a* in a plan view.

The first bracket 104 is a metal plate bent to be opened downward. More specifically, as illustrated in FIG. 12, the first bracket 104 includes two fixed plate portions 104*a* and 104*b* disposed in parallel in a state of being separated from each other in the conveying direction X, and a first bracket body portion 104*c* extending in the conveying direction X in a state of connecting upper ends of the two fixed plate portions 104*a* and 104*b*. As illustrated in FIG. 14, the first bracket body portion 104*c* has a shape extending at a right angle in a plan view. More specifically, the first bracket body portion 104*c* includes a first plate portion 104*d* extending in the left-right direction, and a second plate portion 104*e* extending from an end portion of the first plate portion 104*d* on the upstream side toward the sewing table portion 13*a*. Of the two fixed plate portions 104*a* and 104*b*, the fixed plate portion 104*a* on the downstream side is fixed to the post case 112*a* of the first sewing machine main body 69*a*. On the other hand, the second bracket 105 is fixed to the fixed plate portion 104*b* on the upstream side.

As illustrated in FIG. 14, the second bracket 105 is a metal plate bent in an L shape in a plan view. More specifically, the second bracket 105 includes a second bracket body portion 105*a* that is fixed to the fixed plate portion 104*b* of the first bracket 104 on the upstream side and extends in the direction Y orthogonal to the conveying direction X toward an upstream side of the needle plate 111*t*, and a fixed plate portion 105*b* whose end portion on the upstream side in the conveying direction X is connected to a tip end portion (a front end portion) of the second bracket body portion 105*a* in a state of extending in the conveying direction X. The guide 101 is fixed to the fixed plate portion 105*b* of the second bracket 105.

The guide 101 is a rigid body, and is a metal object in the present embodiment. As illustrated in FIGS. 12 and 13, the guide 101 includes a guide block portion 102 that guides the fly 1 to approach the upper surface of the sewing table portion 13*a* and extends in the conveying direction X, and a fixed block portion 107 that extends upward from the guide block portion 102 and is fixed to the bracket 103 (the fixed plate portion 105*b* of the second bracket 105). In the present embodiment, screw-fixing is used for the fixing between the guide 101 and the bracket 103, the fixing between the bracket 103 and the first sewing machine main body 69*a*, the fixing between the conveying direction mark 70 and the first sewing machine main body 69*a*, and the like.

As illustrated in FIG. 13, the fixed block portion 107 is shorter than the guide block portion 102 in the left-right direction and extends upward from a post portion 112 side on an upper surface of the guide block portion 102. Further, as illustrated in FIG. 12, the fixed block portion 107 is shorter than the guide block portion 102 in the forward-rearward direction (the conveying direction X) and extends upward from the upstream side in the conveying direction X on the upper surface of the guide block portion 102.

As illustrated in FIG. 12, the upper surface of the guide block portion 102 is formed by recessing (lowering) a portion thereof on the downstream side in the conveying direction X with respect to the fixed block portion 107 into a stepped shape with respect to a portion thereof on the upstream side in the conveying direction X.

A lower surface of the guide block portion 102 (a lower surface of the guide 101) includes a first guide surface 102*a* that moves downward toward the conveying direction X of the fly 1 (approaches the sewing table portion 13*a*), and a second guide surface 102*b* that is adjacent to the first guide surface 102*a* on the downstream side in the conveying direction X of the fly 1 and is parallel to the upper surface of the sewing table portion 13*a*.

Figure 16:
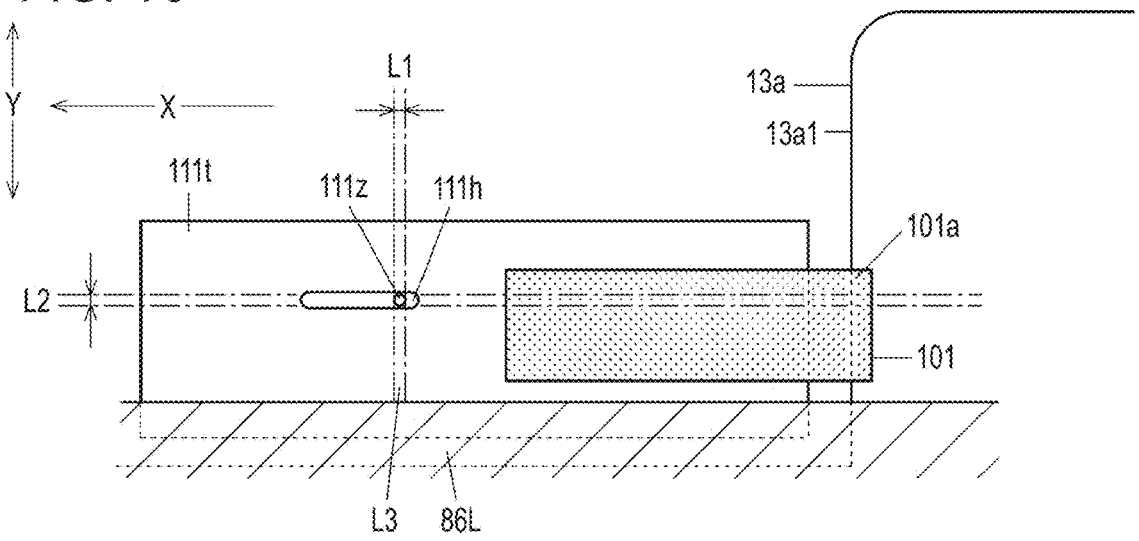
FIG. 16 is an explanatory diagram illustrating a relation between a needle drop position of the first sewing machine and a guide.

Hereinafter, a disposition region 101*a* of the guide 101 in a plan view will be described with reference to FIG. 16. First, a presupposition for specifying the disposition region 101*a* of the guide 101 is as follows.

In the present embodiment, a needle drop region 111*z* on the sewing table portion 13*a* is a region in which the needle 69*c* precisely penetrates the sewing table portion 13*a*. In addition, in the example of FIG. 16, the needle drop region 111*z* has a circular shape. In the present embodiment, the needle hole 111*h* is a thin and long hole that includes the needle drop region 111*z* as a part, and is a long hole that is long in the left-right direction. The needle hole 111*h* is larger than the outer periphery of the needle 69*c* so as not to touch the needle 69*c*, and more specifically, is slightly longer than the needle drop region 111*z* in the forward-rearward direction, and is sufficiently longer than the needle drop region 111*z* in the left-right direction. In addition, since an outer shape of the needle hole 111*h* is a boundary for partitioning a region of the needle hole 111*h* into an inner part and an outer part in a plan view, the needle hole 111*h* becomes the needle hole region 111*h* in the plan view. The needle hole region 111*h* on the sewing table portion 13*a*, that is, the needle hole region 111*h* in the plan view is larger than the needle drop region 111*z*.

In the vicinity of the first sewing machine 69, a conveyance region 86L of the clamp portion 86 is a region parallel to the conveying direction X, and is separated from the needle drop region 111*z* on a side opposite to the post portion 112 of the first sewing machine main body 69*a* in the direction Y orthogonal to the conveying direction X.

Further, two regions are set.

A first reference region L1 is a region that passes through the needle drop region 111*z* in the direction Y orthogonal to the conveying direction X.

A second reference region L2 is a region that passes through the needle drop region 111*z* in the conveying direction X.

A space region L3 is formed between the conveyance region 86L of the clamp portion 86 and the needle drop region 111*z* in the direction Y orthogonal to the conveying direction X of the clamp portion 86. As stated, the space region L3 is a region in which no object exists. The space region L3 is a part of the first reference region L1. In the present embodiment, the space region L3 is formed not only between the conveyance region 86L of the clamp portion 86 and the needle drop region 111*z* but also between the conveyance region 86L of the clamp portion 86 and the needle hole region 111*h*.

Further, the disposition region 101*a* of the guide 101 in the present embodiment is as follows in the plan view. As illustrated in FIG. 16, the disposition region 101*a* of the guide 101 is rectangular, and is shown as a region in which dots are scattered in FIG. 16. The needle hole region 111*h* is disposed on the downstream side in the conveying direction X with respect to the disposition region 101*a* of the guide 101 so as to be separated therefrom. Further, the entire disposition region 101*a* of the guide 101 is disposed on the upstream side in the conveying direction X with respect to the first reference region L1 including the needle drop region 111*z* as a part so as to be separated therefrom. That is, the disposition region 101*a* of the guide 101 is disposed on only the upstream side in the conveying direction X with respect to the first reference region L1. Since the space region L3 is included in the first reference region L1, the disposition region 101*a* of the guide 101 is formed outside the space region L3.

The disposition region 101*a* of the guide 101 and the second reference region L2 partially overlap with each other. More specifically, the second reference region L2 passes through an intermediate portion in the disposition region 101*a* of the guide 101 in the forward-rearward direction (the direction Y orthogonal to the conveying direction X). The disposition region 101*a* of the guide 101 includes a region overlapping with the second reference region L2, a region protruding on a side of the conveyance region 86L of the clamp portion 86 with respect to the second reference region L2, and a region protruding on a side opposite to the conveyance region 86L of the clamp portion 86 with respect to the second reference region L2.

In the plan view, the disposition region 101*a* of the guide 101 satisfies a condition that the disposition region 101*a* is around the needle drop region 111*z* and a condition that the disposition region 101*a* is away from the conveyance region 86L of the clamp portion 86. When the disposition region 101*a* is not around the needle drop region 111*z*, it is not possible to function as the guide 101 that guides the fly 1 immediately below the needle 69*c* at the time of sewing, and a sewing failure is likely to occur. Incidentally, since the clamp portion 86 presses the fly 1 against the sewing table portion 13*a*, the clamp portion 86 serves to suppress the fly 1 from being lifted together with the needle 69*c*. The guide 101 also supplementarily serves to suppress the fly 1 from being lifted together with the needle 69*c*.

When the disposition region 101*a* of the guide 101 and the conveyance region 86L of the clamp portion 86 are not separated from each other, the clamp portion 86 collides with the guide 101.

In order to make the conveyance region 86L of the clamp portion 86 as close as possible to the needle 69*c* (the needle drop region 111*z*), it is desirable that the disposition region 101*a* of the guide 101 is as small as possible in the amount of protrusion on the side of the conveyance region 86L of the clamp portion 86 with respect to the second reference region L2, or that an end of the disposition region 101*a* on the side of the conveyance region 86L of the clamp portion 86 is aligned with the second reference region L2. However, the reason why the guide 101 protrudes on the side of the conveyance region 86L of the clamp portion 86 with respect to the second reference region L2 is to suppress the fly 1 from moving upward and being caught on a side surface of the guide 101 at the time of edge overcasting.

In the guide 101 according to the first embodiment described above, the disposition region 101*a* of the guide 101 satisfies the conditions, and in particular, the space region L3 is formed between the needle hole region 111*h* including the needle drop region 111*z* and the conveyance region 86L of the clamp portion 86, and thus it is possible to make the conveyance region 86L of the clamp portion 86 close to the needle 69*c* while holding a state in which the conveyance region 86L of the clamp portion 86 is away from the disposition region 101*a* of the guide 101. Further, the guide 101 according to the first embodiment satisfies a condition that the disposition region 101*a* of the guide 101 is located only on the upstream side in the conveying direction X with respect to the first reference region L1 or the needle hole region 111*h*, and thus the guide 101 is provided in a narrower range than that of other embodiments to be described later.

Figure 17:
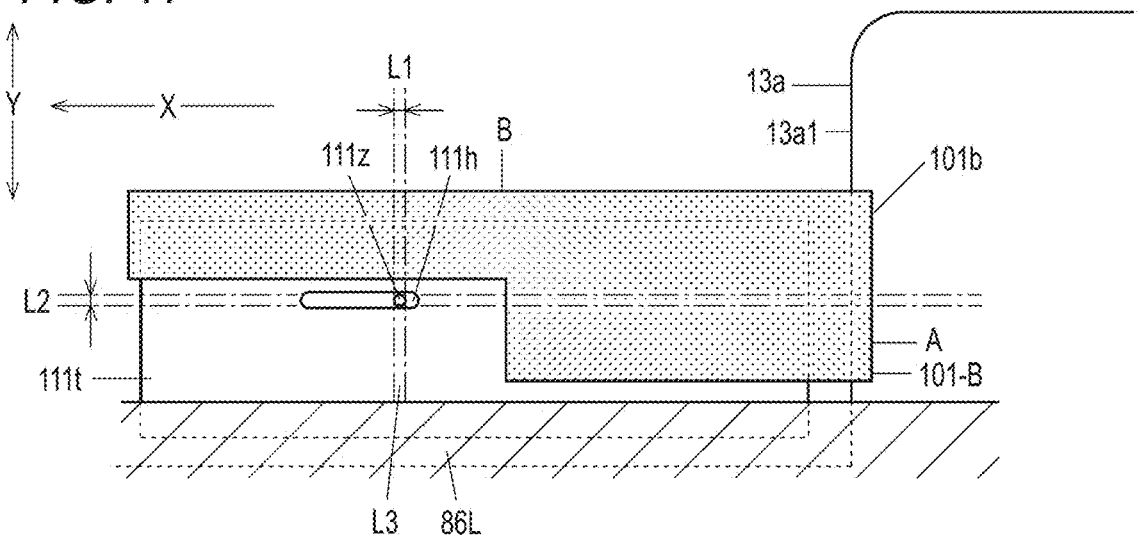
FIG. 17 is an explanatory diagram illustrating a relation between the needle drop position of the first sewing machine and a guide according to a second embodiment.

Regarding a guide 101-B according to a second embodiment, as illustrated in FIG. 17, a disposition region 101*b* of the guide 101-B is wider than the disposition region 101*a* according to the first embodiment.

The disposition region 101*b* of the guide 101-B is L-shaped in a plan view, and is disposed on the upstream side in the conveying direction X and on a side opposite to the conveyance region 86L of the clamp portion 86 with respect to the needle hole region 111*h* including the needle drop region 111*z* so as to be separated therefrom. More specifically, the disposition region 101*b* of the guide 101-B includes a first disposition region A that extends in the direction Y orthogonal to the conveying direction X of the fly 1 at a position separated from the needle hole region 111*h* and the first reference region L1 including the needle drop region 111*z* as a part on the upstream side in the conveying direction X, and a second disposition region B that extends in the conveying direction X in a state of intersecting the first reference region L1 at a right angle on a side opposite to the conveyance region 86L of the clamp portion 86 with respect to the second reference region L2 and the needle hole region 111*h*.

The first disposition region A is the same as the disposition region 101*a* of the guide 101 according to the first embodiment.

The second disposition region B extends over a range between the upstream side and the downstream side in the conveying direction X with respect to the first reference region L1 and the needle hole region 111*h*.

In the guide 101-B according to the second embodiment, the disposition region 101*b* of the guide 101-B includes the first disposition region A, and thus a part (the first disposition region A) of the disposition region 101*b* of the guide 101 is disposed on the upstream side in the conveying direction X with respect to the needle hole region 111*h* and the first reference region L1 including the needle drop region 111*z* as a part so as to be separated therefrom. Similarly to the disposition region 101*a* according to the first embodiment, the disposition region 101*b* of the guide 101-B is formed outside the space region L3. In the plan view, the disposition region 101*b* of the guide 101-B satisfies a condition that the disposition region 101*b* is around the needle drop region 111*z* and a condition that the disposition region 101*b* is away from the conveyance region 86L of the clamp portion 86.

A portion of a lower surface of the guide 101-B according to the second embodiment, which forms the first disposition region A, is the same as the lower surface of the guide 101 according to the first embodiment. That is, a portion of the lower surface on the upstream side in the conveying direction X in the first disposition region A is the first guide surface 102*a* (the surface that moves downward toward the conveying direction X and approaches the sewing table portion 13*a*), and a portion of the lower surface on the downstream side in the conveying direction X in the first disposition region A is the second guide surface 102*b* (the surface parallel to the upper surface of the sewing table portion 13*a*). In addition, regarding a portion of the lower surface of the guide 101-B according to the second embodiment, which forms the second disposition region B, an upstream end portion in the conveying direction X is referred to as the first guide surface 102*a*, and the rest is referred to as the second guide surface 102*b*. The first guide surface 102*a* of the portion forming the second disposition region B and the first guide surface 102*a* of the portion forming the first disposition region A are continuous in the direction Y orthogonal to the conveying direction X.

Further, regarding the lower surface of the guide 101-B according to the second embodiment, a portion on the upstream side in the conveying direction X with respect to the needle drop region 111*z* mainly serves as the guide 101-B that guides the sewn workpieces immediately below the needle 69*c* at the time of sewing, but the rest only serves to suppress the fly 1 from being lifted together with the needle 69*c*.

Figure 18:
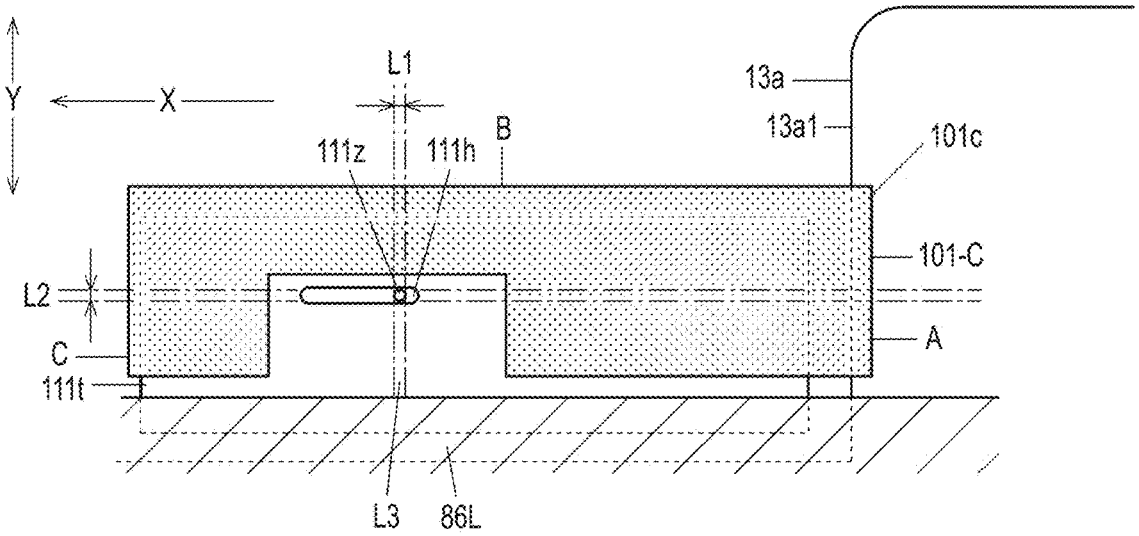
FIG. 18 is an explanatory diagram illustrating a relation between the needle drop position of the first sewing machine and a guide according to a third embodiment.

Regarding a guide 101-C according to a third embodiment of the present invention, as illustrated in FIG. 18, a disposition region 101*c* of the guide 101-C is wider than the disposition region 101*b* according to the second embodiment.

The disposition region 101*c* of the guide 101-C is U-shaped in a plan view, and includes, in addition to the first disposition region A and the second disposition region B described above, a third disposition region C that extends in the direction Y orthogonal to the conveying direction X from a downstream side of the second disposition region B toward the conveyance region 86L of the clamp portion 86 at a position separated from the first reference region L1 and the needle hole region 111*h* on the downstream side in the conveying direction X.

The third disposition region C is disposed to face the first disposition region A with the needle hole region 111*h* as a center. The third disposition region C is also separated from the conveyance region 86L of the clamp portion 86 in the direction Y orthogonal to the conveying direction X.

In the guide 101-C according to the third embodiment, the disposition region 101*c* of the guide 101-C includes the first disposition region A, and thus a part (the first disposition region A) of the disposition region 101*c* of the guide 101 is disposed on the upstream side in the conveying direction X with respect to the needle hole region 111*h* and the first reference region L1 including the needle drop region 111*z* as a part so as to be separated therefrom. The disposition region 101*c* of the guide 101-C is formed outside the space region L3. In the plan view, the disposition region 101*c* of the guide 101-C satisfies a condition that the disposition region 101*c* is around the needle drop region 111*z* and a condition that the disposition region 101*c* is away from the conveyance region 86L of the clamp portion 86.

A portion of a lower surface of the guide 101-C according to the third embodiment, which forms the third disposition region C, is the second guide surface 102*b* (the surface parallel to the upper surface of the sewing table portion 13*a*).

Further, regarding the lower surface of the guide 101-C according to the third embodiment, a portion on the upstream side in the conveying direction X with respect to the needle drop region 111*z* mainly serves as the guide 101-C that guides the sewn workpieces immediately below the needle 69*c* at the time of sewing, but the rest only serves to suppress the fly 1 from being lifted together with the needle 69*c*.

Figure 19:
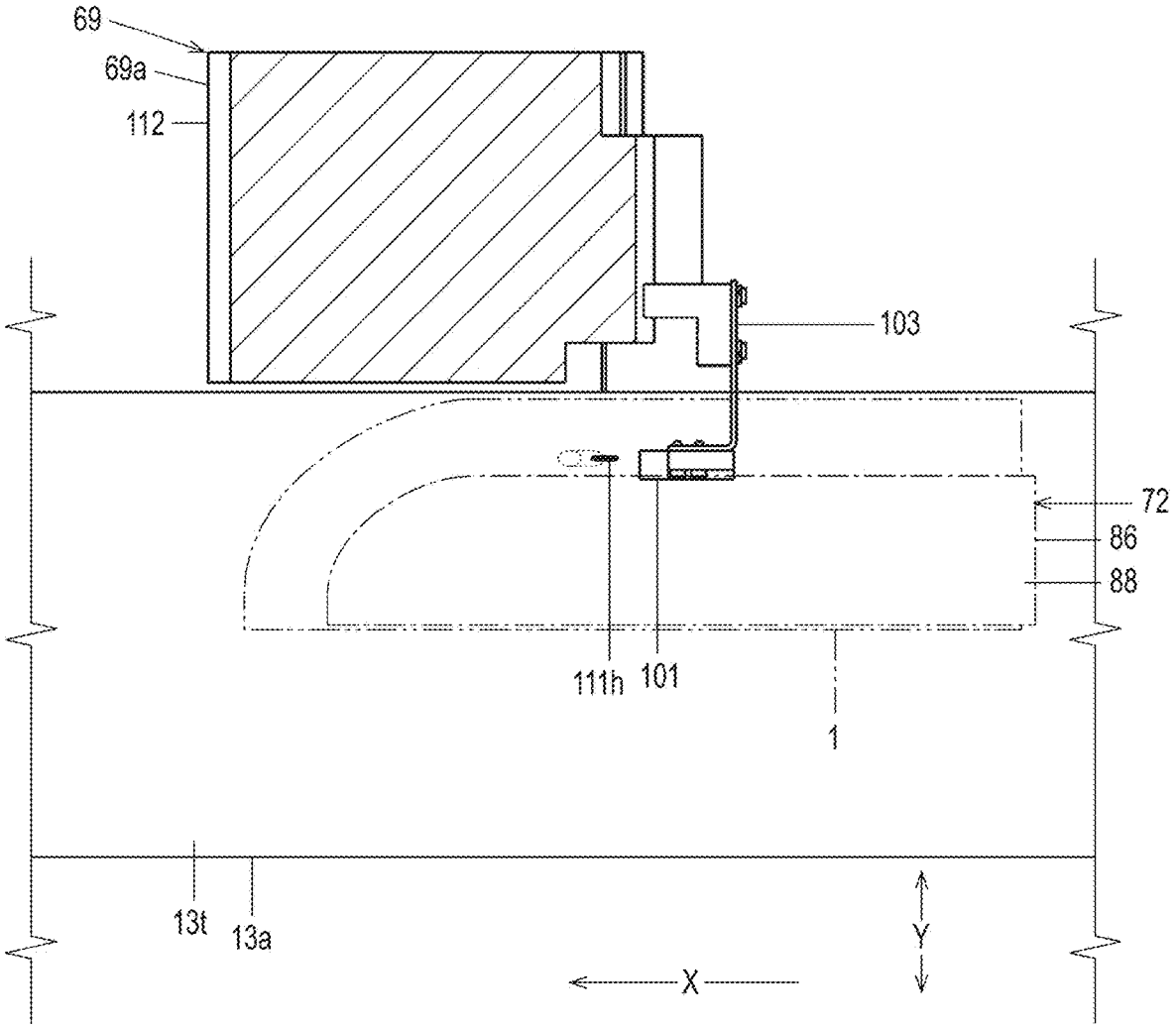
FIG. 19 is a plan view illustrating an example in which a sewing table portion is formed by a single component immediately below the first sewing machine.

A relation between the sewing table portion 13*a*, the first sewing machine 69, and the conveying portion 72 for edge overcasting is not limited to the embodiments described above, and as illustrated in FIG. 19, the relation may be different in details of the sewing table portion 13*a*, the first sewing machine 69, and the conveying portion 72 for edge overcasting. However, also in this case, the disposition region 101*a* of the guide 101 is the same as that of the guide 101 according to the first embodiment.

The sewing table portion 13*a* is constituted by the single conveying table main body 13*t* in the vicinity of the first sewing machine 69. In this case, the needle hole 111*h* is formed in a portion of the conveying table main body 13*t* corresponding to the needle plate.

The first sewing machine 69 does not include the conveying direction mark 70. Since the conveying direction mark 70 is not included, the end of the fly 1 can be sewn closer to a post portion 112 side of the first sewing machine main body 69*a* as compared with the first sewing machine 69 including the conveying direction mark 70.

The clamp portion 86 corresponds to the size of the fly 1, and presses the fly 1 so as to extend on the downstream side in the conveying direction with respect to the rear end (the downstream end in the conveying direction) of the fly 1. Incidentally, a lower portion of the clamp portion 86 may be constituted by only a plate in a case in which the fly 1 is, for example, a single piece of fabric, but in a case in which the fly 1 is obtained by stacking two piece of fabrics in the upward-downward direction, a lower portion may be used that includes a piercing needle piercing the fabrics stacked in the upward-downward direction and a plate allowing the piercing needle to pierce out from a lower surface thereof.

The needle hole 111*h* has a thin and long hole shape in the above embodiments, but may have other shapes represented by a round hole. On the upstream side in the conveying direction with respect to the first sewing machine 69 described above, the second suction hole group 76G sucks and positions the fly 1. The fly is conveyed by the conveying portion 72 for edge overcasting.

In order to perform the edge overcasting on the fly 1 positioned by the second suction hole group 76G, the conveying portion 72 for edge overcasting conveys the fly 1 along the horizontal side 1*a*, the curved side 1*b*, and the vertical side 1*c* while pressing the fly 1. Further, FIG. 14 illustrates a state in which the fly 1 is conveyed along the vertical side 1*c*.

As illustrated in FIG. 15, the conveying portion 72 for edge overcasting includes the clamp portion 86 that presses the fly 1 against a sewing table portion 13*b* as described above, and the clamp conveying portion 72*a* that conveys the clamp portion 86. The clamp conveying portion 72*a* is, for example, a multi-shaft articulated robot. A robot arm 72*b* at a tip end of the articulated robot extends downward, and the clamp portion 86 is fixed to a lower end portion which is a tip end portion of the robot arm 72*b*. The clamp conveying portion 72*a* moves the clamp portion 86 in accordance with a preset procedure, and conveys the clamp portion 86 while pressing the clamp portion 86 onto the sewing table portion 13*a*.

Figure 21:
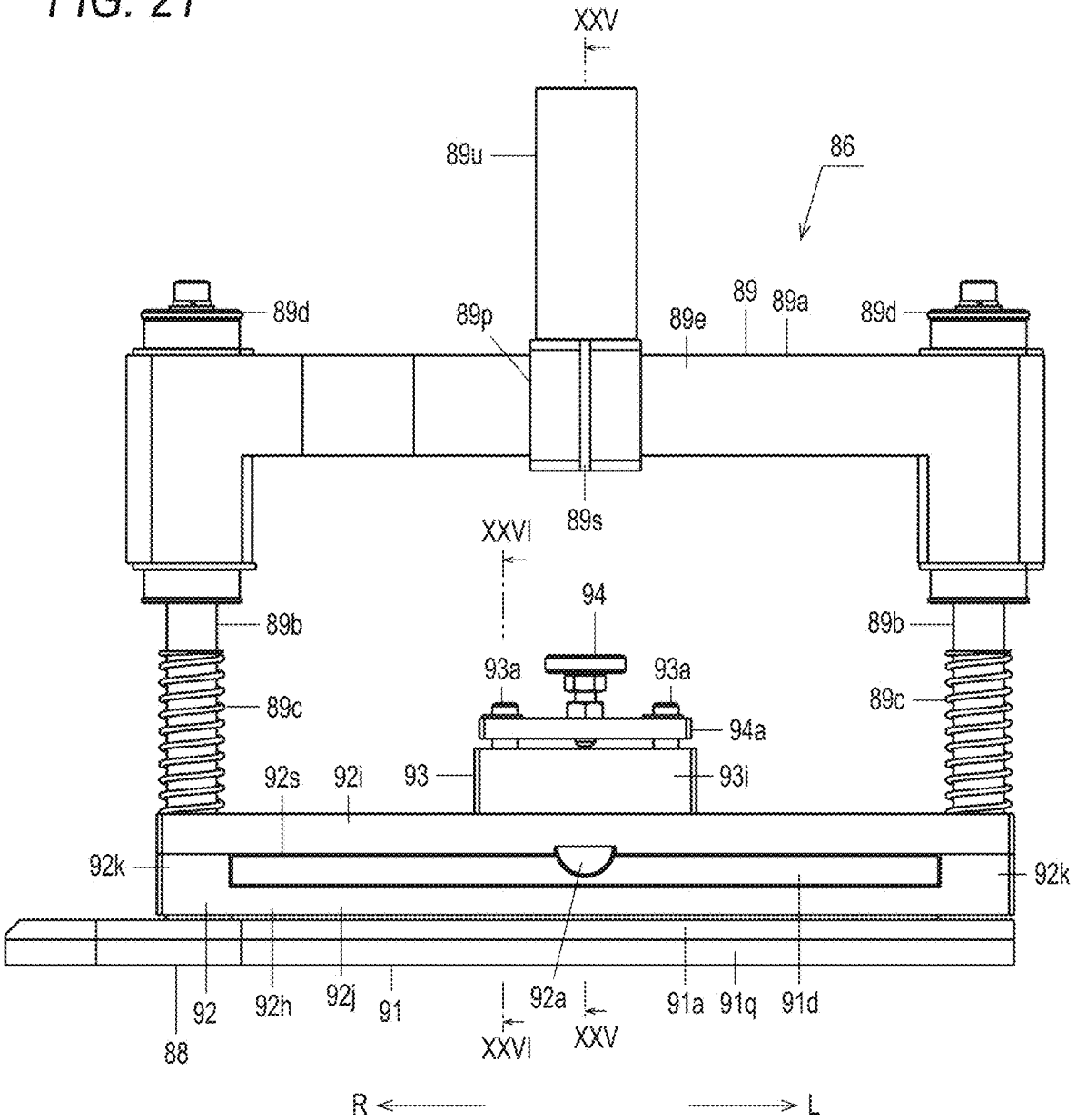
FIG. 21 is a rear view illustrating the clamp portion.

As illustrated in FIGS. 15 and 21, the clamp portion 86 includes a clamp portion main body 88 that presses the fly 1 against the sewing table portion 13*a*, and an impact absorbing portion 89 that connects the clamp portion main body 88 and the tip portion of the robot arm 72*b* and absorbs an impact when the clamp portion main body 88 is pressed against the sewing table portion 13*a* via the fly 1.

In the description of the clamp portion 86, directions are determined as follows.

The upward-downward direction refers to the upward-downward direction in FIG. 21.

The left-right direction and the forward-rearward direction refer to directions with reference to the horizontal.

The forward-rearward direction refers to a direction orthogonal to the paper surface of FIG. 21. The forward direction refers to a direction facing forward. The rearward direction refers to a direction facing backward.

The left-right direction refers to the left-right direction in FIG. 21. It should be noted that FIG. 21 is a rear view. Accordingly, the left direction in FIG. 21 is opposite to the left direction in the plan view of FIG. 22, and the right direction in FIG. 21 is opposite to the right direction in the plan view of FIG. 22. Reference numerals L and R in the figure are described with reference to the plan view of FIG. 22. The left and right directions L and R coincide with reference swing directions to be described later.

Figure 25:
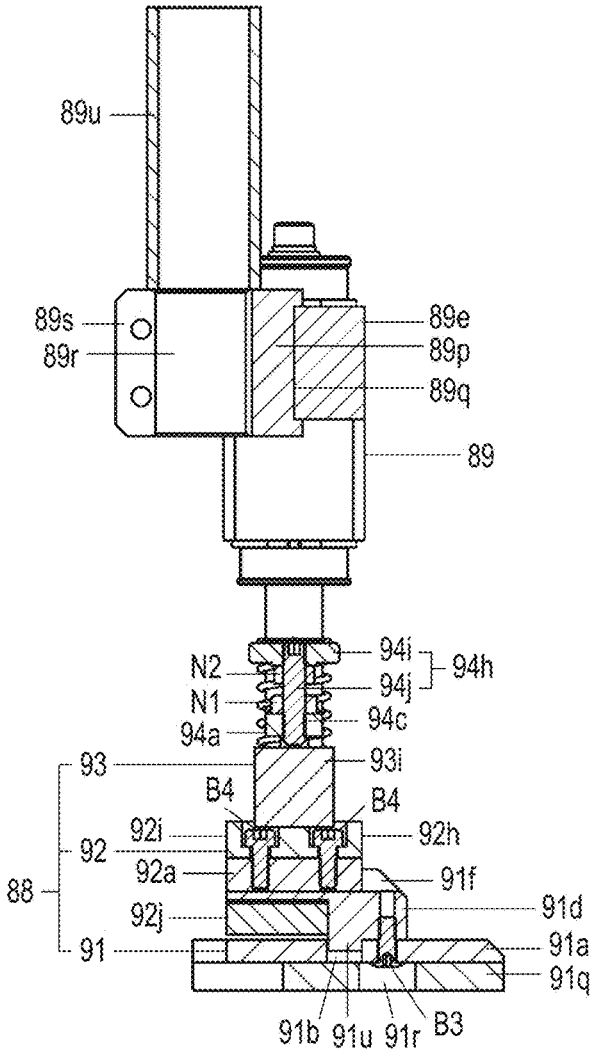
FIG. 25 is a cross-sectional view taken along a line XXV-XXV in FIG. 21.

As illustrated in FIGS. 15, 21, and 25, the clamp portion main body 88 includes a pressing portion 91 that presses the fly 1 against the sewing table portion 13*a*, a support portion 92 that swingably supports the pressing portion 91 in a state of facing the sewing table portion 13*a* with a point as a fixed point, and a presser 93 that presses the pressing portion 91 against the support portion 92 in the downward direction to stabilize an posture of the pressing portion 91.

In a plan view, the pressing portion 91 is supported to be swingable only in two directions with respect to a swing center as the only fixed point. The two directions refer to two directions extending symmetrically on the same straight line from the swing center. Further, the two directions extending symmetrically on the same straight line from the swing center are referred to as the reference swing directions. The reference swing directions L and R according to the present embodiment coincide with the left and right directions. Details of the clamp portion main body 88 will be described after the impact absorbing portion 89.

Figure 22:
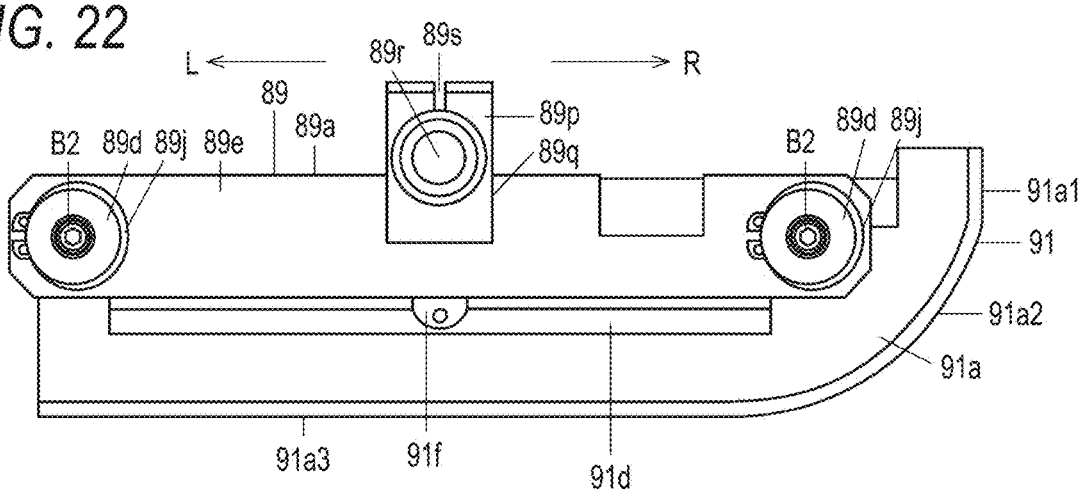
FIG. 22 is a plan view illustrating the clamp portion.
Figure 23:
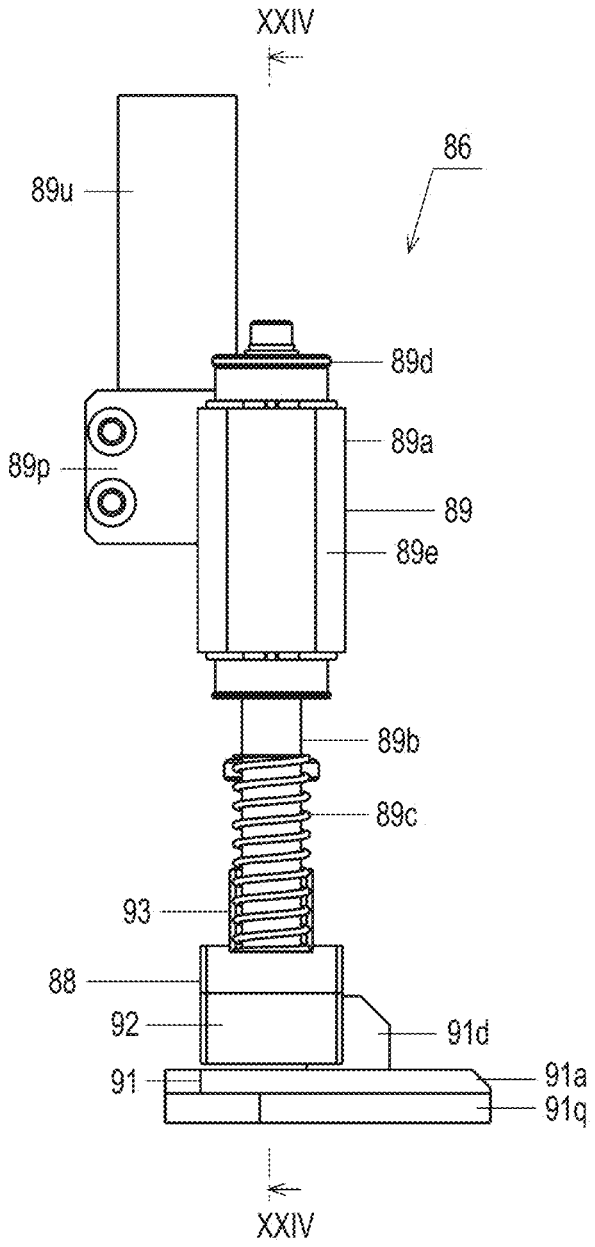
FIG. 23 is a left side view illustrating the clamp portion.

As illustrated in FIGS. 21 to 23, the impact absorbing portion 89 includes a connecting arm 89*a* that extends in a state of facing the sewing table portion 13*a* and is connected to the tip portion of the robot arm 72*b* of the clamp conveying portion 72*a*, a pair of rods 89*b* that are guided to be movable in the upward-downward direction with respect to both end portions of the connecting arm 89*a* extending in the directions L and R, and to which the clamp portion main body 88 is fixed, compression coil springs 89*c* through which the rods 89*b* pass between the connecting arm 89*a* and the clamp portion main body 88, and stoppers 89*d* that support the rods 89*b* in a manner of being suspended from the connecting arm 89*a*. In the present embodiment, the direction in which the connecting arm 89*a* extends is a direction orthogonal to the upward-downward direction, and is aligned with the reference swing directions L and R. Further, it is desirable that the clamp portion 86 is conveyed while the reference swing directions L and R are aligned with (kept parallel to) the conveying direction.

In the connecting arm 89*a*, an intermediate portion in the reference swing directions L and R (the left-right direction) is set as a fixed portion to the tip portion of the robot arm 72*b*, and left and right end portions in the left-right direction are set as guide portions that respectively guide the rods 89*b* to be movable upward and downward.

Figure 24:
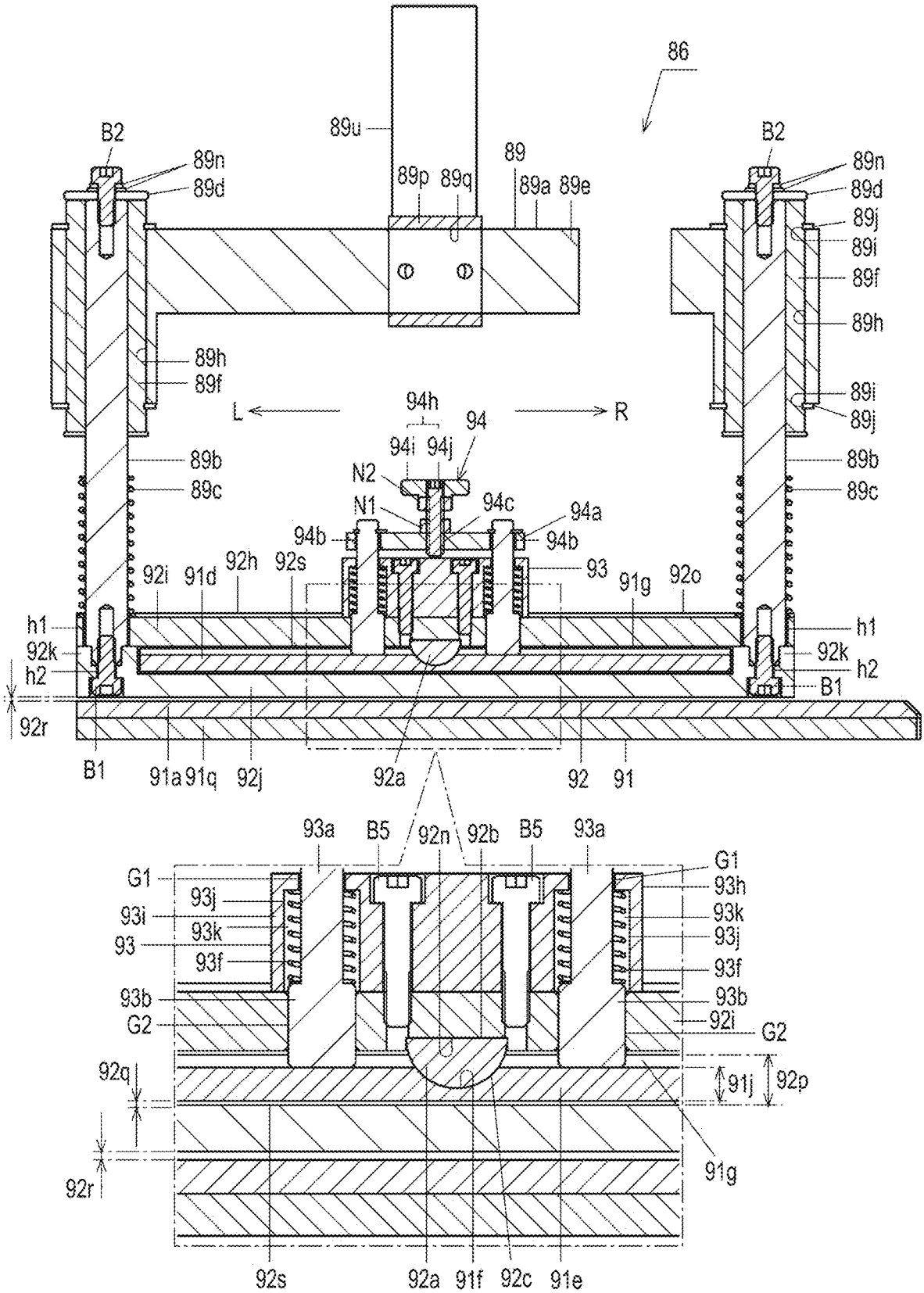
FIG. 24 is a cross-sectional view taken along a line XXIV-XXIV in FIG. 23.

As illustrated in FIG. 24, the guide portions of the connecting arm 89*a* include both left and right end portions of an arm main body 89*e* extending in the reference swing directions L and R (the left and right directions), and guide tubes 89*f* fixed to the left and right end portions of the arm main body 89*e* and guiding the rods 89*b* so as to be movable in the upward-downward direction, respectively.

The arm main body 89*e* has a shape in which the left end portion and the right end portion in the left-right direction protrude downward with respect to a portion therebetween. A through hole 89*h* penetrating in the upward-downward direction is formed in each of the left and right end portions. The guide tube 89*f* is inserted into the through hole 89*h* in a state of protruding in the upward-downward direction. Grooves 89*i* are formed on an outer circumferential surface at upper and lower end portions of the guide tube 89*f* along a circumferential direction thereof, and C-shaped retaining rings 89*j* are fitted into the upper and lower grooves 89*i*. The guide tubes 89*f* are fixed to the arm main body 89*e* by the retaining rings 89*j*.

A lower end portion of each rod 89*b* is fixed to the clamp portion main body 88 by a bolt B1, and an upper portion thereof passes through the guide tube 89*f* of the connecting arm 89*a*. The stopper 89*d* having a larger diameter than that of the rod 89*b* is fixed to an upper end surface of the rod 89*b* by a bolt B2. A washer 89*n* is sandwiched between the stopper 89*d* and a head portion of the bolt B2. An outer side portion of the stopper 89*d* in a radial direction protrudes in a flange shape in the radial direction from the rod 89*b*. Accordingly, the stoppers 89*d* cannot move below an upper surface of the connecting arm 89*a*. The downward movement of the rods 89*b* with respect to the connecting arm 89*a* is regulated by the stoppers 89*d*. A state in which the downward movement of the rods 89*b* is regulated by the stoppers 89*d* is a state in which the clamp portion main body 88 integrated with the rods 89*b* is suspended from the connecting arm 89*a*, and the clamp portion main body 88 cannot move downward but can move upward. The rods 89*b* pass through the inside of the compression coil springs 89*c* between the clamp portion main body 88 and the connecting arm 89*a*.

The compression coil springs 89*c* absorb the impact transmitted from the clamp portion main body 88 and transmit the impact to the connecting arm 89*a*. That is, when the fly 1 is conveyed on the sewing table portion 13*a*, the clamp conveying portion 72*a* is driven to press the clamp portion main body 88 against the sewing table portion 13*a* via the robot arm 72*b*. As a result, the rods 89*b* integrated with the clamp portion main body 88 move upward with respect to the connecting arm 89*a*, the compression coil springs 89*c* contract between the clamp portion main body 88 and the connecting arm 89*a*, and the clamp portion main body 88 presses the fly 1 against the upper surface of the sewing table portion 13*a*. In this way, the fly 1 is conveyed by conveying the clamp portion main body 88 from the upstream side to the downstream side with respect to the first sewing machine 69 in a state of being sandwiched between the sewing table portion 13*a* and the clamp portion main body 88.

On the other hand, as illustrated in FIGS. 21, 23, and 25, the fixed portion of the connecting arm 89*a* includes the intermediate portion in the left-right direction of the arm main body 89*e*, a connecting block 89*p* that is fixed to the intermediate portion of the connecting arm 89*a* and connects the tip portion of the robot arm 72*b*, and a pipe 89*u* that is fixed onto the connecting block 89*p* and into which the robot arm 72*b* is inserted to penetrate therethrough (see FIG. 17).

As illustrated in FIGS. 24 and 25, a groove 89*q* penetrating in the left-right direction is formed in an intermediate portion on a rear surface of the connecting block 89*p* in the upward-downward direction. The intermediate portion of the connecting arm 89*a* in the left-right direction of the arm main body 89*e* is fitted and fixed to the groove 89*q*. Further, as illustrated in FIGS. 22 and 25, the connecting block 89*p* is formed with a through hole 89*r* penetrating in the upward-downward direction at a central portion in a plan view, and is formed with an opening portion 89*s* communicating with the through hole 89*r* in the rear surface. When the connecting block 89*p* is bolted to narrow the opening portion 89*s*, the through hole 89*r* becomes slightly small, and the tip portion of the robot arm 72*b* inserted into the through hole 89*r* through the pipe 89*u* is fastened and connected. That is, the tip portion of the robot arm 72*b* is connected to the connecting block 89*p* by so-called split fastening. The clamp portion main body 88 is connected to such an impact absorbing portion 89.

As illustrated in FIGS. 21, 24, and 25, among the components of the clamp portion main body 88, the pressing portion 91 includes a pressing member 91*a* that presses the fly 1, a swinging member 91*d* that protrudes upward from the pressing member 91*a*, is supported by the support portion 92 to be swingable in the upward-downward direction, and is pressed downward by the presser 93, and an elastically deformable cushion 91*q* fixed to a lower surface of the pressing member 91*a*. In the present embodiment, the pressing member 91*a*, the swinging member 91*d*, and the cushion 91*q* of the pressing portion 91 are separate components, the pressing member 91*a* and the swinging member 91*d* are fixed and integrated by using bolts B3 (see FIG. 25), and the pressing member 91*a* and the cushion 91*q* are integrated with each other by adhesion.

The support portion 92 swingably supports the pressing portion 91 only in the two directions, that is, the reference swing directions L and R. The support portion 92 includes a shaft 92*a* that serves as a center around which the swinging member 91*d* of the pressing portion 91 swings, that is, as a fixed point, and a frame-shaped support frame 92*h* that supports the swinging member 91*d* in a state of allowing the swinging in the upward-downward direction at both ends of the swinging member 91*d* and fixes the shaft 92*a*.

The support frame 92*h* includes an upper frame portion 92*i* that faces the swinging member 91*d* from above, a lower frame portion 92*j* that faces the swinging member 91*d* from below, and a pair of side frame portions 92*k* that face the swinging member 91*d* from the left and right directions (in the reference swing directions L and R). The lower frame portion 92*j* and the pair of side frame portions 92*k* are integrally formed, that is, are formed into one component. The lower frame portion 92*j* and the pair of side frame portions 92*k*, which are formed into one component, are formed such that the pair of side frame portions 92*k* protrude upward from both left and right end portions of the lower frame portion 92*j*.

Left and right end portions of the upper frame portion 92*i* are placed on the pair of side frame portions 92*k*. The support frame 92*h* is formed by fixing the upper frame portion 92*i* and the pair of side frame portions 92*k* with bolts B6 (see FIG. 20). The left and right rods 89*b* of the impact absorbing portion 89 are fixed to an upper surface of the support frame 92*h* in a standing state. More specifically, as illustrated in FIG. 24, through holes h1 penetrating in the upward-downward direction are formed in the left and right end portions of the upper frame portion 92*i* so as to pass through the lower end portions of the left and right rods 89*b*. In the pair of side frame portions 92*k* and the lower frame portion 92*j*, through holes h2 smaller in diameter than the through holes h1 and penetrating in the upward-downward direction are formed at positions corresponding to the through holes h1. Female screw holes (a reference numeral thereof is omitted) are formed in lower surfaces of the left and right rods 89*b*. By screwing the bolts B1 into the female screw holes of the rods 89*b* from the through holes h2 formed in the pair of side frame portions 92*k* and the lower frame portion 92*j*, the periphery of each through hole h2 is sandwiched between a head portion of the corresponding bolt B1 and the corresponding rod 89*b*, and the left and right rods 89*b* and the support frame 92*h* are fixed. A lower portion of each through hole h2 is formed to have a larger diameter than an upper portion above the lower portion, and accommodates a head portion of the corresponding bolt B2. The support frame 92*h* is a rectangular frame penetrating in the forward-rearward direction. A space portion 92*s* that allows the swinging member 91*d* to swing is formed inside the support frame 92*h*. In addition, the shaft 92*a* serving as the swing center, that is, the fixed point of the swinging member 91*d* (the pressing portion 91) is fixed inside the support frame 92*h*. Since the support frame 92*h* is a rectangular frame penetrating in the forward-rearward direction as described above, the space portion penetrating in the forward-rearward direction is formed inside the support frame 92*h*. An upper surface of the space portion corresponds to the upper surface of the support frame 92*h*, more specifically, corresponds to a lower surface of the upper frame portion 92*i*. The shaft 92*a* is fixed to the lower surface of the upper frame portion 92*i*.

As illustrated in FIG. 24, the shaft 92*a* is a rod having an end surface formed in a semicircular shape. More specifically, the shaft 92*a* includes the elongated flat upper surface 92*b* fixed to an upper surface 92*b* of the shaft 92*a* and the lower surface (the upper surface inside the support frame 92*h*) of the upper frame portion 92*i*, and the lower surface 92*c* curved in a semi-cylindrical surface shape as a lower surface 92*c* of the shaft 92*a* and a surface to which the swinging member 91*d* is fitted.

The shaft 92*a* is fixed to the lower surface of the upper frame portion 92*i*. More specifically, an upper portion of the shaft 92*a* is positioned and fixed to an intermediate portion of the lower surface of the upper frame portion 92*i* in the left-right direction. A groove 92*n* into which the upper portion of the shaft 92*a* is fitted is formed in the intermediate portion of the lower surface of the upper frame portion 92*i* in the left-right direction. The shaft 92*a* fitted into the groove 92*n* and the upper frame portion 92*i* are fixed by bolts B4 as illustrated in FIG. 25.

Figure 26:
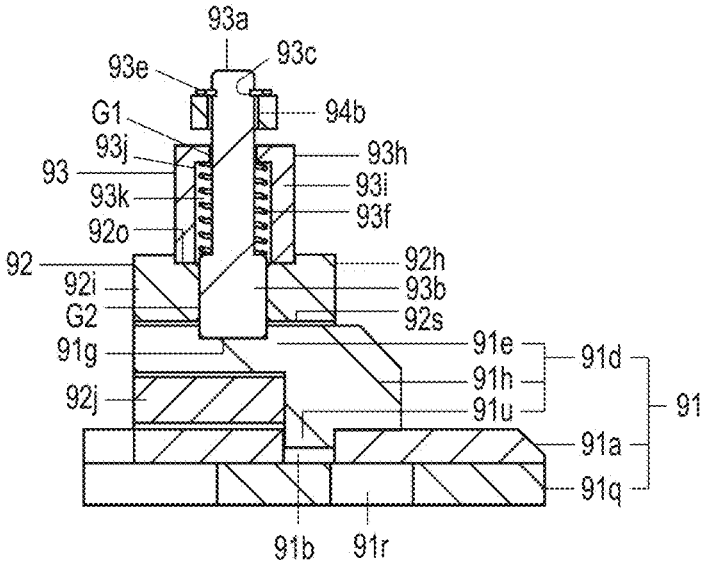
FIG. 26 is a cross-sectional view taken along a line XXVI-XXVI in FIG. 21.

The swinging member 91*d* has an elongated rectangular shape in a plan view and a front view, and has an L shape in a side view as illustrated in FIG. 26. More specifically, the swinging member 91*d* includes a swinging member main body portion 91*e* that is swingably supported by the support frame 92*h* via the shaft 92*a* and extends in the left-right direction, and a fixed portion 91*h* that extends downward from a rear portion of the swinging member main body portion 91*e* and to which the pressing member 91*a* is fixed.

As illustrated in FIGS. 24 and 25, the swinging member main body portion 91*e* includes a bearing 91*f* that supports the shaft 92*a* at an intermediate portion of an upper surface in the reference swing directions L and R (the left-right direction). The bearing 91*f* refers to the fitting groove 91*f* that is recessed on the upper surface of the swinging member main body portion 91*e* and into which a lower portion of the shaft 92*a* is fitted. The fitting groove 91*f* extends in a longitudinal direction (the forward-rearward direction) of the shaft 92*a*, and is a curved surface that has an arc shape smaller than a semicircle when viewed from the longitudinal direction of the shaft 92*a*.

FIG. 24 illustrates a state in which the clamp portion 86 is pressed against the sewing table portion 13*a* from above the fly 1. In this state, the fitting groove 91*f* of the swinging member main body portion 91*e* is fitted to the shaft 92*a*, and the swinging member main body portion 91*e* is horizontally supported to be swingable with respect to the shaft 92*a*. That is, FIG. 24 illustrates a state in which the swinging member 91*d* is supported by a lower surface of the shaft 92*a* inside the support frame 92*h*.

A thickness 91*j* of the swinging member main body portion 91*e* in the upward-downward direction is smaller than an interval 92*p* of the space portion 92*s* inside the support frame 92*h* in the upward-downward direction. In addition, in the state in which the swinging member 91*d* is supported by the lower surface of the shaft 92*a* inside the support frame 92*h*, an interval 92*q* allowing the swinging is formed immediately below the shaft 92*a* and between a lower surface (an upper surface of the lower frame portion 92*j*) inside the support frame 92*h* and a lower surface of the swinging member main body portion 91*e* of the swinging member 91*d*. In addition, in the state in which the swinging member 91*d* is supported by the lower surface of the shaft 92*a* in this way, portions of the space portion 92*s* on both left and right sides with respect to the shaft 92*a* are positioned above the swinging member main body portion 91*e* fitted to the shaft 92*a*. In this way, the swinging member main body portion 91*e* is allowed to swing inside the support frame 92*h*. Accordingly, the swinging member 91*d* including the swinging member main body portion 91*e* can swing around the shaft 92*a*, and left and right ends of the swinging member main body portion 91*e* serve as swing ends displaceable in the upward-downward direction. In addition, in the state in which the swinging member 91*d* is supported by the lower surface of the shaft 92*a* inside the support frame 92*h*, an interval 92*r* is also formed between a lower surface of the lower frame portion 92*j* of the support frame 92*h* and an upper surface of the pressing member 91*a*. In this way, the pressing member 91*a* is swingably supported by the support frame 92*h*.

As illustrated in FIG. 26, the swinging member 91*d* includes a protruding block 91*u* protruding from a front portion of the lower surface of the fixed portion 91*h* in addition to the swinging member main body portion 91*e* and the fixed portion 91*h*. The protruding block 91*u* is positioned at the front portion of the fixed portion 91*h* and is formed over the entire length of the fixed portion 91*h* in the left-right direction. The pressing member 91*a* is fitted to the protruding block 91*u*.

The pressing member 91*a* has a flat plate shape. A fitting hole 91*b* into which the protruding block 91*u* is fitted is formed in the upper surface of the pressing member 91*a*. The fitting hole 91*b* is a long hole that penetrates in the upward-downward direction and is long in the left-right direction. As illustrated in FIG. 22, in a plan view, the pressing member 91*a* has a shape that is similar to that of a portion of the fly 1 to be subjected to the edge overcasting before the edge overcasting, and that includes a short side 91*a*1 and a long side 91*a*3 extending in directions orthogonal to each other, and a curved side 91*a*2 smoothly joining the short side 91*a*1 and the long side 91*a*3.

Figure 20:
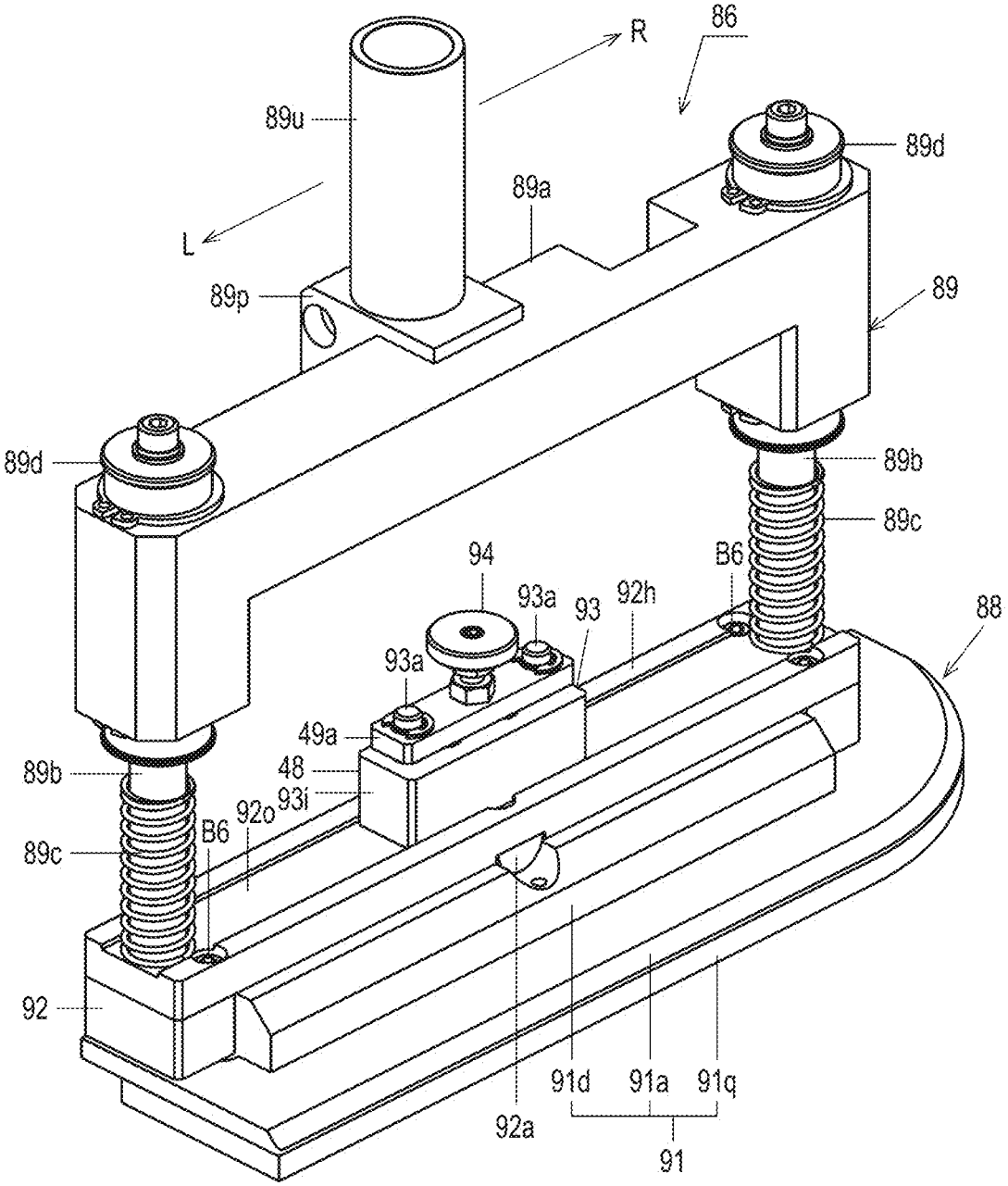
FIG. 20 is a perspective view illustrating a clamp portion according to the first embodiment of a conveying portion for edge overcasting as viewed from an oblique front-upper side.

The cushion 91*q* has a plate shape. As illustrated in FIG. 26, the cushion 91*q* is formed with through holes 91*r* penetrating in the upward-downward direction. Each through hole 91*r* is a long hole that is thin in the left-right direction. Further, as illustrated in FIG. 25, a head portion of the corresponding bolt B3 that fixes the pressing member 91*a* to the swinging member 91*d* is accommodated in the through hole 91*r*. As illustrated in FIGS. 20, 21, and 23, the length of the cushion 91*q* in the left-right direction is equal to that of the pressing member 91*a*, and the length thereof in the forward-rearward direction is shorter than that of the pressing member 91*a*. Incidentally, in the state in which the cushion 91*q* and the pressing member 91*a* are integrated, the cushion 91*q* and the pressing member 91*a* are aligned with each other with regard to a rear end, and the cushion 91*q* is positioned behind the pressing member 91*a* with respect to a front end. The cushion 91*q* is made of a material elastically deformable in a thickness direction.

The presser 93 includes a pair of pressing pins 93*a* that press the pressing portion 91 downward from both sides in the reference swing directions L and R with respect to the swing center (the shaft 92*a*) as an intermediate portion of the pressing portion 91 in the reference swing directions L and R. More specifically, as illustrated in FIG. 24, the presser 93 includes the pair of pressing pins 93*a* that press the swinging member 91*d* from above, protrude downward of the upper frame portion 92*i*, and are disposed in the left and right directions (the reference swing directions L and R) with respect to the shaft 92*a*, the compression coil springs 93*f* serving as a pair of elastic members 93*f* that press the pressing pins 93*a* downward and are elastically deformable in the upward-downward direction, a guide block portion 93*h* that accommodates the pair of compression coil springs 93*f* and guides the pair of pressing pins 93*a* so as to be movable in the upward-downward direction, and an adjusting portion 94 that adjusts a downward pressing force of the pair of compression coil springs 93*f*.

The guide block portion 93*h* includes a guide block main body 93*i* that protrudes upward with respect to the upper frame portion 92*i* and accommodates the compression coil springs 93*f*, and a part of the upper frame portion 92*i*.

The guide block main body 93*i* has a rectangular parallelepiped shape. The guide block main body 93*i* is placed at an intermediate portion of an upper surface of the upper frame portion 92*i* in the left-right direction, and is fixed to the upper frame portion 92*i* by bolts B5. The bolts B5 are disposed in the left-right direction with respect to the shaft 92*a*. Incidentally, as illustrated in FIGS. 20 and 26, the upper surface of the upper frame portion 92*i* is formed with a groove 92*o* extending in the left-right direction at an intermediate portion in the forward-rearward direction, and the guide block main body 93*i* is fitted into the groove 92*o* in a state of being positioned in the forward-rearward direction.

In the present embodiment, the guide block main body 93*i* cooperates with the upper frame portion 92*i* to guide the pressing pins 93*a* to be movable upward and downward. Through holes 93*j* through which the pressing pins 93*a* penetrate in the upward-downward direction are formed in a left end portion and a right end portion of the guide block main body 93*i*. The through holes 93*j* are guide holes G1 in which a portion on an upper surface side is smaller in diameter than a portion on a lower surface side. The diameter of each guide hole G1 is formed to be slightly larger than a diameter of a corresponding portion of the corresponding pressing pin 93*a*, and guides an upper portion of the corresponding pressing pin 93*a* to be movable upward and downward. The portion on the lower surface side of the through hole 93*j* serves as an accommodating hole 93*k* that is formed to be larger in diameter than the corresponding compression coil spring 93*f* through which the pressing pin 93*a* is passed, and that accommodates the compression coil spring 93*f*.)

The upper frame portion 92*i* is formed with guide holes G2 for guiding lower portions 93*b* of the pressing pins 93*a* to be movable in the upward-downward direction. The guide holes G2 penetrate the upper frame portion 92*i* in the upward-downward direction at positions separated in the left-right direction with respect to the groove 92*n* into which the shaft 92*a* is fitted. Each guide hole G2 is formed to be slightly larger than the diameter of the corresponding lower portion 93*b* of the corresponding pressing pin 93*a*, and guides the lower portion 93*b* of the pressing pin 93*a* to be movable upward and downward.

The pressing pin 93*a* is a cylindrical rod extending in the upward-downward direction. The lower portion 93*b* of the pressing pin 93*a* is guided into the corresponding guide hole G2 of the upper frame portion 92*i* as described above. A lower end portion of the pressing pin 93*a* protrudes downward of the upper frame portion 92*i* and is pressed against the upper surface of the swinging member main body portion 91*e*. In addition, a positioning recess 91*g* in which the lower end portions of the pressing pins 93*a* are positioned and accommodated in the forward-rearward direction is formed in the upper surface of the swinging member main body portion 91*e*. The positioning recess 91*g* is a groove extending in the left-right direction on the upper surface of the swinging member main body portion 91*e*. Further, the positioning recess 91*g* and the lower end portions of the pressing pins 93*a* cooperate with each other to serve as a positioning portion that regulates the swinging member 91*d* so as not to be movable in the forward-rearward direction with respect to the support frame 92*h*. In addition, the positioning portion suppresses the swinging member 91*d* from being detached from the support frame 92*h*.

The lower portion 93*b* of each pressing pin 93*a* serves as the large-diameter portion 93*b* wider than the upper portion above the lower portion 93*b*. The compression coil springs 93*f* as the elastic members 93*f* are placed on upper surfaces of the large-diameter portions 93*b* of the pressing pins 93*a*.

Each compression coil spring 93*f* is accommodated in the corresponding through hole 93*j* of the guide block main body 93*i* in a state of passing through the intermediate portion of the corresponding pressing pin 93*a* in the upward-downward direction and surrounding the periphery of the intermediate portion of the pressing pin 93*a*. Further, an upper surface of the compression coil spring 93*f* is pressed against an upper surface of the accommodating hole 93*k* of the guide block main body 93*i*, the compression coil spring 93*f* contracts, the lower end portion of the pressing pin 93*a* protrudes downward with respect to the lower surface of the upper frame portion 92*i* and enters the space portion 92*s* of the support frame 92*h*, and the upper surface of the swinging member 91*d* (the swinging member main body portion 91*e*) is pressed downward. The adjusting portion 94 adjusts a contraction amount of the compression coil springs 93*f*.

As illustrated in FIG. 24, the adjusting portion 94 includes a pin holding plate 94*a* that holds the upper portions of the pressing pins 93*a* above the guide block main body 93*i*, and an adjustment knob 94*h* that adjusts a vertical interval between the pin holding plate 94*a* and the guide block main body 93*i*.

The pin holding plate 94*a* extends horizontally in the left-right direction. Through holes 94*b* through which the upper portions of the pressing pins 93*a* are passed are formed on left and right sides of the pin holding plate 94*a*. As illustrated in FIG. 26, a groove 93*c* is formed along a circumferential direction on an upper side of the corresponding pressing pin 93*a* passed through the corresponding through hole 94*b*. A C-shaped retaining ring 93*e* is fitted into the groove 93*c*, and the pin holding plate 94*a* is suppressed from being detached upward from the pressing pin 93*a* by the retaining ring 93*e*. In addition, as illustrated in FIGS. 24 and 25, a female screw hole 94*c* penetrating in the upward-downward direction is formed in an intermediate portion of the pin holding plate 94*a* in the left-right direction.

The adjustment knob 94*h* includes a disc-shaped knob portion 94*i* and a male screw portion 94*j* extending downward from a disc center of the knob portion 94*i*. Incidentally, a female screw hole (a reference numeral thereof is omitted) is formed to penetrate in the upward-downward direction at the center of the knob portion 94*i*, and the male screw portion 94*j* is screwed into the female screw hole.

A lower portion of the male screw portion 94*j* is screwed into the female screw hole 94*c* formed in the intermediate portion of the pin holding plate 94*a* in the left-right direction. In addition, a lower end portion of the male screw portion 94*j* protrudes downward with respect to the pin holding plate 94*a*, and the lower end thereof is pressed against an upper surface of the guide block main body 93*i*. By adjusting an amount by which the male screw portion 94*j* protrudes downward from the pin holding plate 94*a*, the vertical interval between the guide block main body 93*i* and the pin holding plate 94*a* is adjusted, and the contraction amount of the compression coil springs 93*f*, that is, the pressing force to the pressing pins 93*a* obtained by the elastic members 93*f* is adjusted. Incidentally, a nut N1 is screwed to the male screw portion 94*j* in a state of being pressed against an upper surface of the pin holding plate 94*a*, and a protruding amount of the male screw portion 94*j* is fixed. Another nut N2 is screwed in a state of being pressed against a lower surface of the knob portion 94*i*, and the male screw portion 94*j* is fixed to the knob portion 94*i*.

A conveyance operation for the edge overcasting is an operation in which the clamp conveying portion 72*a* is driven to press the clamp portion 86 on the sewing table portion 13*a*. Accordingly, the support portion 92 slightly moves downward with respect to the pressing portion 91, the fitting groove 91*f* as the bearing 91*f* and the shaft 92*a* are fitted to each other, and the pressing portion 91 is in a swingable state with the bearing 91*f* and the shaft 92*a* as the swing center. Further, by a force of pressing the clamp portion 86 against the sewing table portion 13*a*, the connecting arm 89*a* moves downward together with the guide tubes 89*f* along the rods 89*b* on the support portion 92, and the compression coil springs 89*c* of the impact absorbing portion 89 contract between the guide tubes 89*f* and the support portion 92 to absorb the impact when the clamp portion 86 is pressed. Then, the clamp conveying portion 72*a* conveys the clamp portion 86 toward the first sewing machine 69. The corner of the fly 1 is cut by a cutter (not shown) near the first sewing machine 69 during the conveyance, and the fly 1 is sewn by the first sewing machine 69.

The fly 1 is subjected to the edge overcasting along the horizontal side 1*a*, then the corner is cut to form the curved side 3*b*, and then the curved side 3*b* is subjected to the edge overcasting, and the fly 1 is subjected to the edge overcasting along the vertical side 3*c*.

In a case in which the clamp portion 86 of the conveying portion 72 for edge overcasting according to the first embodiment is conveyed by aligning the directions (the reference swing directions L and R) in which the pressing portion 91 swings with respect to the fixed portion (the shaft 92*a*) with the conveying direction after pressing the fly 1 on the sewing table portion 13*a* by the pressing portion 91, even when the upper surface of the sewing table portion 13*a* has a step in the conveying direction, the pressing portion 91 becomes an posture corresponding to a state of the upper surface of the sewing table portion 13*a*, the corresponding posture is stabilized by a downward pressing force of the presser 93, and thus a pressing state with respect to the fly 1 is stabilized. In particular, while the clamp portion 86 is being conveyed near the first sewing machine 69, the clamp portion 86 is pressed against substantially the same plane of the sewing table portion 13*a* via the fly 1.

That is, the clamp portion 86 is conveyed by being sequentially pressed against the conveying table main body 13*t* of the sewing table portion 13*a*, the needle plate 111*t*, and the lower plate portion 70*b* of the conveying direction mark 70 via the fly 1. Even though there are slight steps in the conveying table main body 13*t*, the needle plate 111*t*, and the lower plate portion 70*b*, the pressing portion 91 swings around the shaft 92*a* to eliminate the steps, and thus the pressing state with respect to the fly 1 is stabilized.

In addition, in the clamp portion 86 of the conveying portion 72 for edge overcasting according to the first embodiment, the pair of pressing pins 93*a* and the pair of compression coil springs 93*f* of the presser 93 are disposed on the left and right directions (both the reference swing directions L and R) with the shaft 92*a* as a center, the presser 93 presses the pressing portion 91 downward from both the left and right directions with the shaft 92*a* as a center, and thus the posture of the pressing portion 91 (the pressing state with respect to the fly 1) is stabilized as compared to, for example, a case in which the presser 93 presses the pressing portion 91 downward from one of the left and right directions with the shaft 92*a* as a center.

In addition, in the clamp portion 86 of the conveying portion 72 for edge overcasting according to the first embodiment, a downward pressing force of the pair of pressing pins 93*a* (the contraction amount of the compression coil springs 93*f*) is adjusted only by rotating the single adjustment knob 94*h*, and thus the pressing force is easily adjusted.

Figure 27A:
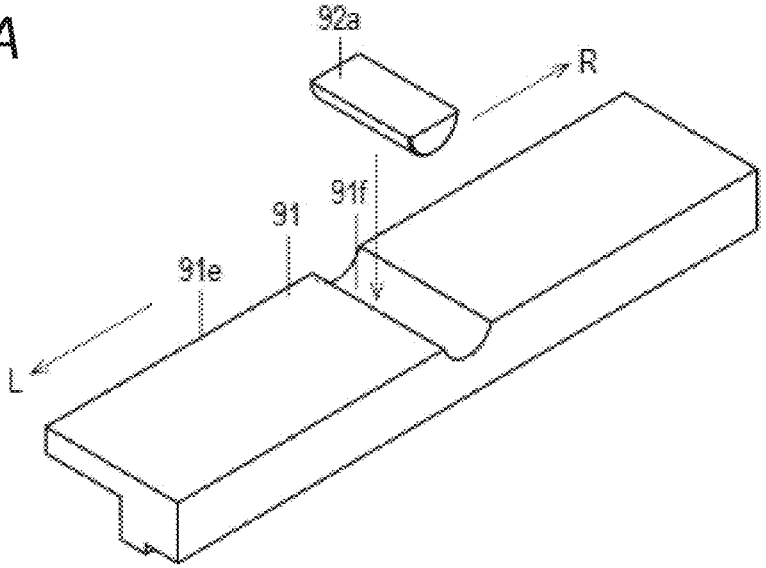
FIGS. 27A to 27C are explanatory diagrams each illustrating a swing structure of the clamp portion.
Figure 27B:
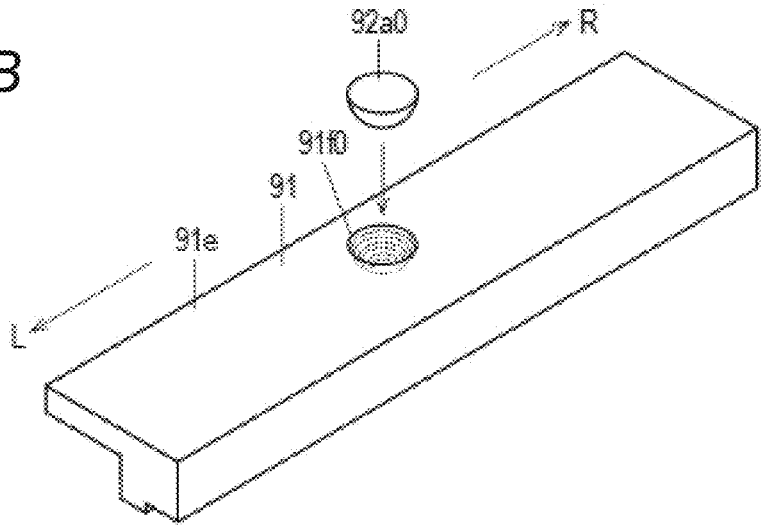
Figure 27C:
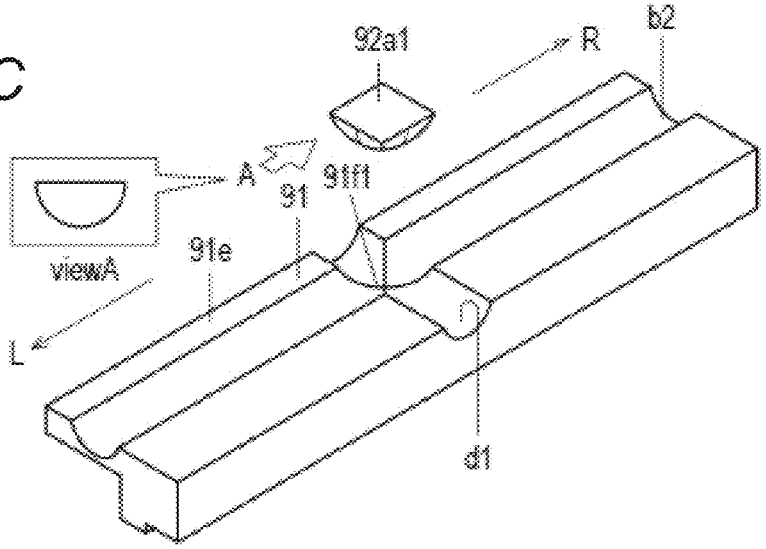

In the clamp portion 86 according to the first embodiment, although the swing directions of the pressing portion 91 in the plan view are only the two directions, that is, the reference swing directions L and R with respect to the swing center of the pressing portion 91 as illustrated in FIG. 27A, the swing directions may be all directions with respect to the swing center of the pressing portion 91 as illustrated in a modification according to FIG. 27B, and may be only four directions including the reference swing directions L and R and directions orthogonal to the reference swing directions L and R with respect to the swing center of the pressing portion 91 as illustrated in a modification according to FIG. 27C. More details are as follows. In the first embodiment, although the positioning recess 91*g* is originally formed in the upper surface of the swinging member main body portion 91*e*, the positioning recess 91*g* is omitted in FIG. 27A, and thus a fitting structure between the shaft 92*a* and the bearing 91*f* related to the swing of the pressing portion 91 is illustrated in an easy-to-understand manner. The same applies to FIGS. 27B and C.

In the first embodiment illustrated in FIG. 27A, the shaft 92*a* has a semicircular shape when viewed from the forward-rearward direction, the upper surface thereof has an elongated flat surface shape, and the lower surface thereof has a curved surface having a semi-cylindrical surface shape. On the other hand, the bearing 91*f* is formed as the fitting groove that is recessed with respect to the upper surface of the pressing portion 91 (the swinging member main body portion 91*e*) and extends in the forward-rearward direction, and has a curved surface that is an arc shape and is smaller than the semicircular shape of the shaft 92*a* when viewed in the forward-rearward direction. In addition, in the first embodiment, the pressing portion 91 can swing only in the left-right direction with the shaft 92*a* and the bearing 91*f* as the swing center in the plan view. As described above, the reference swing directions refer to the two directions symmetrically extending on the same straight line from the swing center. In the first embodiment, the swinging directions include only the left and right directions, and therefore the reference swing directions L and R are the left and right directions.

In the modification illustrated in FIG. 27B, a shaft 92*a*0 has a circular upper surface and a hemispherical lower surface. On the other hand, a bearing 91*f*0 is a hemispherical hole smaller than the hemisphere. In addition, in the modification illustrated in FIG. 27B, the pressing portion 91 can swing in all directions with the shaft 92*a*0 and the bearing 91*f*0 as the swing center in the plan view.

Since the pressing portion 91 can swing in all directions, there are numerous directions as the two directions symmetrically extending on the same straight line from the swing center. In this case, the reference swing directions L and R may be any two directions among the numerous directions. For convenience, in the modification illustrated in FIG. 27B, a straight line connecting the pair of rods (not shown) in the plan view is the same straight line that serves as a basis for determining the reference swing directions, and thus the reference swing directions L and R are set to the left and right directions.

In addition, since the pressing portion 91 can swing in all directions, in the modification illustrated in FIG. 27B, when the conveying portion 72 for edge overcasting conveys the fly 1 while pressing the fly 1 against the sewing table portion 13*a*, even in a state in which the upper surface of the sewing table portion 13*a* has steps in different directions, not limited to the same direction with respect to the conveying direction X, the pressing portion 91 becomes an posture corresponding to the state of the upper surface of the sewing table portion 13*a*, and the pressing state with respect to the fly 1 is stabilized.

In the modification illustrated in FIG. 27C, a shaft 92*al* has a square upper surface. A lower surface of the shaft 92*al* is formed with four surfaces, that is, front, rear, left, and right surfaces, and each of the four surfaces is formed to be seen as a semicircular shape only when viewed in corresponding one direction among the four directions, and each of the four surfaces is set to a curved surface linearly extending in a direction orthogonal to the corresponding one direction among the forward, rearward, left, and right directions. In other words, in order to be seen as the semicircular shape swelling downward only when viewed in the left-right direction and the forward-rearward direction, the shaft 92*al* has a shape obtained by moving a cutter, which has a semicircular cut surface, in the left-right direction and the forward-rearward direction to cut left, right, front, and rear surfaces among six surfaces, that is, an upper surface, a lower surface, the left surface, the right surface, the front surface, and the rear surface of a regular hexahedron.

On the other hand, a bearing 91*f*1 is a hole corresponding to an intersection portion of a vertical groove d1 and a horizontal groove d2 extending to be orthogonal to the forward-rearward and left-right directions, respectively, and each of the vertical groove d1 and the horizontal groove d2 is formed in an arc shape that is smaller than the semicircular shape when viewed from the forward-rearward direction or the left-right direction in which the corresponding groove extends. More specifically, the vertical groove d1 is set to extend in the forward-rearward direction, and the horizontal groove d2 is set to extend in the left-right direction. The vertical groove d1 viewed in the forward-rearward direction and the horizontal groove d2 viewed in the left-right direction have the same arc shape smaller than the semicircular shape swelling downward. Further, the intersection portion between the vertical groove d1 and the horizontal groove d2 is a hole serving as the bearing 91*f*1, and has a complicated shape.

In the modification illustrated in FIG. 27C, in the plan view, the pressing portion 91, can swing only in the directions in which the vertical groove d1 and the horizontal groove d2 extend with the shaft 92*al* and the bearing 91*f*1 as the swing center, that is, in the four directions in the forward-rearward direction and the left-right direction, in other words, the four orthogonal directions.

In addition, in the modification illustrated in FIG. 27C, since the pressing portion 91 can swing in the four directions, there are two pairs of the two directions symmetrically extending on the same straight line from the swing center. The reference swing directions L and R in this case may be any of the two pairs of the two directions. However, for convenience, in the modification illustrated in FIG. 27C, the reference swing directions L and R are set to the left and right directions as in the modification illustrated in FIG. 27B.

In addition, since the pressing portion 91 can swing in the four directions, in the modification illustrated in FIG. 27C, when the conveying portion 72 for edge overcasting conveys the fly 1 while pressing the fly 1 against the sewing table portion 13*a*, in a case in which the fly 1 is conveyed by aligning the conveying direction with any of the forward-rearward direction and the left-right direction of the clamp portion 86, even in a state in which the upper surface of the sewing table portion 13*a* has steps not only in the conveying direction X but also in the direction orthogonal to the conveying direction, the pressing portion 91 becomes an posture corresponding to the state of the upper surface of the sewing table portion 13*a*, and the pressing state with respect to the fly 1 is stabilized.

Figure 28:
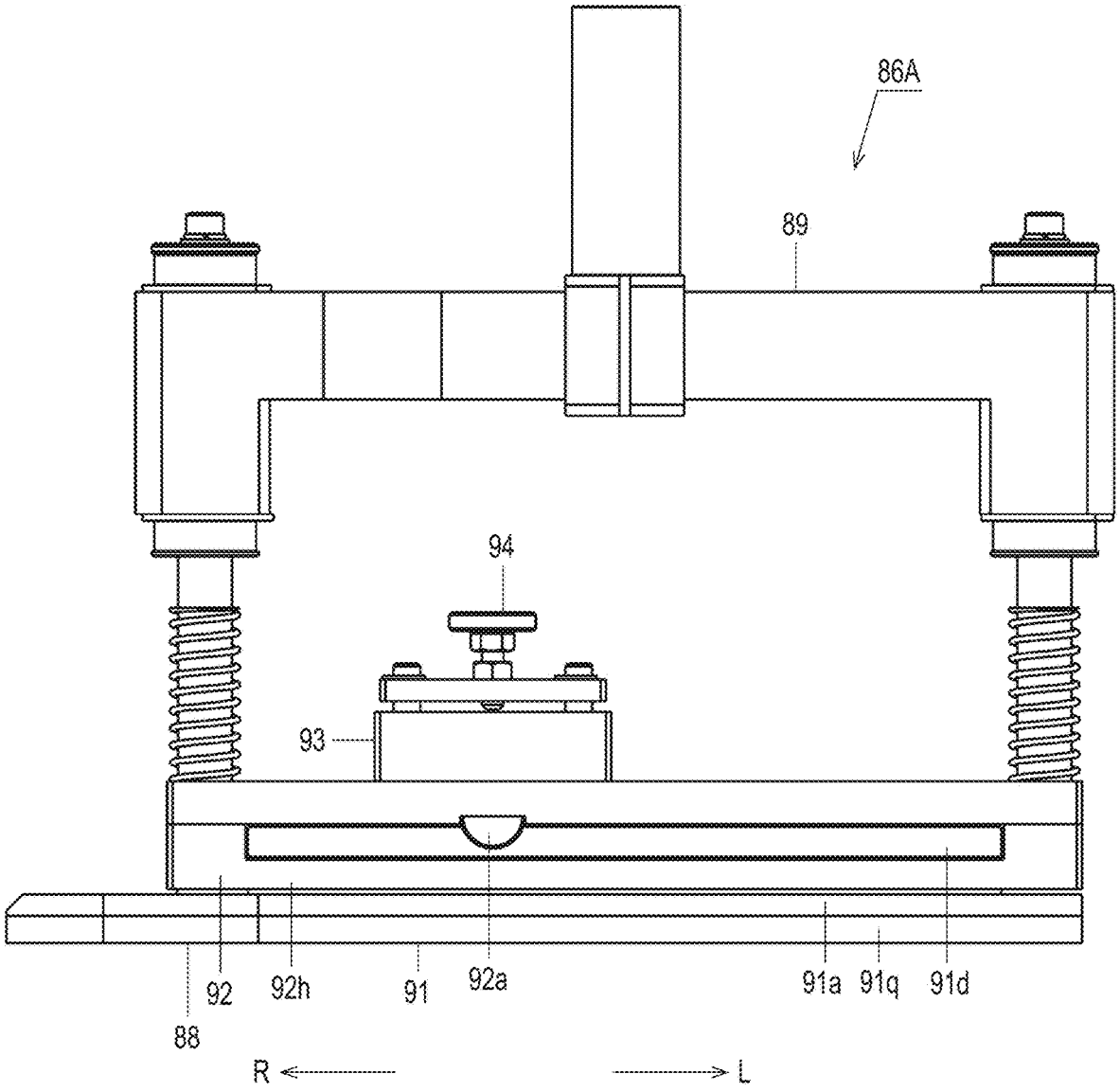
FIG. 28 is a rear view illustrating a clamp portion according to the second embodiment.

As illustrated in FIG. 28, a clamp portion 86A of the conveying portion 72 for edge overcasting according to the second embodiment is different from the clamp portion 86 of the conveying portion 72 for edge overcasting according to the first embodiment in that the shaft 92*a* is disposed at the intermediate portion of the support frame 92*h* in the left-right direction, but is disposed at a position close to one of the left and right directions instead of the strict intermediate portion.

That is, the intermediate portion refers to a position between two positions, and is not limited to the middle point of the two positions. Therefore, the intermediate portion of the support frame 92*h* in the left-right direction refers to a portion between the left and right ends of the support frame 92*h*.

Figure 29:
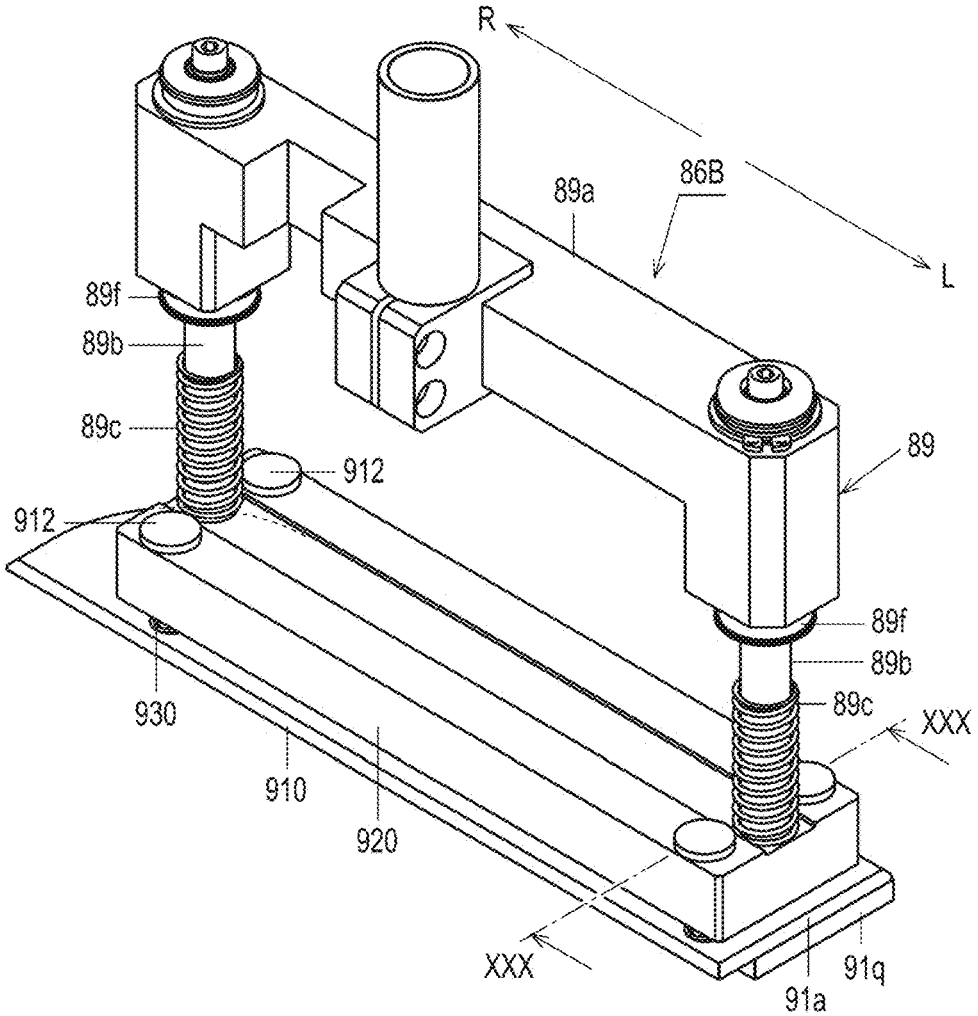
FIG. 29 is a perspective view illustrating a clamp portion according to the third embodiment as viewed from an oblique rear-upper side.
Figure 30:
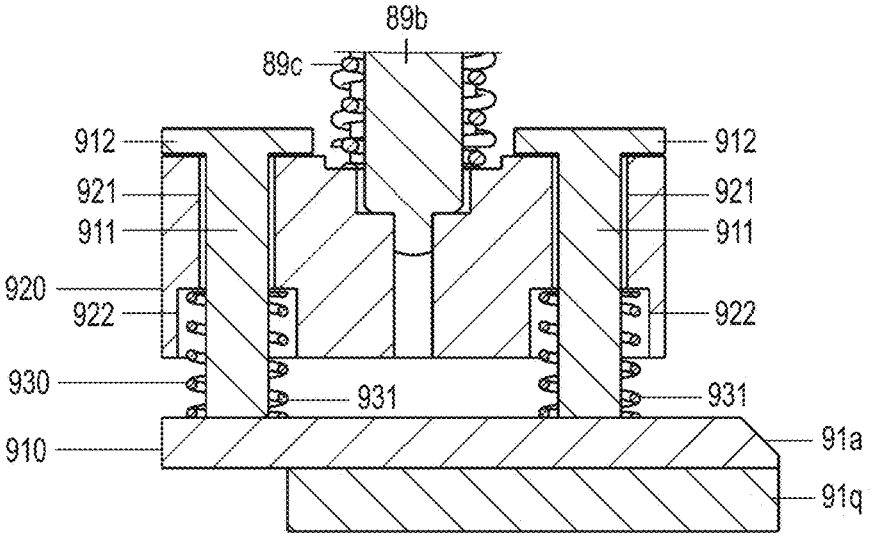
FIG. 30 is a cross-sectional view taken along a line XXX-XXX in FIG. 29.

As illustrated in FIGS. 29 and 30, a clamp portion 86B of the conveying portion 72 for edge overcasting according to the third embodiment of the present invention is different from the clamp portion 86 according to the first embodiment in a configuration including a pressing portion 910 and a support portion 920, which is a configuration in which the pressing portion 910 is swingably supported in a state of facing the sewing table portion 13*a* with a plurality of points as fixed points, and a configuration of a presser 930.

The pressing portion 910 is suspended from the support portion 920 in a state of being movable upward and downward and being capable of inclining with respect to the upward-downward direction. In the present embodiment, the number of positions at which the pressing portion 910 is suspended from the support portion 920 is four, that is, there is a plurality of positions. More specifically, the pressing portion 910 is suspended from four corners of the support portion 920 in a plan view. Further, the pressing portion 910 can swing with one or two among the four corners as the fixed points.

In addition to the pressing member 91*a* and the cushion 91*q*, the pressing portion 910 includes a plurality of guide posts 911 protruding upward from the pressing portion 910, and guide stoppers 912 protruding from upper end portions of the respective guide posts 911.

The four guide posts 911 protrude from four corners of the rectangular upper surface of the pressing member 91*a* in a plan view. Each guide post 911 has a rod shape, more specifically, a columnar shape.

Each guide stopper 912 has a flange shape, more specifically, an annular shape.

The support portion 920 has a block shape extending in the left-right direction. Similarly to the support portion 92 according to the first embodiment, the pair of rods 89*b* are fixed to left and right end portions of an upper surface of the support portion 920. In addition, guide holes 921, through which the guide posts 911 are guided and the guide stoppers 912 cannot pass, are formed in the four corners (front and rear portions of the left and right end portions) of the support portion 920 in the plan view to penetrate in the upward-downward direction. The guide holes 921 serve as the fixed points when the pressing portion 910 swings.

The configuration in which the pressing portion 910 is suspended from the support portion 920 in a manner of being movable upward and downward is as follows. The length of the guide posts 911 in the upward-downward direction is sufficiently longer than the length of the guide holes 921 in the upward-downward direction. Accordingly, the guide posts 911 are movable upward and downward along the guide holes 921, and the pressing portion 910 is also movable upward and downward together with the guide posts 911. The diameter of the guide holes 921 is smaller than the diameter of the guide stoppers 912. Accordingly, the guide stoppers 912 support the pressing portion 910 in a manner of being suspended from the support portion 92*o*. The diameter of the guide holes 921 is sufficiently larger than the diameter of the guide posts 911. Accordingly, the guide posts 911 can be inclined in the upward-downward direction inside the guide holes 921, and the pressing portion 910 can also be inclined in the upward-downward direction.

The presser 930 includes a plurality of compression coil springs 931 accommodated between the support portion 920 and the pressing portion 910. The compression coil springs 931 are accommodated between the support portion 920 and the pressing portion 910 by passing the guide posts 911 through the inside thereof. In addition, accommodating holes 922 for accommodating upper portions of the compression coil springs 931 are formed in a lower surface of the support portion 920. The accommodating holes 922 are lower portions of the guide holes 921. The lower portion of each guide hole 921 is formed to have a larger diameter than an upper portion above the lower portion.

In the clamp portion 86B of the conveying portion 72 for edge overcasting according to the third embodiment, the pressing portion 910 is swingably supported by the guide posts 911 and the guide holes 921 at the four corners of the support portion 920. In addition, in the clamp portion 86B according to the third embodiment, when the fly 1 on the sewing table portion 13*a* is pressed by the pressing portion 910, the support portion 920 is pressed against the compression coil springs 931, the connecting arm 89*a* moves downward together with the guide tubes 89*f* along the rods 89*b* above the support portion 920, and the compression coil springs 89*c* of the impact absorbing portion 89 contract between the guide tubes 89*f* and the support portion 920 and absorb the impact. Further, the compression coil springs 931 sandwiched between the support portion 920 and the pressing portion 910 contract and further absorb the impact. In addition, since the guide posts 911 are movable upward and downward and are capable of inclining with respect to the upward-downward direction inside the guide holes 921, the guide posts 911 are parallel to or inclined with respect to the upward-downward direction in accordance with the shape of the upper surface of the sewing table portion 13*a*, and accordingly, the compression coil springs 931 contract and the pressing portion 910 becomes an posture corresponding to the state of the upper surface of the sewing table portion 13*a*, and the corresponding posture is stabilized by the downward pressing force of the presser 930 by the contraction of the compression coil springs 931 of the presser 930, whereby the pressing state with respect to the fly 1 is stabilized.

Figure 31:
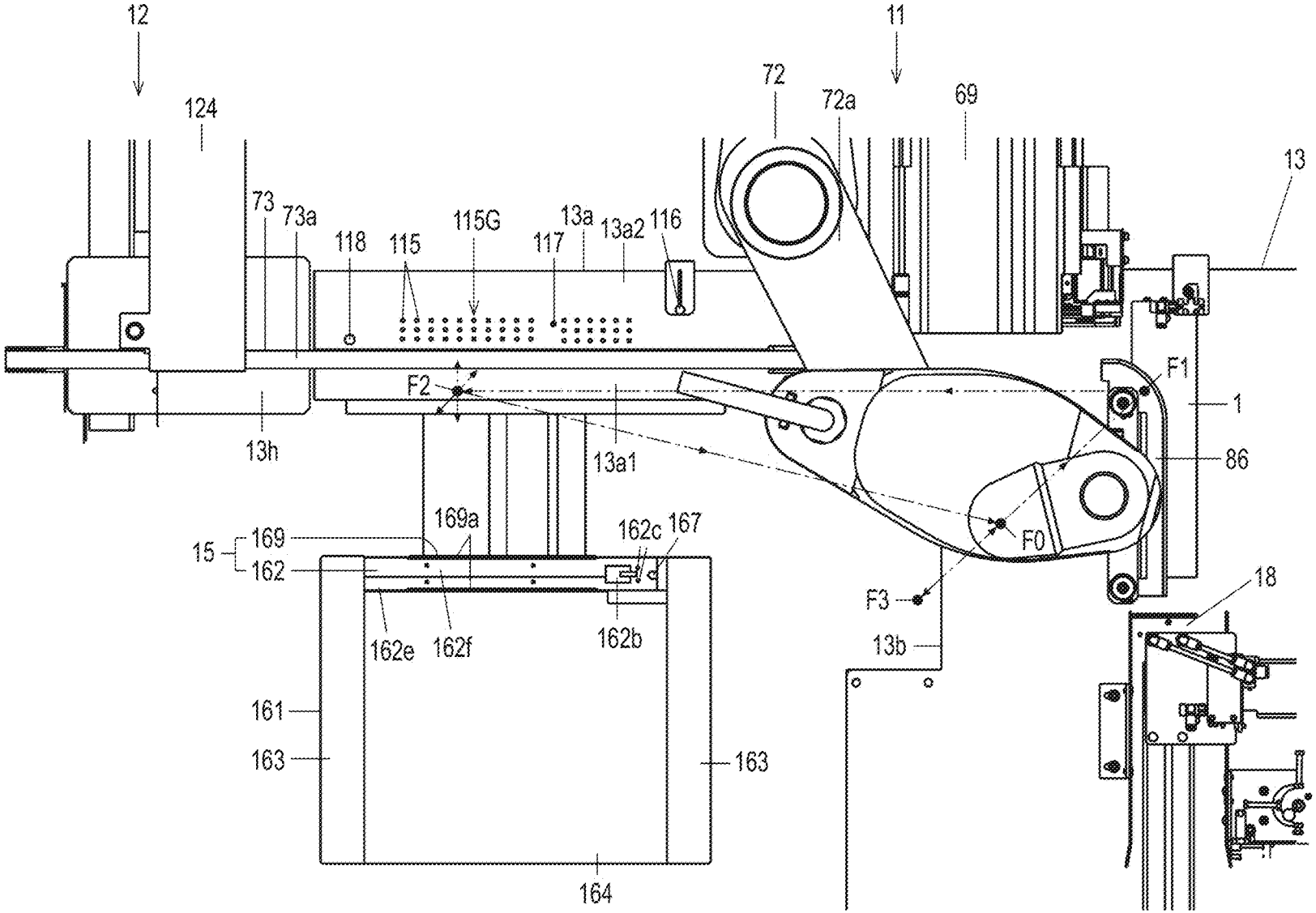
FIG. 31 is a plan view illustrating an operation of the clamp portion.

As illustrated in FIG. 31, the conveying portion 72 for edge overcasting as described above conveys the fly 1 to the second conveyor 73 from the upstream side in the conveying direction with respect to the first sewing machine 69 in a state of pressing the fly 1 against the sewing table portion 13*a*.

The second conveyor 73 is a belt conveyor. A part of a belt 73*a* of the second conveyor 73 is exposed on the upper surface of the sewing table portion 13*a*, and is provided to linearly convey the fly 1 toward the left direction. The rest of the belt 73*a* of the second conveyor 73 is disposed below the sewing table portion 13*a*. The second conveyor 73 is provided in a range between a position on the downstream side with respect to the first sewing machine 69 and on the upstream side with respect to the fastener base 15 and a position on the downstream side with respect to a second sewing machine 124 used for the sewing portion 12. Further, the sewing table portion 13*a* includes, between the first sewing machine 69 and the second sewing machine 124, a front portion 13*al* and a rear portion 13*a*2 that are separated from each other in the forward-rearward direction. A portion of the belt 73*a* on the upstream side in the conveying direction is provided between the front portion 13*al* and the rear portion 13*a*2. In the vicinity of the second sewing machine 124, the sewing table portion 13*a* is provided with a lower stage portion 13*h* that is low in a stepped manner in front of a portion immediately below a needle. A portion of the belt 73*a* on the downstream side in the conveying direction is provided above the lower stage portion 13*h* (see FIG. 47).

In addition, a third suction hole group 115G that sucks and positions the fly 1 on which the edge overcasting is finished is formed in the sewing table portion 13*a* on a rear side (a side opposite to the fastener base 15) of the edge overcasting portion 11 with respect to the belt 73*a* of the second conveyor 73.

The third suction hole group 115G includes a plurality of through holes 115 formed in the sewing table portion 13*a*.

A second fly-rear end sensor 116 that detects the rear end (the downstream end in the conveying direction) of the fly 1 is provided on the upstream side in the conveying direction with respect to the third suction hole group 115G. The second fly-rear end sensor 116 separately includes a light projector and a light receiver. The light projector and the light receiver are provided above and below the through holes 115 formed in the sewing table portion 13*a*.

In addition, a fly presence sensor 117 that detects whether the fly 1 is positioned by the third suction hole group 115G (the presence or absence of the fly 1) is provided in the sewing table portion 13*a*. The fly presence sensor 117 is provided in a disposition region of the third suction hole group 115G. The fly presence sensor 117 is embedded in the sewing table portion 13*a* in a state in which a detection surface thereof is exposed upward.

In addition, a fly-front end sensor 118 that detects a front end of the fly 1 is provided on the downstream side in the conveying direction with respect to the third suction hole group 115G. More specifically, the fly-front end sensor 118 is provided on the downstream side in the conveying direction with respect to a supply position of the fly 1 supplied onto a third suction hole group 115G. The fly-front end sensor 118 is embedded in the sewing table portion 13*a* in a state in which a detection surface thereof is exposed upward.

The clamp conveying portion 72*a* of the conveying portion 72 for edge overcasting is capable of correcting a posture and a position of the fly 1 conveyed onto the third suction hole group 115G and on which edge overcasting is finished. A setting portion is provided in the control device so that the posture and the position can be corrected.

The fastener 2 is placed on the fly 1 on which the edge overcasting is finished. A posture of the fastener 2 when placed on the fly 1 is parallel to an advancing direction of the second conveyor 73 (the conveying direction, that is, the left direction). A position at which the fastener 2 is placed refers to a position at which the fly 1, on which the edge overcasting is finished, stops, that is, a section of the sewing table portion 13*a* in which the third suction hole group 115G is formed, or a front side thereof. The belt 73*a* of the second conveyor 73 is also included on the front side of the section in which the third suction hole group 115G is formed. In the present embodiment, it is assumed that the position at which the fastener 2 is placed is immediately above the second conveyor 73 and is a front portion thereof. Since the posture and the position of the fastener 2 placed on the fly 1 are relatively determined in advance with respect to the sewing table portion 13*a* as described above, a relative positional relation between the fly 1 and the fastener 2 is corrected by correcting the posture and the position of the fly 1.

In the present embodiment, it is assumed that a reference angle of the fly and a reference width of the fly that coincides with the conveying direction are set in advance in the setting portion. In addition, it is assumed that a width of the fly to be fed into the sewing device and an inclination angle of the fly 1 with respect to the conveying direction at the time of sewing can be set in the setting portion. Then, the control device determines whether to correct the position and the posture of the fly 1 on which the edge overcasting is finished, based on the inclination angle and the width of the fly 1 and the reference angle and the reference width of the fly 1 which are set in the setting portion. When the inclination angle and the width of the fly 1 coincide with the reference angle and the reference width, the control device does not cause the clamp conveying portion 72*a* to perform a correction operation. On the other hand, when the inclination angle of the fly 1 and the width of the fly 1 are different from the reference angle and the reference width, the control device drives the clamp conveying portion 72*a* to move the fly 1 on the sewing table portion 13*a* based on the settings.

For example, when the inclination angle of the fly 1 is set to +X degrees with respect to the reference angle, the fly 1 is rotated clockwise by +X degrees in a plan view, and when the inclination angle of the fly 1 is set to −X degrees with respect to the reference angle, the fly 1 is rotated counterclockwise by −X degrees in a plan view.

In addition, when the width of the fly 1 is set to +X mm with respect to the reference width, the fly 1 is moved forward by X mm, and when the width is set to −X mm, the fly 1 is moved rearward by X mm.

When the number of the fly 1 is normal in the fly conveyance process before the sewing in procedure 2), the conveying portion 72 for edge overcasting and the first sewing machine 69 perform the edge overcast process in procedure 3), and when the number of the fly 1 is abnormal, the conveying portion 72 for edge overcasting and the first sewing machine 69 perform the discharge process of the fly in procedure 6).

The discharge process of the fly in procedure 6) is a process for performing a discharge operation of discharging the fly 1 by the conveying portion 72 for edge overcasting. Specifically, as illustrated in FIG. 31, the conveying portion 72 for edge overcasting moves the clamp portion 86 from a starting position F0 to a fly pressing position F1 immediately above the second suction hole group 76G and then moves the clamp portion 86 downward to press the fly 1, moves the clamp portion 86 in this state to a disposal position F3 so as to deviate from a position immediately above the sewing table portion 13*a* and discharges the fly 1, and then returns the clamp portion 86 to the starting position F0.

The edge overcast process in procedure 3) is performed as follows in the order of procedures 3-1) to 3-14).

A case in which there is no fly 1 at a fly conveying position F2 in procedure 3) before the start of the process in procedure 3) is basically described, and it is needless to say that when the preceding processes in procedures 4) and 5) with respect to the fly 1 are performed before the start of the process in procedure 3), a slight change can be added to each procedure so as not to inhibit the processes in the respective procedures. When the second and subsequent flies 1 supplied from the fly bundle 1G are processed, the fly 1 preceding the fly 1 processed in procedure 3) may be processed in procedures 4) and 5).

In procedure 3-1), the conveying portion 72 for edge overcasting is driven to perform the conveyance operation for the edge overcasting of the fly 1. Specifically, as illustrated in FIG. 31, the conveying portion 72 for edge overcasting conveys the clamp portion 86 from the starting position F0 to the fly pressing position F1 to press the fly 1, and conveys the clamp portion 86 in this state toward the first sewing machine 69 while conveying the clamp portion 86 in accordance with a shape of an edge of the fly 1.

In procedure 3-2), when the conveying portion 72 for edge overcasting is driven and then reaches a predetermined position, the first sewing machine 69 operates to perform the edge overcasting in cooperation with the conveying portion 72 for edge overcasting. That is, position information on the conveying portion 72 for edge overcasting serves as a command to start the operation of the first sewing machine 69. Simultaneously with the start of the operation of the first sewing machine 69, the second conveyor 73 also starts to drive.

In procedure 3-3), the two fly presence sensors 83 and 84 are provided to be separated from each other in the forward-rearward direction in the vicinity of the second suction hole group 76G. Of these sensors, the fly presence sensor 83 on the rear side functions as the first fly-rear end sensor to detect the presence or absence of the fly 1. The detection is repeated until the fly 1 is no longer detected, that is, until the rear end of the fly 1 passes immediately above the fly presence sensor 83 on the rear side.

In procedure 3-4), the completion of the edge overcasting by the first sewing machine 69 is determined based on whether a set time elapse after the fly 1 is no longer detected by the first fly-rear end sensor 83.

In procedure 3-5), the conveying portion 72 for edge overcasting temporarily stops driving after the set time elapses, the first sewing machine 69 then stops driving, and then the cutter (not shown) is driven to cut a loop extending on the upstream side with respect to the fly 1. That is, until the set time elapses after the fly 1 is no longer detected by the first fly-rear end sensor 83, the rear end of the fly 1 passes below the needle 69*c* of the first sewing machine 69, the edge overcasting on the fly 1 is finished, and the loop is continuously formed on the fly 1 by a sewing thread 1*e* for the edge overcasting. The loop is cut by the cutter.

In procedure 3-6), the conveying portion 72 for edge overcasting restarts to drive after the loop is cut, and temporarily stops after the fly 1 is conveyed to a position immediately in front of the second fly-rear end sensor 116.

The procedure up to here is a procedure up to immediately after the edge overcasting is finished.

In procedure 3-7), after the temporary stop of the conveying portion 72 for edge overcasting, the fly presence sensor 117 positioned on the downstream side in the conveying direction with respect to the first sewing machine 69 detects the presence of the fly 1. The above is a process for confirming that there is no preceding fly 1 subjected to the edge overcasting before the fly 1 currently being subjected to the edge overcasting.

When the fly presence sensor 117 detects the fly 1 (ON), the subsequent process is not performed until the fly presence sensor 117 no longer detects the fly 1, for example, until the operation of the sewing device is temporarily stopped and the operation is resumed after a cause of detection of the fly 1 by the fly presence sensor 117 is eliminated. The case of ON is, for example, a case in which the preceding fly 1 remains, and is a case in which the preceding fly 1 with the fastener 2 placed thereon is originally supposed to be conveyed toward the second sewing machine 124, but is not conveyed due to a conveyance error.

In procedure 3-8), when the fly presence sensor 117 does not detect the fly (OFF), the conveying portion 72 for edge overcasting restarts to drive.

In procedure 3-9), the second fly-rear end sensor 116 detects the passage of the fly 1. The second fly-rear end sensor 116 does not detect the fly 1 at the start of the procedure 3-9), the second fly-rear end sensor 116 detects the fly 1 at the time of passage, and the detection is repeated until it is detected that the fly 1 passes through the second fly-rear end sensor 116 due to the driving of the conveying portion 72 for edge overcasting and there is no fly 1.

In procedure 3-10), when the fly 1 is no longer detected, the rear end (the end on the downstream side) of the fly 1 passes therethrough, the conveying portion 72 for edge overcasting stops, and the fly 1 reaches the fly conveying position F2.

In procedure 3-10A), when the fly 1 passes through the second fly-rear end sensor 116 and the fly 1 is no longer detected, the second conveyor 73 stops. However, when there is the fly 1 on the downstream side in the conveying direction with respect to the fly 1 immediately after passing through the second fly-rear end sensor 116, the process in procedure 5) is also performed in parallel, and the second conveyor 73 is also driven in procedure 5), a stop process of the second conveyor 73 based on the process in procedure 5) is prioritized. The above is a process that occurs because the conveyance length of the second conveyor 73 required in procedure 5) is longer than the length required in procedure 3).

In procedure 3-11), there are a case in which a correction process for correcting the position and the posture of the fly 1 is performed and a case in which the correction process is not performed according to the settings of the control device. When the position and the posture of the fly 1 are corrected by the correction process, the conveying portion 72 for edge overcasting is driven at the fly conveying position F2 to move the fly 1 forward or rearward, or to change the inclination with respect to the conveying direction as illustrated in FIG. 31.

In procedure 3-12), after procedure 3-11), the air is sucked from the third suction hole group 115G near the fly presence sensor 117, and the fly 1 is held. On the downstream side in the conveying direction with respect to the second fly-rear end sensor 116, the fly presence sensor 117 detects the presence of the fly 1.

In procedure 3-12A), when the fly presence sensor 117 does not detect the fly 1, a warning process is performed.

In procedure 3-13), when the fly presence sensor 117 detects the fly 1, the conveying portion 72 for edge overcasting returns the clamp portion 86 to the starting position F0.

In procedure 3-14), the air is sucked from the third suction hole group 115G near the fly presence sensor 117, and the fly 1 is held. Hereinafter, the process proceeds to the fastener supply process to the fly in procedure 4).

In the edge overcasting portion 11 according to the embodiments as described above, the first conveyor 24 conveys the fly 1 to a relay point (the fly base 18) of the entire length of the fly conveyance table portion 13*b* in the conveying direction, the fly positioning device 22 positions the fly 1 at the relay point, and the first conveying device 68 conveys the fly 1 from the relay point to the first sewing machine 69. More specifically, the pre-sewing conveying portion 71 of the first conveying device 68 conveys the fly 1 from the relay point to an end point of the entire length of a fly conveyance table portion 13*b* in the conveying direction in a suspended manner, and the conveying portion 72 for edge overcasting moves the fly 1 along the horizontal side 1*a* from the end point in 1), rotates the fly 1 by 90 degrees along the curved side 1*b* in 2), and moves the fly 1 along the vertical side 1*c* in 3) during the edge overcasting. The fly 1 collides with nothing during the movement for the edge overcasting.

However, in the edge overcasting portion 11, the first conveyor 24 may convey the fly 1 to the end point (the fly base 18) of the fly conveyance table portion 13*b* in the conveying direction, the fly positioning device 22 may position the fly 1 at the end point, and the conveying portion 72 for edge overcasting of the first conveying device 68 may convey the fly 1 from the end point.

However, the fly stopper 62 and the pair of width correcting guides 63*a* and 63*b* for the fly in the fly positioning device 22 position the fly 1 in a state of being disposed on the fly conveyance table portion 13*b*. Accordingly, the fly stopper 62 and the pair of width correcting guides 63*a* and 63*b* for the fly in the fly positioning device 22 need to be located at positions away from a movement path of the conveying portion 72 for edge overcasting and the conveyance path of the fly 1 in advance so as not to collide with the conveying portion 72 for edge overcasting and the fly 1 during the conveyance of the fly 1 by the conveying portion 72 for edge overcasting. More details are as follows.

The fly stopper 62 is capable of protruding and retracting upward with respect to the fly conveyance table portion 13*b* in order to position the fly 1 in the conveying direction, and thus the fly stopper 62 is positioned below the fly conveyance table portion 13*b* during the conveyance of the fly 1 by the conveying portion 72 for edge overcasting.

The pair of width correcting guides 63*a* and 63*b* for the fly position the fly 1 in the direction orthogonal to the conveying direction, and the movable guide 63*b* moves toward the fixed guide 63*a* to narrow the interval between the pair of width correcting guides 63*a* and 63*b* for the fly. In the above embodiments, the width correcting guide 63*b* for the fly on the right side serves as the movable guide, and the width correcting guide 63*a* for the fly on the left side serves as the fixed guide. When the width correcting guide 63*a* for the fly on the left side serves as the fixed guide, the clamp portion 86 of the conveying portion 72 for edge overcasting and the fly 1 during the movement for the edge overcasting collide with the width correcting guide 63*a* for the fly on the left side. Therefore, in this case, the width correcting guide 63*a* for the fly on the left side also serves as a movable guide, and is configured to be movable to a retraction position on the left side and a positioning position on the right side, or is configured to be capable of protruding and retracting upward with respect to the fly conveyance table portion 13*b*. The above is the descriptions on the edge overcasting portion 11.

Figure 38:
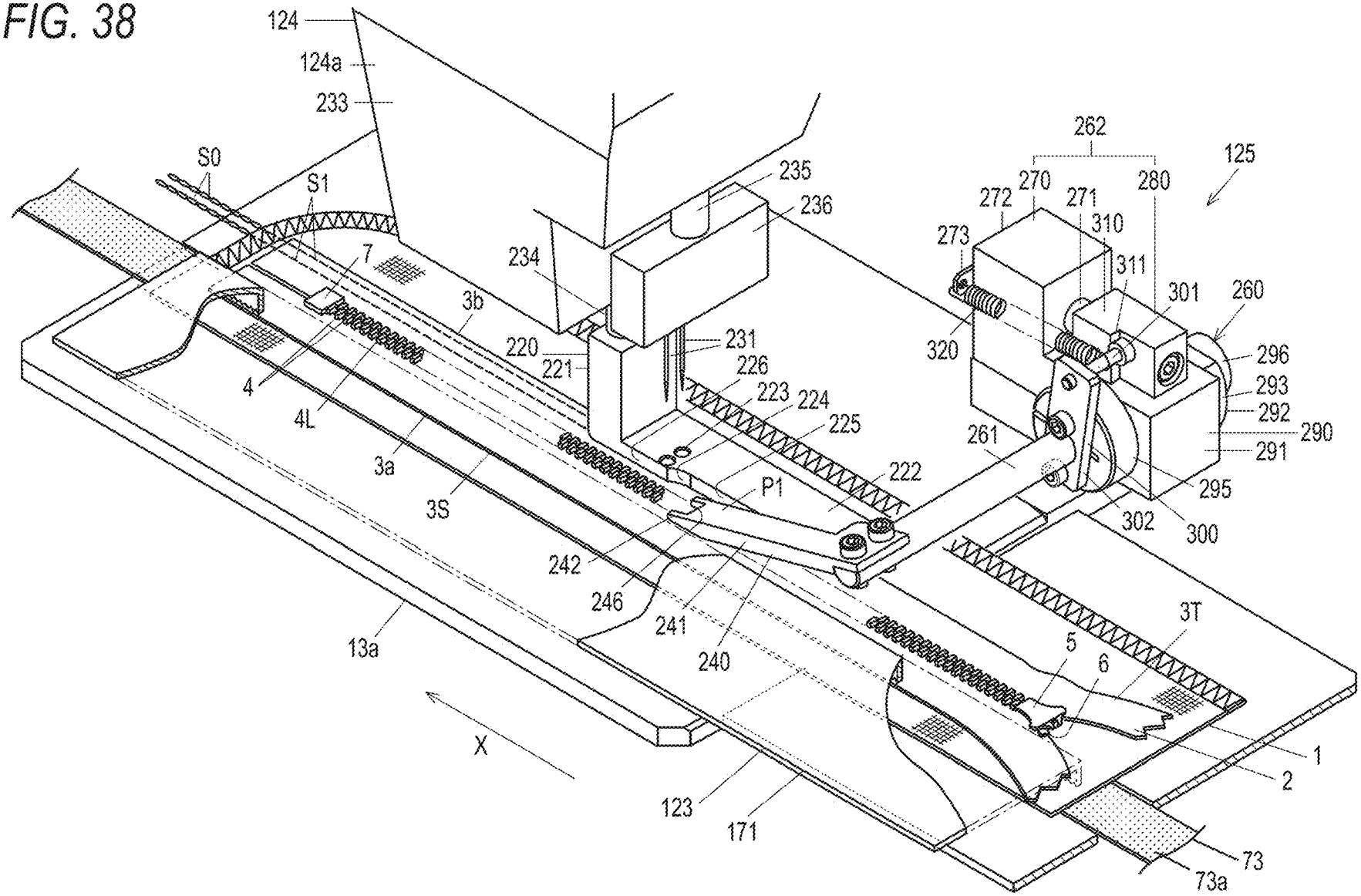
FIG. 38 is a perspective view illustrating a second sewing machine and a fastener positioning device.

As illustrated in FIG. 1, in addition to the fastener base 15 on which the fastener 2 is placed, the iron base 16, and the temporary placement base 161, the sewing portion 12 includes a fastener supplying device 121 that supplies the fastener 2 from above the fastener base 15 onto the fly 1 on which the edge overcasting is finished, a discharge device 122 that discharges the fastener 2 and the fly 1 together when the fly 1 onto which the fastener 2 is supplied is in an abnormal state, a second conveying device 123 that conveys the fly 1 and the fastener 2 placed thereon together, the second sewing machine 124 that sews and integrates the fly 1 and the fastener 2 during the conveyance by the second conveying device 123, a fastener positioning device 125 that positions the fastener 2 to be sewn by the second sewing machine 124, a loop cutting device 126 (see FIGS. 48 to 50) serving as a sewing thread cutting device that cuts a loop (A loop S0 formed before the sewing is shown in FIG. 38. A loop as a weft extending from the rear end of the fly 1) as a sewing thread after the sewing by the second sewing machine 124, and an iron device 127 that adjusts the shape of the fastener 2 on the iron base 16.

The fastener supplying device 121, the second conveying device 123, and the second conveyor 73 constitute a supplying and conveying device 120. The supplying and conveying device 120 supplies and overlaps the fastener 2 from the fastener base 15 onto the fly 1 on which the edge overcasting is finished, and conveys the fly 1 and the fastener 2 together.

Figure 32:
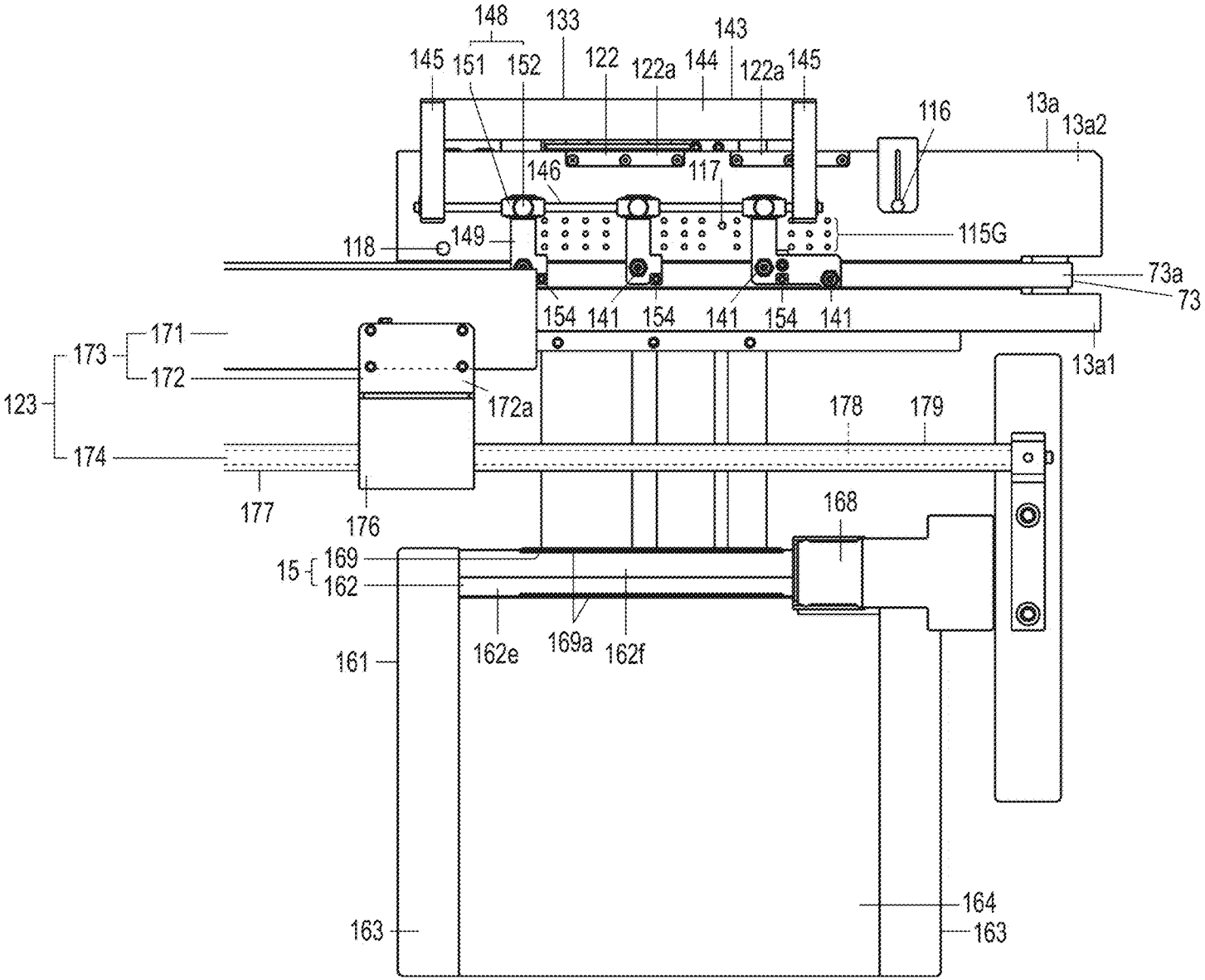
FIG. 32 is a plan view illustrating a configuration for supplying a fastener from a fastener base to a sewing table portion.

As illustrated in FIG. 32, the discharge device 122 includes a plurality of blowing portions 122*a* fixed to the upper surface of the sewing table portion 13*a* at intervals in the conveying direction. Discharge ports are formed in each blowing portion 122*a* at intervals in the conveying direction. The blowing portions 122*a* are disposed to be separated from the conveyance path of the fly 1 on the sewing table portion 13*a* in the direction orthogonal to the conveying direction. More specifically, the blowing portions 122*a* are fixed on the sewing table portion 13*a* on a side opposite to the belt 73*a* of the second conveyor 73 with respect to the third suction hole group 115G. The discharge ports for the air of the blowing portions 122*a* are formed to blow the air toward the third suction hole group 115G.

Figure 33:
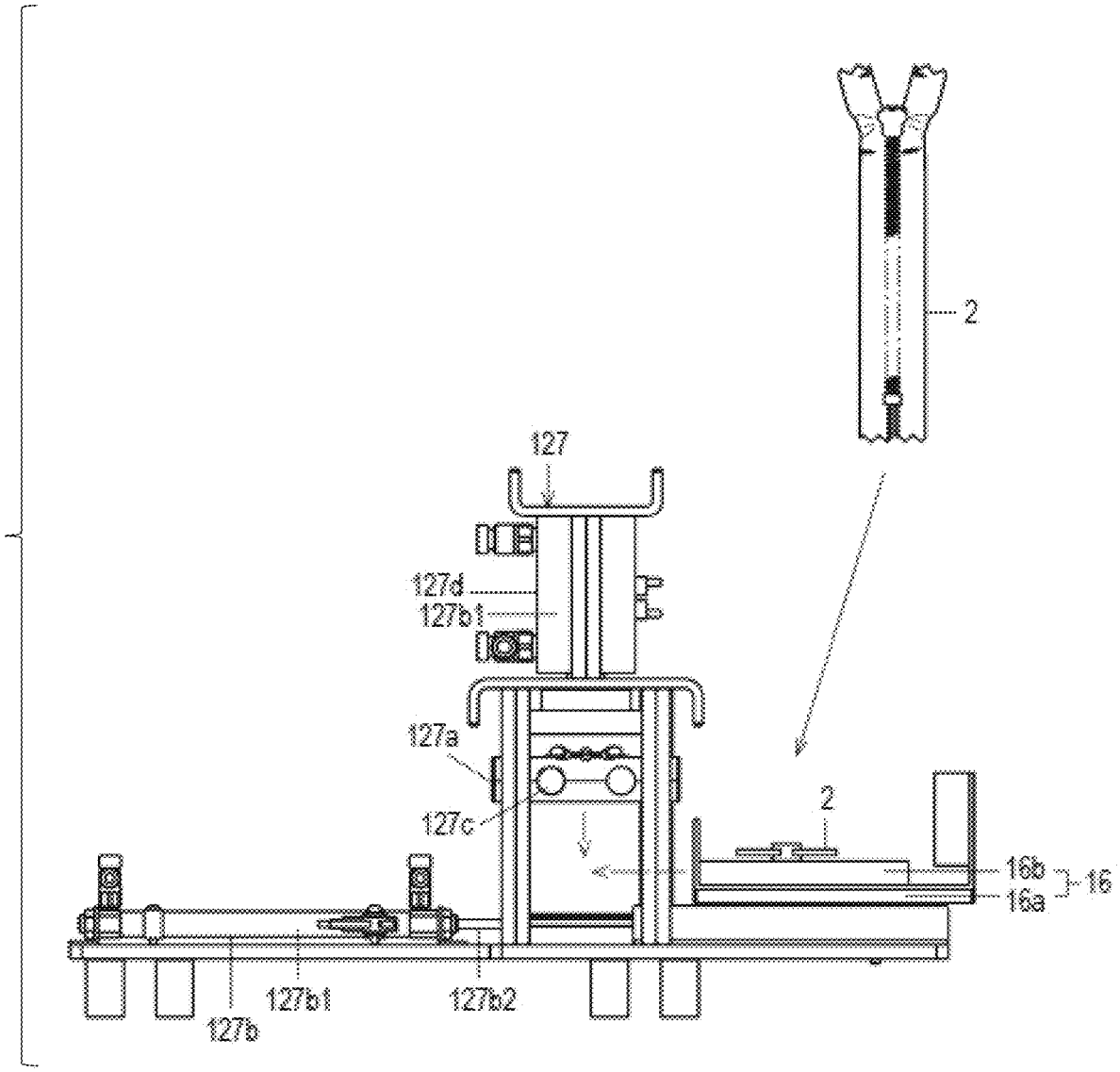
FIG. 33 is a left side view illustrating an iron device.

As illustrated in FIG. 33, the iron base 16 includes an iron base main body 16*a* and a cushion 16*b* fixed on the iron base main body 16*a*. The cushion 16*b* has flexibility and heat resistance and is elastically deformed to correspond to the unevenness of the fastener 2 placed thereon, and a heat-resistant sponge can be used as an example thereof.

The iron device 127 includes a heater table 127*a* that is pressed against the fastener 2 from above, an iron base moving device 127*b* that can move the iron base 16 to advance to or retract from a heating position immediately below the heater table 127*a* and a standby position away from immediately below the heater table 127*a*, a heating device 127*c* that heats the heater table 127*a*, and a lifting device 127*d* that can move the heater table 127*a* upward and downward.

The iron base moving device 127*b* is also referred to as the cylinder device 127*b*. A cylinder 127*b*1 of the cylinder device 127*b* is fixed to the frame, and a piston rod 127*b*2 moves forward. In a state in which the piston rod 127*b*2 moves forward, the iron base 16 is positioned in front of the heater table 127*a*.

The lifting device 127*d* is also referred to as the cylinder device 127*d*. A cylinder 127*d*1 of the cylinder device 127*d* is disposed above the heater table 127*a*, and is fixed to the frame. A piston rod 127*d*2 of the cylinder device 127*d* moves downward, and the heater table 127*a* is fixed to a tip portion of the piston rod 127*d*2.

Although not shown, an iron device 127 includes a heater operation switch and a start switch. When the heater operation switch is pressed, the heating device 127*c* operates to heat the heater table 127*a*. When the start switch is pressed, in a case in which a heater reaches a set temperature, the iron base moving device 127*b* and the lifting device 127*d* are driven.

A fastener shaping process in procedure 8) by the iron device 127 is performed as follows in the order of procedures 8-1) to 8-10).

In procedure 8-1), the heater operation switch is pressed.

In procedure 8-2), accordingly, the heating device 127*c* operates, and the heater of the heating device 127*c* is heated.

In procedure 8-3), the fastener 2 is placed on the iron base 16.

In procedure 8-4), the start switch of the iron device 127 is pressed.

In procedure 8-5), it is detected whether the heater reaches a desired set temperature. This detection process is repeated until the heater reaches the set temperature.

In procedure 8-6), when the heater reaches the set temperature, the iron base moving device 127*b* is driven, and the iron base 16 advances immediately below the heater table 127*a*.

In procedure 8-7), the lifting device 127*d* is driven, the heater table 127*a* moves downward, and the fastener 2 is sandwiched between the heater table 127*a* and the iron base 16.

In procedure 8-8), whether a set time elapses from the completion of the downward movement is detected. This detection process is repeated until the set time is reached.

In procedure 8-9), when the set time elapses, the lifting device 127*d* is driven, and the heater table 127*a* moves upward to return to an original initial position.

In procedure 8-10), the iron base moving device 127*b* is driven, and the iron base 16 retracts and returns to an original initial position.

Figure 34:
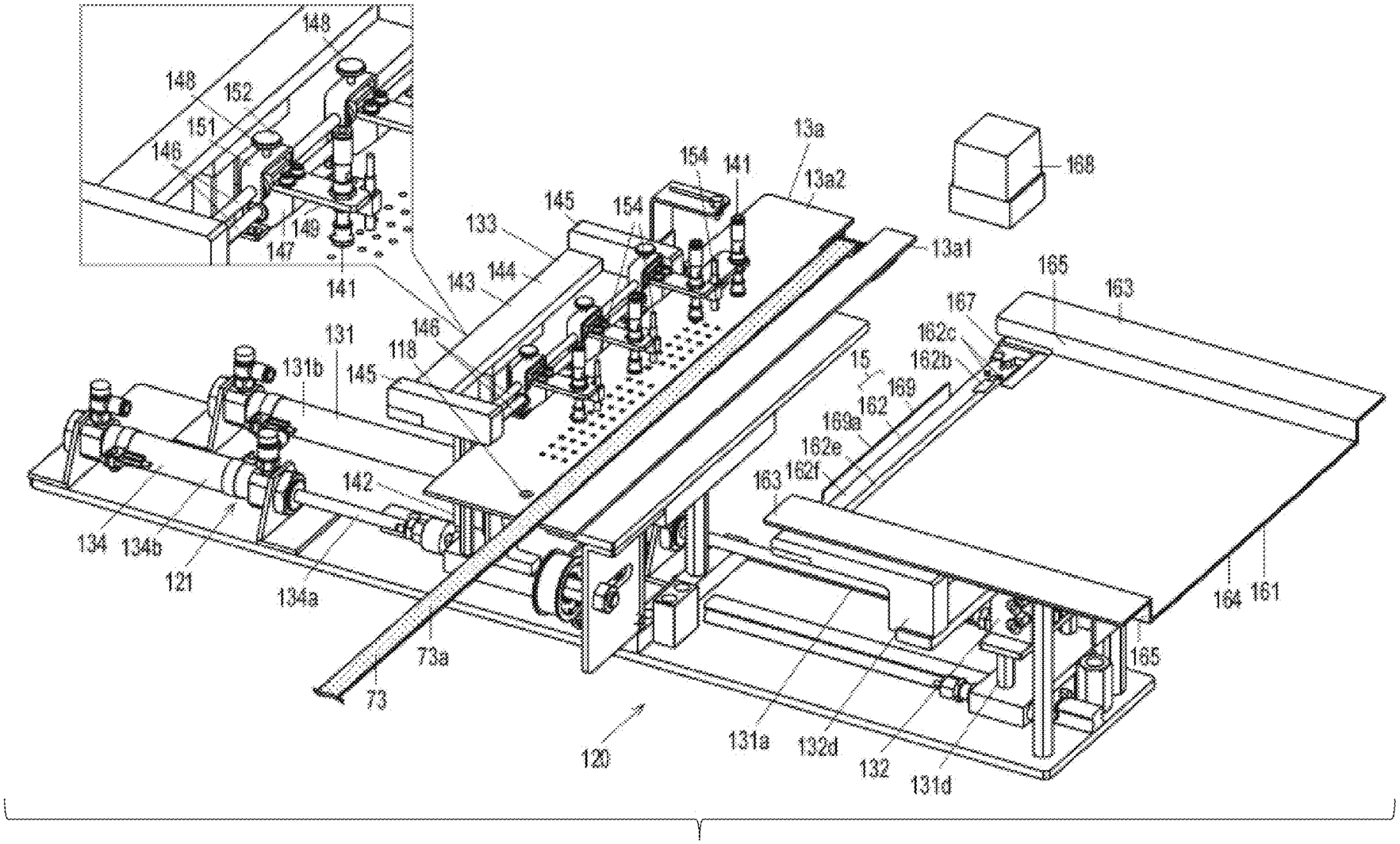
FIG. 34 is a perspective view illustrating the configuration for supplying the fastener from the fastener base to the sewing table portion.
Figure 35:
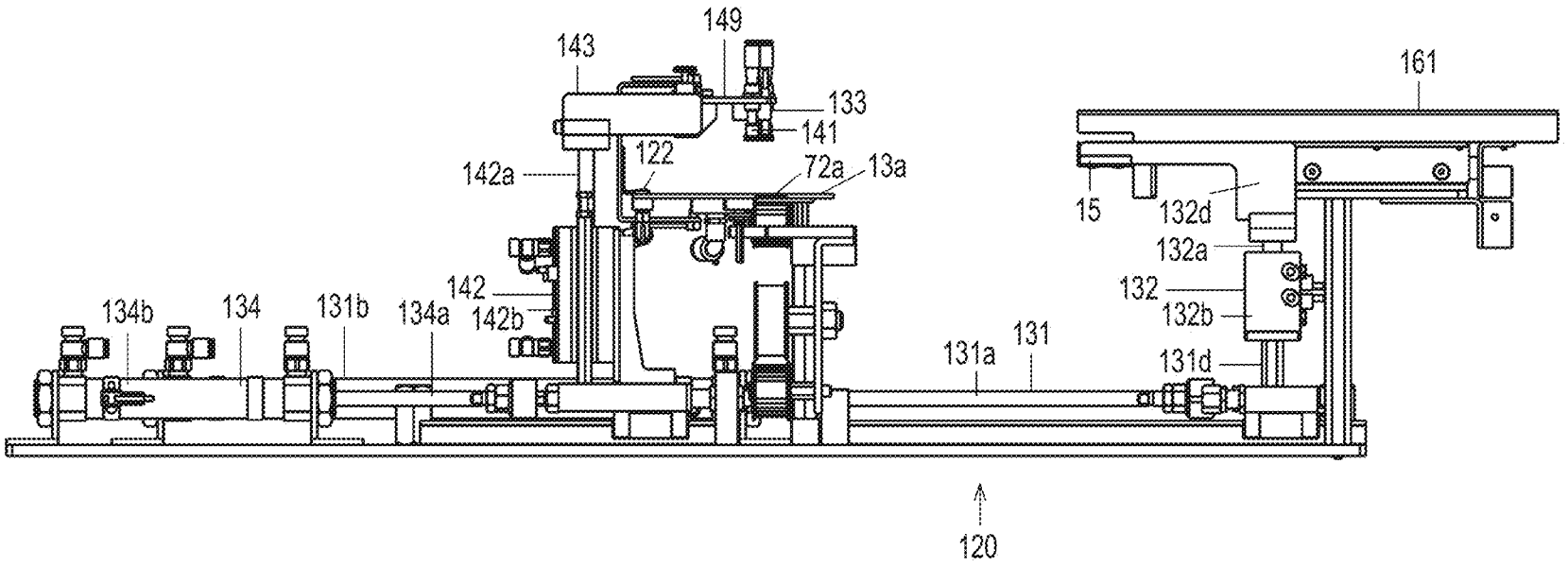
FIG. 35 is a left side view illustrating the configuration for supplying the fastener from the fastener base to the sewing table portion.

As illustrated in FIGS. 34 and 35, in addition to the fastener base 15 as described above, the fastener supplying device 121 includes a fastener base conveying device 131 that reciprocates the fastener base 15 in the forward-rearward direction between a position immediately above the sewing table portion 13*a* and a standby position, a fastener base lifting device 132 that moves the fastener base 15 upward and downward, a fastener suction unit 133 that sucks the fastener 2 on the fastener base 15 from above and supplies the fastener 2 onto the fly 1 on the sewing table portion 13*a*, and a suction unit conveying device 134 that reciprocates the fastener suction unit 133 in the forward-rearward direction between a suction position and a standby position.

The fastener suction unit 133 includes suction port portions 141 that suck and hold the fastener 2, and a lifting device 142 that is capable of moving the suction port portions 141 upward and downward.

A plurality of suction port portions 141 are disposed at intervals in the conveying direction (the left-right direction), and the four suction port portions 141 are disposed in the illustrated example. Further, all the suction port portions 141 are fixed to the lifting device 142 via a connecting portion 143.

As illustrated in FIGS. 32 and 34, the connecting portion 143 includes a first plate portion 144 extending in the conveying direction, a pair of end plate portions 145 that extend in the direction orthogonal to the conveying direction from both ends of the first plate portion 144 in the conveying direction toward the fastener base 15, a pair of bars 146 bridged between tip portions of the pair of end plate portions 145, three support blocks 147 through which the pair of bars 146 pass, three fixtures 148 that respectively fix positions of the support blocks 147 with respect to the pair of bars 146, and brackets 149 that are respectively fixed to the support blocks 147 and extend toward the fastener base 15.

The lifting device 142 is a cylinder device in which a piston rod 142*a* moves upward. The first plate portion 144 of the connecting portion 143 is fixed to an upper portion of the piston rod 142*a*.

The suction port portions 141 are fixed to the brackets 149. Two of the suction port portions 141 are fixed to the bracket on the most upstream side in the conveying direction among the three brackets 149. The bracket 149 on the most upstream side is L-shaped in a plan view. The other two brackets 149 have a linearly extending shape. The suction port portions 141 suck the air from below and hold the fastener 2.

The pair of bars 146 are arranged in the upward-downward direction. The fixtures 148 are fixed to the upper bar 146 and the support blocks 147.

Each fixture 148 includes a metal fitting 151 through which the upper bar 146 passes, and a screw 152 screwed into the metal fitting 151 to fix the metal fitting 151 to the corresponding support block 147.

The metal fitting 151 is U-shaped. The upper bar 146 passes through both ends of the metal fitting 151. Further, the support block 147 is disposed between both ends of the metal fitting 151. The metal fitting 151 covers the support block 147 from above and both sides in the conveying direction. The screw 152 is screwed into a central portion of the metal fitting 151, and both end portions of the U-shaped metal fitting 151 are deformed to be pulled upward by pressing a tip portion of the screw 152 against the support block 147, and the metal fitting 151 is fixed to the bar 146. Accordingly, a position of the support block 147 with respect to the bar 146 and a position of the suction port portion 141 with respect to the bar 146 are fixed.

Further, the fastener suction unit 133 includes three fastener set sensors 154 that detect the presence of the fastener 2, in addition to the suction port portions 141, the lifting device 142, and the connecting portion 143. The fastener set sensors 154 are separately fixed to the three brackets 149. More specifically, when the length of the fastener 2 is long, the three fastener set sensors 154 are caused to function to confirm that the fastener 2 reaches a predetermined position, and when the length of the fastener 2 is short, the two fastener set sensors 154 positioned on the upstream side in the conveying direction among the three fastener set sensors 154 are caused to function to confirm that the fastener 2 reaches the predetermined position.

The fastener set sensors 154 are provided in a state in which detection surfaces thereof face downward. The fastener suction unit 133 as described above is conveyed by the suction unit conveying device 134.

The suction unit conveying device 134 is disposed below the sewing table portion 13*a* and on the side opposite to the fastener base 15 (the rear side).

The suction unit conveying device 134 is a cylinder device in which a piston rod 134*a* reciprocates in the forward-rearward direction. A cylinder 134*b* of the cylinder device is fixed to the frame, and a tip portion of the piston rod 134*a* of the cylinder device 134 is fixed to a cylinder 142*b* of the lifting device 142 of a fastener suction unit 133 via the brackets.

The fastener base conveying device 131 is a cylinder device in which a piston rod 131*a* reciprocates in the forward-rearward direction. A cylinder 131*b* of the cylinder device is fixed to the frame, and a tip portion of the piston rod 131*a* of the cylinder device is fixed to the fastener base lifting device 132 via a fixture 131*d*. The fastener base conveying device 131 is not limited to a cylinder device, and may be a device that converts a rotational motion of a servomotor into a linear reciprocating motion by a conversion mechanism.

The fastener base lifting device 132 is a cylinder device in which a piston rod 132*a* moves upward. A cylinder 132*b* of the cylinder device is fixed on the fixture 131*d*, and the fastener base 15 is fixed to a tip portion of the piston rod 132*a* via a fixture 132*d*.

The fastener base 15 can reciprocate in the forward-rearward direction, and is in a state of being adjacent to the temporary placement base 161 on the rear side (a sewing table portion 13*a* side) at a limit position at which the fastener base 15 retracts as illustrated in FIG. 34.

As illustrated in FIGS. 31, 32, and 34, when viewed in the forward-rearward direction, the temporary placement base 161 includes a pair of left and right end plate portions 163, a plate-shaped temporary placement plate portion 164 that is located between the pair of end plate portions 163 and is low in a stepped manner with respect to the pair of end plate portions 163, and joining plate portions 165 that join the pair of end plate portions 163 and the temporary placement plate portion 164.

The pair of end plate portions 163 and the pair of joining plate portions 165 extend on the rear side (a sewing table portion 13*a* side) with respect to the temporary placement plate portion 164. Therefore, when viewed in the upward-downward direction, the temporary placement base 161 includes a space portion that penetrates in the upward-downward direction on the rear side of the temporary placement plate portion 164 and between the pair of joining plate portions 165. When viewed in the upward-downward direction, the fastener base 15 can be disposed in a state of closing the space portion.

The fastener base 15 includes a fastener base main body portion 162 on which the fastener 2 is placed, and a tape guide 169 that extends above an upper surface of the fastener base main body portion 162 from a rear surface of the fastener base main body portion 162 and positions the tape 3*b* on the rear side.

The fastener base main body portion 162 has a plate shape extending in the left-right direction. In a state in which the fastener base main body portion 162 is adjacent to the temporary placement base 161 on the rear side, left and right end portions of the fastener base main body portion 162 are positioned immediately below the pair of the end plate portions 163. Further, the upper surface of the fastener base main body portion 162 has a stepped shape in which one side (the front side) thereof in the forward-rearward direction is set to a high surface 162*e* and the opposite side (the rear side) thereof is set to a low surface 162*f*. Of the upper surface of the fastener base main body portion 162, a region in the left-right direction, which has the stepped shape, refers to a region other than a right end portion of a region facing the temporary placement plate portion 164.

At a right end portion of the upper surface of the fastener base main body portion 162, a recess 162*b* that recesses to be deeper than the low surface 162*f* is formed in a state of being adjacent to a right end of the stepped shape (the high surface 162*e* and the low surface 162*f*). A lower surface side (the pull tab of the fastener 2 and a portion of the slider body to which the pull tab is connected) of the slider 5 is placed on the recess 162*b* (see FIG. 41 regarding the fastener 2). In addition, a pair of protrusions 162*c*, which position the slider body 5*a*, protrude upward on the upper surface of the fastener base main body portion 162 on the right side with respect to the recess 162*b* in the forward-rearward direction.

The tape 3*a* on the front side of the fastener 2 is placed on a high surface 162*e*. One surface (a front surface) of the element row 4L in the width direction is brought into contact with a step surface, which is a boundary between the high surface 162*e* and the low surface 162*f*, and is positioned. In addition, the tape guide 169 brings the tape 3*b* on the rear side into contact with a rear surface of the element row 4L and positions the tape 3*b*.

The upper surface of the fastener base main body portion 162 may include a groove extending in the left-right direction instead of the high surface 162*e* and the low surface 162*f*, and in this case, the element row 4L is accommodated in the groove and the fastener 2 is positioned.

Further, the tape guide 169 is fixed to the fastener base main body portion 162. The tape guide 169 is a plate bent in a U-shape. The tape guide 169 includes opposed plate portions 169*a* that face each other in the forward-rearward direction and a bottom plate portion (not shown) that joins lower end portions of the pair of opposed plate portions 169*a*. The fastener base main body portion 162 is placed on the bottom plate portion. The opposed plate portion 169*a* on the rear side protrudes upward from the lower surface of the fastener base main body portion 162.

A body presence sensor 167 that detects the presence or absence of the slider body 5*a* is provided on the right side with respect to a portion between the pair of protrusions 162*c*. The body presence sensor 167 is provided in a state in which a detection surface thereof faces the left side.

An image sensor 168 is provided above the recess 162*b* on which the lower surface side of the slider 5 is placed. The image sensor 168 is a device that is capable of calculating a feature amount of an object and outputting data or a determination result by performing an image process on data captured by a camera. Here, the image sensor 168 determines, for example, whether the slider body 5*a* completely closes the element row 4L, whether the slider body 5*a* is a normal product from the viewpoint of the shape, the size, and the like, and whether a color of a plating covering a surface of the slider body 5*a* is normal.

As illustrated in FIGS. 32, 38, and 41, the second conveying device 123 presses the fly 1 against the belt 73*a* of the second conveyor 73 from above the tape 3*a* of the pair of tapes 3*a* and 3*b*, and conveys the fly 1 and the fastener 2 together in parallel to the longitudinal direction of the element row 4L of the fastener 2. Further, the tape 3*b* of the pair of tapes 3*a* and 3*b* and the fly 1 on the lower side are sewn by the second sewing machine 124 during the conveyance. Hereinafter, of the pair of tapes 3*a* and 3*b*, the tape 3*a* pressed by the second conveying device 123 is referred to as the pressing-side tape 3*a*, and the sewn tape 3*b* is referred to as the sewing-side tape 3*b*.

As illustrated in FIG. 32, the second conveying device 123 includes a fastener pressing portion 171 that presses the pressing-side tape 3*a* from above, a lifting device 172 that can move the fastener pressing portion 171 upward and downward, and a second conveying device main body portion 174 that reciprocates a fastener pressing unit 173, in which the fastener pressing portion 171 and the lifting device 172 are integrated, in the direction opposite to the conveying direction X and the conveying direction X. A limit position of the fastener pressing unit 173 in the conveying direction (the left direction) is a standby position. A limit position of the fastener pressing unit 173 in the direction (the right direction) opposite to the conveying direction is a pressing position of the fastener 2 with respect to the pressing-side tape 3*a*, and is the disposition region of the third suction hole group 115G on the belt 73*a* of the second conveyor 73.

As illustrated in FIGS. 1 and 32, the second conveying device main body portion 174 includes a servomotor 175 and a conversion mechanism 177 that converts a rotational motion of the servomotor 175 into a linear reciprocating motion of a slide block 176. The conversion mechanism 177 includes a screw portion 178 that is rotated by the servomotor 175 and extends in the left-right direction, the slide block 176 that is screwed to the screw portion 178, and a guide rod 179 that is passed through a through hole penetrating the slide block 176 in the left-right direction and is parallel to the screw portion 178.

The lifting device 172 is a cylinder device in which a piston rod moves downward. The slide block 176 is fixed to a cylinder 172*a* of the lifting device 172 via a bracket. The fastener pressing portion 171 is fixed to a tip portion (a lower portion) of the piston rod of the lifting device 172.

As illustrated in FIG. 38, the fastener pressing portion 171 is a single plate bent in an L shape. One of a pair of plate portions bent at a right angle extends vertically, and a lower end thereof is pressed against the fastener 2. The length of the fastener pressing portion 171 in the conveying direction X is substantially the same as the entire length of the fly 1 in the conveying direction X (the entire length of the fly 1 in the longitudinal direction of the tapes 3*a* and 3*b* overlapped on the fly 1).

Figure 36:
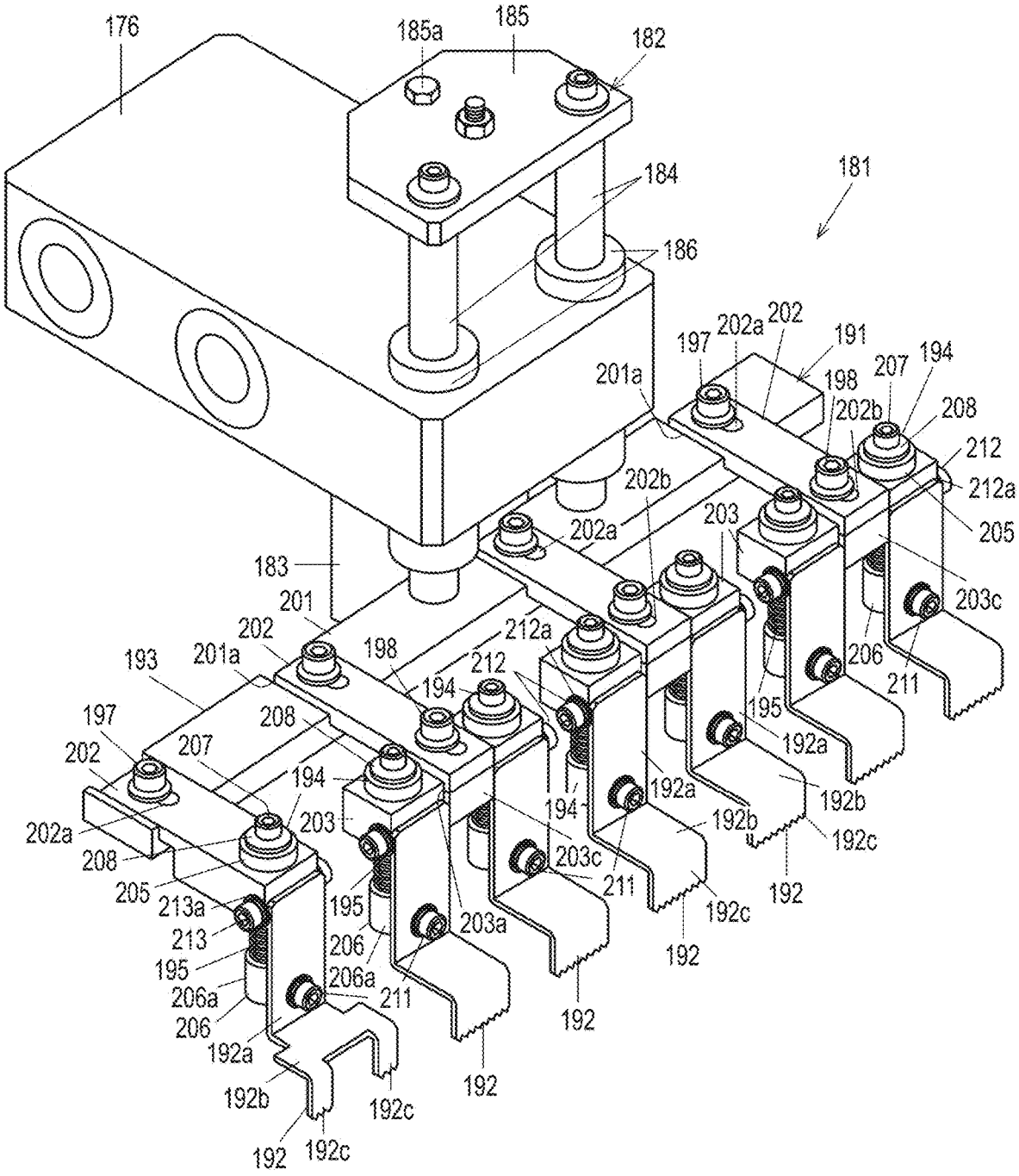
FIG. 36 is a perspective view illustrating a fastener pressing unit according to a modification.
Figure 37:
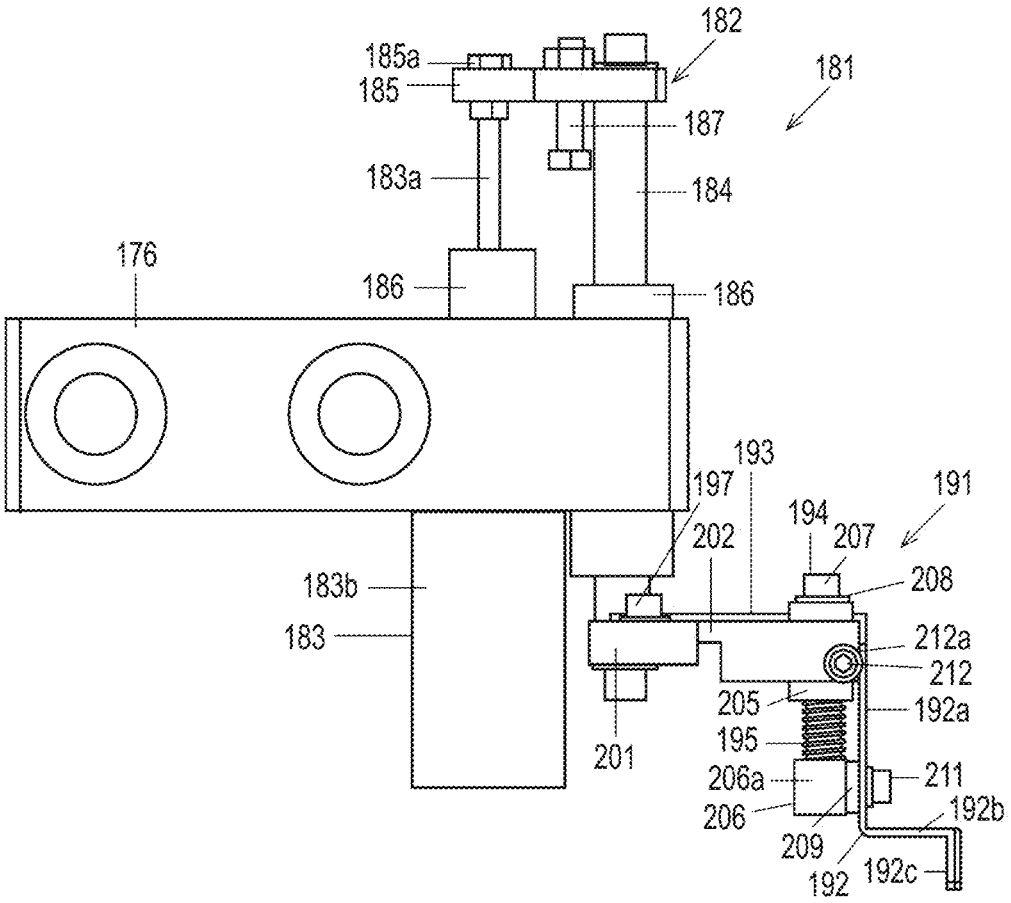
FIG. 37 is a right side view illustrating the fastener pressing unit according to the modification.

In the fastener pressing unit 173 as described above, the lifting device 172 includes the piston rod that moves downward, and the fastener pressing portion 171 is a single plate bent in an L shape. However, in a fastener pressing unit 181 according to a modification illustrated in FIGS. 36 and 37, a lifting device 182 according to the modification includes a piston rod 183*a* that moves upward, and a fastener pressing portion 191 according to the modification includes a plurality of claws 192. The details thereof will be described below.

The lifting device 182 includes a cylinder device 183 in which the piston rod 183*a* moves upward, two guide rods 184 extending parallel to the piston rod 183*a* of the cylinder device 183, a connecting plate 185 that connects a tip end portion (an upper end portion) of the piston rod 183*a* and upper end portions of the guide rods 184, linear bushes 186 that guide the piston rod 183*a* and the two guide rods 184 to be displaceable in the upward-downward direction and are separately fixed to the slide block 176 of the second conveying device main body portion 174, and a stopper 187 that protrudes downward from the connecting plate 185 and determines a lower limit position of the piston rod 183*a*. The stopper 187 includes a bolt and a nut, and is fixed to the connecting plate 185.

A cylinder 183*b* of the cylinder device 183 is fixed to a lower surface of the slide block 176, the piston rod 183*a* of the cylinder device 183 penetrates through one linear bush 186 and protrudes upward, and a tip portion (an upper end portion) of the piston rod 183*a* is fixed to the connecting plate 185 via a floating joint 185*a*. In addition, the two guide rods 184 also penetrate the linear bushes 186 in the upward-downward direction. The floating joint 185*a* does not interfere with the movement of the piston rod 183*a* even when guide rods 184 and the piston rod 183*a* slightly deviate from a parallel state. When the piston rod 183*a* moves backward and downward, the stopper 187 collides with the slide block 176, and the lower limit position of the piston rod 183*a* is determined.

The fastener pressing portion 191 according to the modification includes the plurality of claws 192 arranged at intervals in the conveying direction, a suspending portion 193 that supports the plurality of claws 192 in a suspended state and is fixed to lower end portions of the two guide rods 184, guide portions 194 that respectively guide the claws 192 to be displaceable in the upward-downward direction, and elastic members 195 that respectively press the claws 192 downward.

The suspending portion 193 includes a first fixed plate 201 that is fixed to the lower end portions of the two guide rods 184 and extends in the conveying direction, second fixed plates 202 that are respectively fixed to the first fixed plate 201 by bolts 197 at intervals in the conveying direction and extend to one side (the rear side) in the direction (the forward-rearward direction) orthogonal to the conveying direction, and third fixed plates 203 that are respectively fixed to tip portions of the second and subsequent second fixed plates 202 from the upstream side in the conveying direction by bolts 198.

Groove portions 201*a* recessed in a stepped manner are formed on an upper surface of the first fixed plate 201 at intervals in the conveying direction. The groove portions 201*a* penetrate the first fixed plate 201 in the direction orthogonal to the conveying direction in a plan view.

A long hole 202*a* extending in the forward-rearward direction is formed in a front portion (a portion placed on the first fixed plate 201) of each second fixed plate 202 in order to adjust a position at which the second fixed plate 202 is fixed by the bolt 197. In addition, a long hole 202*b* extending in the forward-rearward direction is also formed in a rear portion of each of the second and subsequent second fixed plates 202 from the upstream side in the conveying direction to penetrate in the upward-downward direction in order to adjust a position at which the second fixed plate 202 is fixed by the bolt 198. In addition, a tip portion (an end portion away from the first fixed plate 202) of the first second fixed plate 202 from the upstream side in the conveying direction has a larger thickness in the upward-downward direction than that of the rest of the second fixed plates 202.

Groove portions 203*a* recessed in a stepped manner are formed on intermediate portions of the upper surfaces of the third fixed plates 203 in the conveying direction. The groove portions 203*a* penetrate the third fixed plates 203 in the direction (the forward-rearward direction) orthogonal to the conveying direction in a plan view. Each third fixed plate 203 is fixed by the bolt 198 in a state in which the groove portion 203*a* is overlapped with a lower surface of the tip portion of the second fixed plate 202, and is in a state of protruding in the conveying direction (the right-left direction) with respect to the tip portion of the second fixed plate 202. A tip end surface (a rear end surface) of the third fixed plate 203 has a stepped shape in which a central portion 203*c* in the left-right direction protrudes rearward from left and right side portions. This central portion 203*c* is referred to as the step portion 203*c*. Further, a through hole (not shown) penetrating in the upward-downward direction is formed in each of left and right end portions of the third fixed plate 203. The guide portion 194 is attached to the third fixed plate 203 by using the through holes.

Each guide portion 194 includes a guide tube 205 that is inserted in a state of penetrating the through holes of the third fixed plate 203 in the upward-downward direction, a retaining ring (not shown) that is fitted to upper and lower end portions of the guide tube 205 and positions the guide tube 205 on the third fixed plate 203, a rod 206 that is inserted in a state of penetrating the guide tube 205 in the upward-downward direction, and an annular stopper 208 that is fixed to an upper end surface of the rod 206 by a bolt 207 and supports the rod 206 in a state of suspending the rod 206 from the guide tube 205.

A lower portion of the rod 206 serves as a large-diameter portion 206*a* that has a larger diameter than an upper portion above the lower portion. The claw 192 is fixed to a rear surface (a side opposite to the cylinder 183*b*) of the large-diameter portion 206*a* by one bolt 211 via an annular spacer 209. The claw 192 is guided by the rod 206 and the guide tube 205 to be displaceable in the upward-downward direction. In addition, the compression coil spring 195 as the elastic member 195 is passed through the rod 206 at a portion above the large-diameter portion 206*a* in a state of being placed on the large-diameter portion 206*a*. The compression coil spring 195 is in a state of contracting between the third fixed plate 203 and the large-diameter portion 206*a*, and presses the claw 192 downward.

Each claw 192 includes a guide plate portion 192*a* that extends in the upward-downward direction and is fixed to the spacer 209 by the bolt 211, an intermediate plate portion 192*b* that extends horizontally from a lower portion of the guide plate portion 192*a* toward the rearward direction (toward a side opposite to the rod 206), and a claw main body portion 192*c* that extends downward from a tip portion of the intermediate plate portion 192*b*.

Each of the second and subsequent claws from the upstream side in the conveying direction is formed by bending a single elongated plate. An upper portion of the guide plate portion 192*a* is overlapped with a left side portion or a right side portion of a tip end surface (a rear end surface) of the third fixed plate 203. In order to maintain this overlapped state, a bolt 212 is fixed to left and right side surfaces of the third fixed plate 203 via a washer 212*a*. A part of the washer 212*a* is in a state of protruding rearward with respect to the third fixed plate 203. Since the guide plate portion 192*a* is guided in a state of being sandwiched between the left or right washer 212*a* and the step portion 203*c*, an upper portion of each of the second and subsequent claws 192 is guided to be displaceable in the upward-downward direction.

The first claw 192 from the upstream side in the conveying direction is formed such that the tip portion of the intermediate plate portion is wide in the left-right direction, and the two claw main body portions 192*c* are in a state of extending downward from left and right sides of the tip portion of the intermediate plate portion 192*b*. In the first claw 192, the upper portion of the guide plate portion 192*a* is overlapped with a tip end surface of the second fixed plate 202. In order to maintain this overlapped state, a bolt 213 is fixed to left and right side surfaces of the tip portion (the rear portion) of the second fixed plate 202 via washers 213*a*. A part of the washer 213*a* is in a state of protruding rearward with respect to the second fixed plate. Since the guide plate portion 192*c* is guided in a state of being sandwiched between the left and right washer 213*a*, an upper portion of the first claw 192 is guided to be displaceable in the upward-downward direction.

In a modification of the fastener pressing portion 171 as described above, since the plurality of claws 192 are independently displaceable in the upward-downward direction while being pressed downward by the compression coil springs 195, even when a thickness of a portion pressed by each claw 192 (a thickness of the fly 1 and the pressing-side tape 3*a* overlapped with each other) is different, it is possible to uniformly press the fly 1 and the pressing-side tape 3*a* overlapped with each other over the entire length in the conveying direction.

By using the fastener base 15, the fastener supplying device 121, the discharge device 122, and the second conveying device 123 as described above, the fastener supply process to the fly in procedure 4) is performed as follows in the order of procedures 4-1) to 4-15).

In procedure 4-1), the body presence sensor 167 of the fastener base 15 detects the presence of the slider body 5*a*. This detection process is repeated until the body presence sensor 167 is turned ON. When the fastener 2 is appropriately placed on the fastener base 15, the body presence sensor 167 is turned ON.

In procedure 4-2), when the body presence sensor 167 is turned ON and the slider 5 is detected, it is detected whether an ON operation of the start button for starting the supply of the fastener 2 is performed. In a case of OFF, the process returns to the process in procedure 4-1).

In procedure 4-3), when the ON operation of the start button is performed, the process of the image sensor 168 is started.

In procedure 4-3A), when the output of the image sensor 168 indicates abnormality, a confirmation process is performed. In the confirmation process, a confirmation screen for confirming whether a process to be performed thereafter may be continued is output to the control device in 1). The confirmation screen displays information for understanding that the slider 5 is in an abnormal state, and a button for selecting whether to continue the process or to interrupt the process. When the continuation of the process is selected, the process returns to the process in step 1) when the total number of times of selection is equal to or less than the set number of times (for example, three times) in 2). When the total number of times of selection exceeds the set number of times, the process proceeds to a process in procedure 4-4). When the interruption of the process is selected, the process proceeds to a warning process in procedure 4-3B) in 2).

In procedure 4-3B), a warning is issued to notify that an abnormality occurs. For example, an abnormality of the fastener 2 is displayed on the operation panel of the control device.

In procedure 4-4), when the output of the image sensor 168 indicates normality, the fastener base conveying device 131 is driven, and the fastener base 15 advances toward the sewing table portion 13*a*.

In procedure 4-4A), the suction unit conveying device 134 is driven with the advance of the fastener base 15, and the fastener suction unit 133 advances toward the sewing table portion 13*a*.

In procedure 4-4B), the second conveying device 123 is driven with the advance of the fastener base 15, and the fastener pressing unit 181 moves from a pressing position to a standby position.

In procedure 4-5), the fastener base lifting device 132 is driven, the fastener base 15 moves upward, the suction port portions 141 are disposed immediately above the fastener 2, and the fastener 2 and the suction port portions 141 come into contact with each other.

In procedure 4-6), the air is sucked from the suction port portions 141, and the fastener 2 is attracted to the suction port portions 141.

In procedure 4-7), the fastener base lifting device 132 is driven, and the fastener base 15 moves downward.

In procedure 4-8), the fastener base conveying device 131 is driven, and the fastener base 15 retracts and separates from above the sewing table portion 13*a*.

In procedure 4-9), it is determined whether the fastener base 15 has passed through a safe position. This determination process is repeated until the fastener base 15 has passed through the safe position. The safe position refers to a position at which the fastener base 15 and the fastener suction unit 133 do not come into contact with each other even when the fastener suction unit 133 is caused to move downward. In addition, the safe position also refers to a position at which the fastener base 15 and the fastener pressing unit 173 do not come into contact with each other even when the fastener pressing unit 173 is caused to move downward. Here, an automatic switch for the cylinder device of the fastener base conveying device 131 is used to confirm the safe position. When the automatic switch detects that the fastener base 15 reaches the safe position, that is, when the fastener base 15 has passed through the safe position, the process proceeds to the next process. Although the cylinder device is used as the fastener base conveying device 131 in the present embodiment, for example, when the device that converts the rotational motion of the servomotor into the linear reciprocating motion is used, it is also possible to determine whether the fastener base 15 has reached the safe position based on whether the number of rotations of the servomotor reaches the set number of times.

In procedure 4-10), the lifting device 142 of the fastener suction unit 133 is driven, the suction port portions 141 moves downward, and the fastener 2 held by the suction port portions 141 is placed on the fly 1.

In procedure 4-10A), the fastener pressing unit 173 moves from the standby position to the pressing position immediately above the belt 73*a* of the second conveyor 73 on the upstream side in the conveying direction together with the downward movement of suction port portions 141.

In procedure 4-11), it is detected whether all (three) fastener set sensors 154 are turned ON or turned OFF. When all the fastener set sensors 154 are turned ON, the fastener 2 is at a normal position. When any one of the fastener set sensors 154 is turned OFF, the fastener 2 is at an abnormal position. Incidentally, it is assumed that the long fastener 2 is used in this embodiment.

In procedure 4-12), when all the fastener set sensors 154 are turned ON and it is determined that the fastener 2 is at the normal position, the lifting device 172 of the fastener pressing unit 173 is driven, the fastener pressing portion 171 moves downward, the fastener 2 is pressed against the belt 73*a* of the second conveyor 73 via the fly 1, and the fastener 2 and the fly 1 are sandwiched in an overlapped state between the fastener pressing portion 171 and the belt 73*a* of the second conveyor 73.

In procedure 4-13), the suction of the air by the suction port portions 141 is stopped, the lifting device 142 of the fastener suction unit 133 is driven, and the suction port portions 141 move upward. Further, the third suction hole group 115G stops the suction.

In procedure 4-14), the suction unit conveying device 134 is driven, the fastener suction unit 133 retracts, and the suction port portions 141 separate from above the belt 73*a*. Then, the process proceeds to the sew process of the fly and the fastener in procedure 5).

On the other hand, when it is determined in procedure 4-11) that the fastener 2 is at the abnormal position, the process proceeds to the discharge process of the fly and the fastener in procedure 7) after the processes in procedures 4-14) and 4-15). In procedure 7), the discharge device 122 is driven, the air is discharged from the blowing portions 122*a* within a predetermined time, and the fly 1 and the fastener 2 are blown off from the sewing table portion 13*a*. Then, the process returns to the fly supply process from the fly bundle in procedure 1) and the fly conveyance process before the sewing in procedure 2).

As illustrated in FIG. 38, the second sewing machine 124 includes a sewing machine main body 124*a* that sews the fly 1 and a sewing machine foot 220. The second sewing machine 124 is provided to be movable in the forward-rearward direction. When the second sewing machine 124 moves rearward, needles 231 and the like of the second sewing machine 124 are detached from above the sewing table portion 13*a*, and the maintenance of the second sewing machine 124 is facilitated.

The sewing machine main body 124*a* is well-known, and forms the seam S1 on the fly 1 and the fastener 2 placed on the sewing table portion 13*a* by entangling an upper thread passed through the needles 231 and a lower thread supplied to a lower side of the needle hole of the sewing table portion 13*a*. The upper thread, the lower thread, and the needle hole are not shown. Incidentally, in the present embodiment, the sewing machine main body 124*a* is a double thread chain stitch sewing machine, and is configured to form the linear seam S1 in a dotted-line shape on the fly 1 by the cooperation between the second conveying device 123 and the second conveyor 73.

As illustrated in FIG. 40, the sewing machine main body 124*a* includes a bed portion (not shown) provided on a lower side with respect to the sewing table portion 13*a*, a post portion 232 standing up from the bed portion, and a sewing machine head portion 233 extending from an upper portion of the post portion 232 in a state of facing the bed portion above the bed portion. In addition, in the sewing machine main body 124*a*, the bed portion and the sewing machine head portion 233 extend in the forward-rearward direction in a state of being separated from each other in the upward-downward direction, and the post portion 232 extends in the upward-downward direction in a manner of being sandwiched between the bed portion and a rear portion of the sewing machine head portion 233.

A mechanism for entangling the lower thread with the upper thread is incorporated in the bed portion. For example, a mechanism that interlocks an internal mechanism of the sewing machine head portion 233 and an internal mechanism of the bed portion is incorporated in the post portion 232.

The sewing machine head portion 233 includes a sewing machine head case (a reference numeral thereof is omitted) forming a contour of the sewing machine head portion 233, and the internal mechanism accommodated in the sewing machine head case. Incidentally, this internal mechanism is a needle bar upward-and-downward movement mechanism, a balance-driving mechanism, a sewing machine foot driving mechanism, or the like. A connecting rod 234 of the sewing machine foot driving mechanism protrudes downward from a lower surface of a tip portion of the sewing machine head case. Further, the sewing machine foot 220 is fixed to a lower end portion of the connecting rod 234.

As illustrated in FIG. 38, the sewing machine foot 220 includes a fixed portion 221 that is fixed to the connecting rod 234 and extends downward, and a foot portion 222 that extends from a lower end portion of the fixed portion 221 to the upstream side in the conveying direction X. Needle holes 223 penetrating in the upward-downward direction are formed in the foot portion 222. In the illustrated example, the two needle holes 223 are formed at an interval in the forward-rearward direction.

As illustrated in FIGS. 38 and 39, a front surface of the foot portion 222 is a surface that faces the element row 4L during the sewing in a width direction of the foot portion 222. The foot portion 222 includes, at an intermediate portion of the front surface in the conveying direction X, a path correcting surface 224 that corrects a path of the slider 5 by colliding with the slider body 5*a* of the slider 5.

The path correcting surface 224 has a shape that approaches the passage of the element row 4L toward the downstream side in the conveying direction X. Specifically, the path correcting surface 224 has a shape recessed in an arc shape in a plan view. Incidentally, the center of the arc shape is located on the upstream side in the conveying direction X with respect to an end point on the downstream side in the conveying direction X of both end points of the arc shape, and is positioned on a passage side of the element row 4L with respect to an end point on the upstream side in the conveying direction X. Further, the arc shape is an arc shape obtained by substantially equally dividing an ellipse into four equal parts in a major axis direction and a minor axis direction, and more specifically, an elliptical arc shape.

In addition to the path correcting surface 224, the foot portion 222 includes, on the front surface, a guiding surface 225 that guides the slider 5 to the path correcting surface 224, and a path maintaining surface 226 that maintains the path of the slider 5 corrected by the path correcting surface 224.

The guiding surface 225 is disposed on the upstream side in the conveying direction X with respect to the path correcting surface 224. The guiding surface 225 linearly extends in the conveying direction X. More specifically, the guiding surface 225 linearly extends parallel to the conveying direction X while maintaining a relation of being aligned with a tangent line extending from the end point on the upstream side in the conveying direction X of the arc shape of the path correcting surface 224.

The path maintaining surface 226 is disposed on the downstream side in the conveying direction X with respect to the path correcting surface 224. In addition, the path maintaining surface 226 linearly extends in the conveying direction X while maintaining a relation of intersecting a tangent line extending from the end point on the downstream side in the conveying direction X of the arc shape of the path correcting surface 224.

A relation between the front surface (the guiding surface 225, the path correcting surface 224, and the path maintaining surface 226) of the foot portion 222 and the needle holes 223 of the foot portion 222 is as follows as illustrated in FIG. 42.

Of the two needle holes 223, one needle hole (on the front side) is disposed on the downstream side in the conveying direction X with respect to the path correcting surface 224. More specifically, two virtual lines 223L are drawn from both ends of the front needle hole 223 in the direction orthogonal to the conveying direction X toward the upstream side in the conveying direction X. The path correcting surface 224 exists in a region between the two virtual lines 223L, that is, an upstream region 223U of the needle hole 223. In the illustrated example, the path correcting surface 224 partially exists with respect to the upstream region 223U of the needle hole 223. That is, a part of the path correcting surface 224 on a guiding surface 225 side and the guiding surface 225 exist in the upstream region 223U of the needle hole 223, and a part of the path correcting surface 224 on a path maintaining surface 226 side does not exist in the upstream region 223U of the needle hole 223 and is positioned on the front side with respect to the upstream region 223U of the needle hole 223. The path maintaining surface 226 is positioned on the front side with respect to the upstream region 223U of the needle hole 223, the needle hole 223, and a downstream region of the needle hole 223.

In addition, as illustrated in FIGS. 38 and 40, the sewing machine head portion 233 is disposed in a state in which a needle bar 235 of the needle bar driving mechanism protrudes downward from the lower surface of the tip portion of the sewing machine head case. The needles 231 are attached to a lower end portion of the needle bar 235 in a state of extending downward via a fixture 236. In the illustrated example, the two needles 231 are attached to the fixture 236 at an interval in the forward-rearward direction. It is desirable that the needles 231 are moved upward and downward as close as possible to the element row 4L while not being in contact with the slider body 5*a* during the sewing in the width direction of the fastener 2. By this, the seam S1 can be formed as close as possible to the element row 4L. Although a limit position of the seam S1 in the width direction of the fastener 2 varies depending on a thickness of the needles 231, the limit position is a position at which the needles 231 are brought closest to a virtual limit line 5L drawn in parallel with the longitudinal direction of the fastener 2 while not being in contact with the virtual limit line 5L from the viewpoint that a width of the slider body 5*a* becomes a maximum dimension as illustrated in FIG. 41. The fastener positioning device 125 positions the fastener 2 sewn by the second sewing machine 124 on the upstream side in the conveying direction X with respect to the needles 231 of the second sewing machine 124.

As illustrated in FIGS. 38 and 40, the fastener positioning device 125 includes an element guide 240 that is capable of positioning the element row 4L of the fastener 2 in a width direction of the element guide 240 and on the upstream side in the conveying direction X with respect to the needles 231 of the second sewing machine 124 during the sewing, and a guide displacing device 260 that is capable of displacing the element guide 240 between a positioning position P1 at which the element guide 240 positions the element row 4L and a standby position P2 at which the element guide 240 is away from the element row 4L and waits.

The element guide 240 includes a guide arm 241 that is supported to be swingable in the upward-downward direction, and a pair of guide pieces 242 that protrude from a swing end of the guide arm 241 and guide the element row 4L from both sides in the width direction. The guide arm 241 has a plate shape.

As illustrated in FIG. 38 and (a) of FIG. 39, the pair of guide pieces 242 can position the element row 4L at a position that is on the upstream side in the conveying direction X with respect to the needles 231 of the second sewing machine 124 and corresponds to a range of an entire length 225L of the guiding surface 225 of the sewing machine foot 220 in the conveying direction X. The pair of guide pieces 242 position the element row 4L in a state in which the guide arm 241 is inclined downward along the conveying direction X. Further, the pair of guide pieces 242 protrude downward from a lower surface of the swing end of the guide arm 241 in a state of positioning the element row 4L. The pair of guide pieces 242 are disposed at an interval in the forward-rearward direction (the width direction of the element row 4L). As illustrated in FIG. 38, the pair of guide pieces 242 and the swing end of the guide arm 241 cooperate with each other to form a guide groove 246. As illustrated in (a) of FIG. 39, the guide groove 246 penetrates in the conveying direction X in a state of positioning the element row 4L. That is, the guide groove 246 is formed in a swing end portion of the element guide 240. A groove width of the guide groove 246 is slightly wider than a width of the element row 4L and a width of the second stopper 7. Further, the groove width of the guide groove 246 is set such that a portion on the upstream side in the conveying direction X is wider than a portion on the downstream side in the conveying direction X.

More specifically, the pair of guide pieces 242 are formed such that portions of surfaces facing each other in the width direction of the element row 4L (hereinafter, referred to as the "facing surfaces") on the downstream side in the conveying direction X are parallel to the conveying direction X. The facing surface of one guide piece 242 is linearly formed parallel to the conveying direction X over the entire length in the conveying direction X. Therefore, not only a portion on the downstream side in the conveying direction X but also a portion on the upstream side in the conveying direction X of the facing surface of this guide piece 242 are linearly formed parallel to the conveying direction X. A portion of the facing surface of another guide piece 242 on the upstream side in the conveying direction X is an inclined surface 243 that is inclined in the conveying direction X so as to be separated from the facing surface of the guide piece 242 toward the upstream side in the conveying direction X. The rest of the facing surfaces of the pair of guide pieces 242 other than the inclined surface 243 is referred to as parallel surfaces 244. The guide displacing device 260 displaces the element guide 240 including such a pair of guide pieces 242.

As illustrated in FIGS. 38 and 40, the guide displacing device 260 includes a shaft 261 that fixes a swing center side of the element guide 240, and a swing device 262 that swingably supports the shaft 261 and the entire element guide 240 with the shaft 261 as a center.

The shaft 261 is disposed above the sewing table portion 13*a* at an interval. The shaft 261 has a linearly extending rod shape. A longitudinal direction as a direction in which the shaft 261 extends is parallel to the forward-rearward direction. One end portion of the guide arm 241 is fixed to one end portion of the shaft 261. On the other hand, the swing device 262 is fixed to another end portion of the shaft 261.

In the present embodiment, the swing device 262 converts a linear reciprocating motion into a swinging motion. More specifically, the swing device 262 includes a cylinder device 270 as a linear reciprocation device, and a conversion device 280 that is connected to a piston rod 271 of the cylinder device 270 and the shaft 261 and converts the linear reciprocating motion into the swinging motion. In the present embodiment, the swing device 262 converts the linear reciprocating motion into the swinging motion, but the present invention is not limited thereto, and a motor may be used so as to be capable of rotating the shaft 261 clockwise and counterclockwise within a predetermined angle range.

The conversion device 280 includes a bearing portion 290 that supports the other end portion (an end portion on a side opposite to the element guide 240) of the shaft 261 in a swingable manner (rotatable in the predetermined angle range), a crank 300 that also uses the shaft 261 as a crank shaft, a transmission block 310 that is fixed to a tip portion of the piston rod 271 of the cylinder device 270 and transmits the movement of the piston rod 271 to a crank pin 301 of the crank 300, and a tension spring 320 that is bridged between a cylinder 272 of the cylinder device 270 and the crank pin 301 of the crank 300 and engages the transmission block 310 and the crank pin 301 in an interlocking manner.

The cylinder device 270 includes the cylinder 272 that is disposed on the downstream side in the conveying direction X with respect to the shaft 261, and the piston rod 271 that protrudes toward the upstream side in the conveying direction X with respect to the cylinder 272.

The crank 300 includes the shaft 261 that is also used as the crank shaft, a crank arm 302 that is fixed to the shaft 261 in a state of extending in a radial direction and swings the shaft 261, and the crank pin 301 that extends parallel to the shaft 261 from a swing end portion of the crank arm 302 and toward a side opposite to the element guide 240.

In the transmission block 310, a surface facing the swing end portion of the crank arm 302 is a surface having a step in the direction orthogonal to the conveying direction X. More specifically, the surface of the transmission block 310 facing the swing end portion of the crank arm 302 is formed by recessing a portion on the upstream side in the conveying direction X toward the direction (the rearward direction) orthogonal to the conveying direction X in a stepped manner with respect to a portion on the downstream side in the conveying direction X. Therefore, in the transmission block 310, a step surface 311 is formed at a boundary between the portion on the upstream side and the portion on the downstream side in the conveying direction X. The step surface 311 is a surface orthogonal to the conveying direction X and is a guide surface that guides a tip portion of the crank pin 301 so as to be movable in the upward-downward direction.

The tension spring 320 presses the tip portion of the crank pin 301 against the step surface 311. In addition, the tension spring 320 presses, by a restoring force thereof, the swing end portion of the element guide 240 downward toward the sewing table portion 13*a*. Further, when the slider 5 passes under the element guide 240 while the fastener 2 is conveyed in a state of being overlapped on the fly 1, the element guide 240 is displaced upward against the restoring force of the tension spring 320 in a manner of being pushed up by the slider 5. Incidentally, one end portion of the tension spring 320 is hooked through a hole of a bracket 273 fixed to the cylinder 272. Another end portion of the tension spring 320 is hooked on the crank pin 301 as described above.

The bearing portion 290 includes a base block 291 that is fixed onto the sewing table portion 13*a* and through which the shaft 261 penetrates, a bush 292 that is provided between the shaft 261 and a through hole (not shown) penetrating in a longitudinal direction of the shaft 261 and formed in the base block 291, and swingably supports the shaft 261, and a flange 295 and a collar 296 that are fixed to the shaft 261 on both sides in the longitudinal direction of the shaft 261 with respect to the base block 291. The flange 295 is positioned on an element guide 240 side with respect to the base block 291, and the collar 296 is positioned on a side opposite to the element guide 240 with respect to the base block 291.

The bush 292 includes a cylindrical bush main body portion (not shown) and a bush flange portion 293 that protrudes in a flange shape from one end portion of the bush main body portion in a penetrating direction. Incidentally, the bush flange portion 293 is disposed between the collar 296 on the side opposite to the element guide 240 and the base block 291, and is fixed to the base block 291 by bolts.

The flange 295 and the collar 296 have an annular shape, and are fixed to the shaft 261 in a state of protruding outward in the radial direction. The crank arm 302 is fixed to the flange 295 by bolts.

The base block 291 extends in the conveying direction X. The through hole through which the shaft 261 passes together with the bush main body portion as described above is formed in a portion of the base block 291 on the upstream side in the conveying direction X. The cylinder 272 of the cylinder device 270 is fixed above a portion of the base block 291 on the downstream side in the conveying direction X. In the illustrated example, an upper surface of the portion of the base block 291 on the upstream side in the conveying direction X is higher than an upper surface of the portion of the base block 291 on the downstream side in the conveying direction X. An interval is provided between the upper surface of the portion of the base block 291 on the upstream side in the conveying direction X and the transmission block 310 to ensure the reciprocating movement of the transmission block 310.

As described above, the fastener positioning device 125 includes the element guide 240 and the sewing machine foot 220. In a state in which the sewing machine foot 220 moves downward to press the sewn workpieces and the element guide 240 moves downward to be positioned at the positioning position P1 (a state in which the swing end portion of the element guide 240 is in contact with the pair of tapes 3*a* and 3*b*), the element guide 240 and the sewing machine foot 220 function as the following (1) to (6).

1) When the fastener pressing portion 171 moves in the conveying direction X, the second stopper 7 on a tip side of the element row 4L enters a portion between the pair of guide pieces 242 of the element guide 240 and is guided by a wide portion of the inclined surface 243, and then passes between the pair of parallel surfaces 244 to be positioned. When the second stopper 7 is positioned, the element row 4L slightly smaller than the second stopper 7 in width is also positioned, and after the second stopper 7 passes through the element guide 240, the element row 4L is in a state of being guided between the pair of guide pieces 242. As a result, the sewing-side tape 3*b* is also in a positioned state, the sewing-side tape 3*b* and the fly 1 are sewn in this state, and the seam S1 is linearly formed in a dotted-line shape in the conveying direction X. In the example of FIG. 38, the sewing is performed by using the two needles 231, and thus two seams S1 are formed in parallel in the forward-rearward direction. In a case in which the sewing is performed by using one needle 231, one seam S1 is formed as illustrated in FIG. 43. In this case, although not shown, one needle is attached to the second sewing machine 124.

2) Further, when the fastener pressing portion 171 continuously moves in the conveying direction X, as illustrated in (a) of FIG. 39, the rear end of the element row 4L approaches the element guide 240, and the slider 5 enters a region facing the guiding surface 225 of the sewing machine foot 220. Incidentally, the fastener pressing portion 171 maintains the shape of a fastener 2 as it is (maintains a state in which the pair of tapes 3*a* and 3*b* maintain the linear portion 3S and one branched portion 3T), and presses the pressing-side tape 3*a* in a state of being parallel to the conveying direction X. As a result, the pressing-side tape 3*a* is pressed in a state of being parallel to a portion on the downstream side in the conveying direction X with the slider 5 as the boundary, that is, parallel to the conveying direction X in the case of the linear portion 3S, and is pressed in a state of being inclined with respect to a portion on the upstream side in the conveying direction X, that is, the conveying direction X in the case of the branched portion 3T.

3) Further, when the fastener pressing portion 171 continues to move in the conveying direction X, the slider 5 passes under the swing end portion of the element guide 240 while lifting the swing end portion against the restoring force of the tension spring 320, and as illustrated in (b) of FIG. 39, the slider 5 collides with the path correcting surface 224 to correct the path of the slider 5 and moves toward the front side. Incidentally, since the pressing-side tape 3*a* is pressed against the belt 73*a* of the second conveyor 73 by the fastener pressing portion 171 and is positioned, a path of the sewing-side tape 3*b* is corrected at a portion in the vicinity of the slider 5 as the slider 5 moves toward the front side, and the sewing-side tape 3*b* moves to approach the pressing-side tape 3*a*. Further, the sewing-side tape 3*b* is sewn to the fly 1 while the path thereof is corrected.

4) Further, when the fastener pressing portion 171 continues to move in the conveying direction X, as illustrated in (c) of FIG. 39, the slider 5 passes through the path correcting surface 224, the slider 5 whose path is corrected starts to move along the path maintaining surface 226, and a path of the branched portion 3T of the sewing-side tape 3*b* is also corrected.

5) Further, when the fastener pressing portion 171 continues to move in the conveying direction X, as illustrated in (d) of FIG. 39, the slider 5 continues to move along the path maintaining surface 226, and the sewing-side tape 3*b* and the fly 1 are sewn in a state in which the path of the branched portion 3T of the sewing-side tape 3*b* has been corrected.

6) Further, when the fastener pressing portion 171 continues to move in the conveying direction X, the slider 5 passes through the path maintaining surface 226, and the rear end of the fly 1 passes immediately below the needles 231.

In the fastener positioning device 125 as described above, since the element row 4L can be positioned by disposing the element guide 240 at the positioning position P1 in a state of pressing the fly 1 from above the pressing-side tape 3*a* and positioning the fly 1, the fly 1 is sufficiently positioned, and as a result, the shape of the sewn sewing-side tape 3*b* is approximated to a straight line as compared with a fastener positioning device that presses and sews only the pressing-side tape 3*a*.

Further, since the fastener positioning device 125 includes the sewing machine foot 220 formed with the path correcting surface 224, and brings the path correcting surface 224 close to the passage of the element row 4L toward the downstream side in the conveying direction X, the path of the slider 5 is corrected by colliding with the path correcting surface 224, and accordingly, the path is also corrected at the portion of the sewing-side tape 3*b* in the vicinity of the slider 5, and the shape of the sewn sewing-side tape 3*b* and the seam S1 are approximated to a straight line in a manner of including the vicinity of the slider 5 as compared with a sewing device that includes the sewing machine foot 220 without the path correcting surface 224.

In the fastener positioning device 125, the path correcting surface 224 is recessed in an arc shape in the plan view, and the path of the slider 5 is smoothly corrected along the arc shape, and thus the shape of the sewn sewing-side tape 3*b* and the seam S1 are approximated to a straight line in a manner of including the vicinity of the slider 5.

In the fastener positioning device 125, the sewing machine foot 220 includes the front needle hole 223 at a position separated from the path correcting surface 224 on the downstream side in the conveying direction X, and thus the seam S1 can be formed to be close to the element row 4L as compared with a fastener positioning device that includes a needle hole at a position separated from the path correcting surface 224 in the direction orthogonal to the conveying direction in a plan view, for example.

In addition, since the fastener positioning device 125 includes the sewing machine foot 220 formed with the path maintaining surface 226, and the path maintaining surface 226 extends linearly in the conveying direction X, the slider 5 whose path has been corrected is conveyed along the path maintaining surface 226, and accordingly, the portion of the sewing-side tape 3*b* on the upstream side in the conveying direction X with respect to the slider 5, that is, the path of the branched portion 3T is also corrected, and the shape of the sewn sewing-side tape 3*b* and the seam S1 are approximated to a straight line in a manner of including the vicinity of the slider 5 as compared with a fastener positioning device that includes the sewing machine foot 220 without the path maintaining surface 226.

Further, since the fastener positioning device 125 includes the sewing machine foot 220 formed with guiding surface 225, and the guiding surface 225 extends linearly in the conveying direction X, the slider 5 is smoothly guided to the path correcting surface 224 after being conveyed along the guiding surface 225, and the shape of the sewn sewing-side tape 3*b* and the seam S1 are approximated to a straight line in a manner of including the vicinity of the slider 5 as compared with a fastener positioning device that includes the sewing machine foot 220 without the guiding surface 225.

In the fastener positioning device 125, since the element guide 240 can position the element row 4L at the position that is on the upstream side in the conveying direction X with respect to the needles 231 of the second sewing machine 124 and corresponds to the range of the entire length 225L of the guiding surface 225 of the sewing machine foot 220 in the conveying direction X, by displacing the element guide 240 to the standby position P2 after finishing the sewing in a state in which the element guide 240 positions the element row 4L at a position as close as possible to the slider 5, a time difference between the completion of the sewing in the state in which the element guide 240 positions the element row 4L and the start of the sewing in a state in which the sewing machine foot 220 corrects the path of the slider 5 on the path correcting surface 224 can be reduced, and the shape of the sewn sewing-side tape 3*b* and the seam S1 are approximated to a straight line in a manner of including the vicinity of the slider 5 as compared with a fastener positioning device in which the time difference is large.

In the example described above, the fastener positioning device 125 includes the element guide 240 and the guide displacing device 260, but may be set to a modification as illustrated in FIGS. 44 to 48. A fastener positioning device 125A according to the modification includes, in addition to the guide displacing device 260 having the same configuration as that of the previous example and an element guide 240A according to the modification slightly different from that of the previous example, a tape guide 330 that is inserted between the pair of tapes 3*a* and 3*b* at a tip end portion (an end portion on the upstream side in the conveying direction) of the fastener 2 on the upstream side in the conveying direction with respect to the needles 231 of the second sewing machine 124, a support portion 340 that is fixed on the element guide 240A and supports the tape guide 330 so as to be swingable in the upward-downward direction, and an elastic member 360 that is configured to press downward a tip portion (an end portion on the downstream side in the conveying direction) of the tape guide 330 with the support portion 340 as a supporting point.

The elastic member 360 is a compression coil spring. A hole 332*h* for accommodating the elastic member 360 is formed in a lower surface of an end portion of the tape guide 330 on the upstream side in the conveying direction. The elastic member 360 accommodated in the hole 332*h* acts to push upward the end portion of the tape guide 330 on the upstream side. Therefore, the end portion of the tape guide 330 on the upstream side serves as a force applying point at which a restoring force of the elastic member 360 is applied to the swingable tape guide 330.

The element guide 240A includes, in addition to the guide groove 246 formed between the pair of guide pieces 242, a through groove 247 that penetrates in the upward-downward direction and through which the tip portion of the tape guide 330 passes in cooperation with the guide groove 246. The through groove 247 is formed such that a portion on the upstream side in the conveying direction is narrower than a portion on the downstream side in the conveying direction in both directions orthogonal to the conveying direction. The portion of the through groove 247 on the downstream side in the conveying direction is also a part of the guide groove 246, and corresponds to the interval between the pair of guide pieces 242. The portion of the through groove 247 on the upstream side in the conveying direction is narrower than the interval between the pair of guide pieces 242. The tip portion (the end portion on the downstream side) of the tape guide 330 is accommodated in a central portion of the through groove 247 in a width direction, and the tip portion of the tape guide 330 is also accommodated in the guide groove 246. Incidentally, in FIGS. 46 and 47, a tip end portion of the tape guide 330 slightly protrudes downward from a lower end surface of the element guide 240A and the guide groove 246.

The tape guide 330 includes a tape guide main body portion 331 that is inserted between the pair of tapes 3*a* and 3*b*, and a swing arm portion 332 that is fixed to the tape guide main body portion 331 and is swingably supported.

The tape guide main body portion 331 has a plate shape in which the direction orthogonal to the conveying direction is set to a thickness direction. In addition, regarding the thickness, an upper portion of the tape guide main body portion 331 is formed to be thinner than a lower portion thereof. A step surface 331*a* is formed at a boundary between the upper portion and the lower portion of the tape guide main body portion 331.

Regarding the thickness, the swing arm portion 332 is thicker than the tape guide main body portion 331. Regarding the length in the conveying direction, the swing arm portion 332 is longer than the tape guide main body portion 331. Further, a portion of the swing arm portion 332 on the downstream side in the conveying direction and the tape guide main body portion 331 are overlapped with each other in the thickness direction and are fixed by bolts 333. The swing arm portion 332 is in a state of being placed on the step surface 331*a* of the tape guide main body portion 331. On the other hand, a portion of the swing arm portion 332 on the upstream side in the conveying direction protrudes on the upstream side in the conveying direction with respect to the tape guide main body portion 331. The support portion 340 supports the tape guide 330.

The support portion 340 includes a shaft 341 that serves as a supporting point swingably supporting the tape guide 330, a support block 342 that supports the tape guide 330 with the shaft 341 as the supporting point, and a height adjusting portion 343 that presses the tape guide 330 from above, opposite to the elastic member 360, and adjusts a height position of a tip portion of the tape guide 330.

Regarding the thickness direction, a portion 342*a* of the support block 342 on the downstream side in the conveying direction is formed to be thinner than a portion 342*b* on the upstream side in the conveying direction. A step surface 342*c* is formed at a boundary between the portion 342*a* on the downstream side and the portion 342*b* on the upstream side in the conveying direction.

The portion 342*a* of the support block 342 on the downstream side in the conveying direction refers to the swing support portion 342*a* for swingably supporting the tape guide 330, and the portion 342*b* of the support block 342 on the upstream side in the conveying direction refers to the fixed portion 342*b* for fixing to the element guide 240A.

The portion of the swing arm portion 332 on the upstream side in the tape guide 330 is overlapped on the swing support portion 342*a*, and the swing arm portion 332 is swingably supported by the swing support portion 342*a* via the shaft 341. A bolt is used as the shaft 341. In order to fix a tip portion of the shaft 341, a female screw hole 342*d* penetrating in the thickness direction is formed in the swing support portion 342*a*. In addition, a through hole 332*a* through which the shaft 341 is passed is formed in the swing arm portion 332 to penetrate in the thickness direction. The height adjusting portion 343 is fixed on the fixed portion 342*b*.

The height adjusting portion 343 includes an upper plate portion 344 that is placed on the support block 342, and an adjusting screw 345 that is fixed to the upper plate portion 344 and presses the tape guide 330 from above opposite to the elastic member 360.

The upper plate portion 344 is fixed to the element guide 240A together with the fixed portion 342*b* by bolts 346. Therefore, through holes 342*h* and 344*a* penetrating in the upward-downward direction are formed in the fixed portion 342*b* and the upper plate portion 344, respectively, and female screw holes 248 are formed in the element guide 240A to penetrate in the upward-downward direction. In addition, the upper plate portion 344 includes a portion that is placed on the support block 342 and a covering portion that protrudes from the support block 342 and covers the portion of the swing arm portion 332 on the upstream side from above. A female screw hole 344*b* into which the adjusting screw 345 is screwed is formed in the covering portion to penetrate in the upward-downward direction. A nut 347 is screwed into the adjusting screw 345. When the nut 347 is pressed against an upper surface of the covering portion of the upper plate portion 344, a position of the adjusting screw 345 is fixed. Further, a lower portion of the adjusting screw 345 protrudes downward from the covering portion, presses the swing arm portion 332 from the upper side (a side opposite to the elastic member 360), and determines the height position (a lower end position) of the tip portion of the tape guide 330.

In the fastener positioning device 125A according to the modification as described above, when the fastener 2 is conveyed in a state of being placed on the fly 1, first, a tip end (a downstream end in the conveying direction) of the fastener 2 approaches the tape guide main body portion 331, the tape guide main body portion 331 is inserted between the pair of tapes 3*a* and 3*b*, and the pair of tapes 3*a* and 3*b* are positioned in the width direction. As illustrated in FIG. 47, the facing side edge portions of the pair of tapes 3*a* and 3*b* are core portions 3*a*1 and 3*b*1. Regarding the core portions 3*a*1 and 3*b*1 of the pair of tapes, the core portions 3*a*1 and 3*b*1 are formed to be thicker in the upward-downward direction than outer side portions in the width direction. Further, the second stopper 7 of the fastener 2 approaches, and the second stopper 7 passes below the tape guide 330 while pushing up the tape guide 330, and enters the guide groove 246.

As illustrated in FIG. 48, the loop cutting device 126 as a sewing thread cutting device is disposed on the downstream side in the conveying direction with respect to the sewing machine foot 220 of the second sewing machine 124. In addition, the loop cutting device 126 includes a cutter 370 that cuts the loop, a cutter displacing device 380 that can displace the cutter 370 in the forward-rearward direction, a thread presser 390 that presses the loop on the sewing table portion 13*a*, and a thread presser displacing device 400 that can displace the thread presser 390 in the upward-downward direction. In the present embodiment, the second sewing machine 124 also forms the loop S0 after the rear end of the fly 1 passes through the second sewing machine 124, and thus the loop S0 extends from the rear end of the fly 1, a weft cutting device cuts the loop, and the weft cutting device functions as a loop cutting device, however, when any loop is not formed after the rear end of the fly 1 passes through the second sewing machine 124 or when the second sewing machine 124 is a lock-sew sewing machine, the sewing thread extends from the rear end of the fly 1 instead of the loop, and thus the sewing thread cutting device cuts the sewing thread.

The loop cutting device 126 cuts the loop extending from the rear end of the fly 1, and thus the preceding fly 1 that has passed through the loop cutting device 126 and the subsequent fly 1 that is being sewn by the second sewing machine 124 are not connected via the loop, however, the preceding fly 1 and the subsequent fly 1 are connected via the loop when there is no loop cutting device 126, and thus the loop cutting device 126 cuts the loop connecting the preceding fly 1 and the subsequent fly 1 under the presupposition that there is no loop cutting device 126.

As illustrated in FIG. 49, the cutter displacing device 380 includes a cylinder device 381 in which a piston rod 382 moves forward, and a plurality of connecting metal fittings 384 that are connected to a tip portion of the piston rod 382 and rotatably support the disc-shaped cutter 370.

A cylinder 383 of the cylinder device 381 is fixed on the sewing table portion 13*a*. Further, the thread presser displacing device 400 is fixed to a surface of the cylinder 383 on the upstream side in the conveying direction via a plate 385.

The thread presser displacing device 400 includes a cylinder device 410 in which a cylinder 411 is fixed to the plate 385, an L-shaped lever 420 that connects a piston rod 412 moving forward of the cylinder device 410 and the thread presser 390, and a shaft 430 that connects an L-shaped bent portion of the lever 420 to a plate 385.

One portion of the lever 420 extends upward with respect to the bent portion and another portion thereof is connected to the shaft 430 in a state of extending forward with respect to the bent portion. Further, in order to connect a tip portion of the piston rod 412 and a tip portion of the one portion of the lever 420, a metal fitting 440 is fixed to the tip portion of the piston rod 412, and the metal fitting 440 and one end portion of the lever 420 are joined by a pin 450. A long hole 421 through which the pin 450 passes is formed at the one end portion of the lever 420. When the piston rod 412 reciprocates, the one end portion of the lever 420 moves within a range of the length of the long hole 421 with respect to the pin 450 that moves together with the piston rod 412, the lever 420 swings with the shaft 430 as a supporting point, and the other end portion of the lever 420 is displaced in the upward-downward direction.

The thread presser 390 has a plate shape. The thread presser 390 includes a connecting plate portion 391 that is connected to a tip portion of the other portion of the lever 420, and a thread presser main body portion 392 that extends forward of the connecting plate portion 391 and protrudes downward with respect to the connecting plate portion 391.

The sews process of the fly and the fastener in procedure 5) is performed as follows in the order of procedures 5-1) to 5-11) after the process in procedure 4) is completed.

First, after the process in procedure 4) is completed, the fastener 2 and the fly 1 are sandwiched in an overlapped state between the fastener pressing portion 171 and the belt 73*a* of the second conveyor 73.

In procedure 5-1), the second conveying device main body portion 174 for the fastener pressing unit 173 is driven, and the fastener pressing unit 173 moves forward toward the second sewing machine 124.

In procedure 5-1A), the second conveyor 73 is driven together with the forward movement of the fastener pressing unit 173. According to procedure 5-1) and procedure 5-1A), the fastener 2 and the fly 1 are conveyed toward the second sewing machine 124 while being sandwiched between the fastener pressing unit 173 and the belt 73*a* of the second conveyor 73.

In procedure 5-2), the fly-front end sensor 118 detects the presence or absence of the fly 1. This detection process is repeated until the front end of the fly 1 is detected. The fly-front end sensor 118 is positioned on the downstream side in the conveying direction with respect to the third suction hole group 115G holding the fly 1.

In procedure 5-3), when the fly-front end sensor 118 is turned ON, it is determined that the front end of the fly 1 has passed. Then, it is confirmed that the fastener pressing unit 173 has moved by a set distance after the front end of the fly 1 has passed. The set distance is determined based on a rotation amount of the servomotor 175 of the second conveying device main body portion 174 (the rotation amount after the fly-front end sensor 118 is turned ON).

In procedure 5-3A), when the fastener pressing unit 173 moves by the set distance, the sewing machine foot 220 moves downward, and the fly 1 and the fastener 2 are sandwiched under the sewing machine foot 220.

In procedure 5-3B), after the sewing machine foot 220 moves downward, the second sewing machine 124 is operated to start the sewing of the fly 1 and the fastener 2.

In procedure 5-4), it is confirmed that the fastener pressing unit 173 has further moved by the set distance after procedure 5-3).

In procedure 5-4A), when the fastener pressing unit 173 moves by the set distance, the guide displacing device 260 is driven, and the element guide 240A moves downward together with the tape guide 330 and moves from the standby position P2 to the positioning position P1.

In procedure 5-5), it is confirmed that the fastener pressing unit 173 has further moved by the set distance after procedure 5-4).

In procedure 5-5A), when the fastener pressing unit 173 moves by the set distance, the thread presser displacing device 400 is driven, and the thread presser 390 moves upward. The thread presser 390 moves upward after the operation of the second sewing machine 124 is started and after the fastener pressing unit 173 moves by the set distance, and thus the loop to be cut in procedure 5-10) to be described later is less likely to be sewn together during the sewing by the second sewing machine 124.

In procedure 5-6), it is confirmed that the fastener pressing unit 173 has further moved by the set distance after procedure 5-5).

In procedure 5-7), the second conveying device main body portion 174 for the fastener pressing unit 173 stops after procedure 5-6).

In procedure 5-7A), the second conveyor 73 is stopped together with the stop of the second conveying device main body portion 174. The sewing of the fly 1 and the fastener 2 is completed during this time, and the loop S0 is formed on the downstream side in the conveying direction from the rear end (an end on the downstream side in the conveying direction) of the fly 1.

In procedure 5-8), the second sewing machine 124 is stopped.

In procedure 5-8A), the sewing machine foot 220 moves upward together with the stop of the second sewing machine 124.

In procedure 5-8B), the element guide 240A moves upward together with the tape guide 330 along with the stop of the second sewing machine 124 and moves from the positioning position P1 to the standby position P2.

In procedure 5-9), the thread presser displacing device 400 is driven, the thread presser 390 moves downward and presses the loop S0 against the sewing table portion 13*a*.

In procedure 5-10), the cutter displacing device 380 is driven, and the cutter 370 moves forward to cut the loop S0.

In procedure 5-11), the cutter displacing device 380 is driven, and the cutter 370 retracts.

In procedure 5-12), the lifting device 172 of the fastener pressing unit 173 is driven, and the fastener pressing portion 171 moves upward. Hereinafter, the process returns to the fly supply process from the fly bundle in procedure 1) and the fly conveyance process before the sewing in procedure 2).

In the sewing device as described above, the edge overcasting is performed on the fly 1 by the cooperation of the first conveying device 68 and the first sewing machine 69, the fly 1 and the fastener 2 are sewn by the supplying and conveying device 120 and the second sewing machine 124, and thus manual work of a sewing worker can be reduced, the quality of the sewn workpieces as products can be stabilized, and the amount of sewing can also be increased. Moreover, in the sewing device as described above, the sewing workpiece to be conveyed when performing the edge overcasting is a single object, that is, only the fly 1, and as compared to a sewing device in the related art in which the sewing workpiece is the overlapped fly 1 and fastener 2, that is, includes a plurality of objects, the sewing workpiece is easy to be pressed, and as a result, the sewing workpiece can be stably conveyed, and the quality of the edge overcasting can be stabilized.

In addition, the sewing device includes the fly supplying portion 11*a*. When the fly bundle 1G is placed on the fly bundle base 17, the fly conveying device 21 conveys the fly 1 to the fly base 18, and the fly positioning device 22 positions the fly 1 on the fly base 18, thereby facilitating the supply of the fly 1 to the fly base 18.

Further, in the sewing device, the supplying and conveying device 120 includes the fastener supplying device 121 and the second conveying device 123, and thus the supply of the fastener 2 from the fastener base 15 onto the fly 1, on which the edge overcasting is finished, is facilitated by the fastener supplying device 121, and a first conveying device 68 is capable of conveying the fly 1, on which the edge overcasting is finished, on the linear conveyance path provided by the second conveying device 123, and correcting the posture and the position of the fly 1 before the fastener 2 is overlapped on the fly 1, and thus the relative positional relation between the fly 1 and the fastener 2 can be corrected according to a product specification.

Further, since the sewing device includes the tape guide 330 on the upstream side in the conveying direction with respect to the needles 231 of the second sewing machine 124, when the tape guide 330 is inserted between the pair of tapes 3*a* and 3*b* of the fastener 2, the pair of tapes 3*a* and 3*b* can be positioned before the sewing, and therefore, the finished state of the sewing between the fly 1 and the fastener 2 can be improved. In addition, since the sewing device also includes the element guide 240A, the posture of the elements 4 can also be positioned before the sewing, and thus the finished state of the sewing between the fly 1 and the fastener 2 can be improved.

Further, since the sewing device includes the loop cutting device 126 that cuts the loop S0 formed after the sewing by the second sewing machine 124, it is possible to produce a product without the loop S0 after the sewing, which extends from the rear end of the fly 1.

The present invention is not limited to the embodiments as described above, and can be appropriately changed without departing from the gist of the present invention. For example, although the loop cutting device cuts the loop extending from the rear end of the fly 1 in the above embodiment, the present invention is not limited thereto, and the loop cutting device may be configured to also cut the loop S0 extending from the front end of the fly 1.

REFERENCE SIGNS LIST

1 fly
1G fly bundle
2 fastener
3*a*, 3*b* tape
11*a* fly supplying portion
17 fly bundle base
18 fly base
21 fly conveying device
22 fly positioning device
68 first conveying device
120 supplying and conveying device
123 second conveying device
124 second sewing machine
126 loop cutting device
231 needle
S0 loop
S1 seam

The invention claimed is:

1. A sewing device, comprising:
a fly base on which a fly is to be placed;
a fastener base on which a fastener is to be placed;
a first conveying device configured to convey the fly on the fly base;
a first sewing machine configured to perform edge overcasting on the fly during conveyance by the first conveying device;
a supplying and conveying device configured to supply the fastener from the fastener base onto the fly, on which the edge overcasting is finished, in an overlapped manner, and configured to convey the fly and the fastener together; and
a second sewing machine configured to sew the fly and the fastener during conveyance by the supplying and conveying device.

2. The sewing device according to claim 1, further comprising:
a fly supplying portion configured to supply the fly onto the fly base one by one, wherein
the fly supplying portion includes
a fly bundle base on which a fly bundle formed by stacking a plurality of flies is to be placed,
a fly conveying device configured to take out the fly from the fly bundle one by one and configured to convey the fly to the fly base, and
a fly positioning device configured to position the fly supplied to the fly base.

3. The sewing device according to claim 1, wherein
the supplying and conveying device includes
a fastener supplying device configured to supply the fastener from the fastener base onto the fly, on which the edge overcasting is finished, in the overlapped manner, and
a second conveying device configured to linearly convey the fly and the fastener in an overlapped state to the second sewing machine, and
the first conveying device is capable of conveying the fly, on which the edge overcasting is finished, on a linear conveyance path provided by the second conveying device, and capable of correcting at least one of a posture and a position of the fly before the fastener is overlapped on the fly.

4. The sewing device according to claim 1, further comprising:
a tape guide configured to be inserted between a pair of tapes of the fastener on an upstream side in a conveying direction with respect to a needle of the second sewing machine.

5. The sewing device according to claim 1, further comprising:
a sewing thread cutting device configured to cut a sewing thread after sewing performed by the second sewing machine.

* * * * *